US009649851B2

(12) United States Patent
Fukasawa

(10) Patent No.: US 9,649,851 B2
(45) Date of Patent: May 16, 2017

(54) INKJET PRINTING APPARATUS AND CHECK PATTERN PRINTING METHOD

(71) Applicant: CANON KABUSHIKI KAISHA, Tokyo (JP)

(72) Inventor: Takuya Fukasawa, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/159,037

(22) Filed: May 19, 2016

(65) Prior Publication Data

US 2016/0347081 A1 Dec. 1, 2016

(30) Foreign Application Priority Data

May 28, 2015 (JP) ..... 2015-108411
May 28, 2015 (JP) ..... 2015-108439
Mar. 7, 2016 (JP) ..... 2016-043681

(51) Int. Cl.
*B41J 29/38* (2006.01)
*B41J 2/21* (2006.01)
*B41J 2/165* (2006.01)

(52) U.S. Cl.
CPC ..... *B41J 2/2103* (2013.01); *B41J 2/16579* (2013.01); *B41J 2/2114* (2013.01); *B41J 2/2142* (2013.01)

(58) Field of Classification Search
CPC ..... B41J 29/3932
See application file for complete search history.

(56) References Cited

U.S. PATENT DOCUMENTS 7,198,349 B2 4/2007 Endo et al.
8,371,677 B2 2/2013 Fukasawa
8,845,060 B2 9/2014 Azuma et al.
9,278,552 B2 3/2016 Teshigawara et al.
2005/0062782 A1* 3/2005 Endo ..... B41J 2/16579 347/19

(Continued)

FOREIGN PATENT DOCUMENTS

JP 2000-141624 A 5/2000
JP 2005-022216 A 1/2005
JP 2005022216 A 1/2005

OTHER PUBLICATIONS

European Search Report dated Oct. 5, 2016 issued in corresponding European Patent Application No. 16001154.0.

*Primary Examiner* — Juanita D Jackson
(74) *Attorney, Agent, or Firm* — Fitzpatrick, Cella, Harper & Scinto

(57) ABSTRACT

There is provided an inkjet printing apparatus. The inkjet printing apparatus includes a receiving unit configured to receive an instruction to perform check processing, and a controlling unit configured to cause a printing unit to eject a first coloring material ink, a second coloring material ink, and a clear ink so as to print a check pattern used for the check processing, wherein the printing unit prints the check pattern in which the clear ink, the first coloring material ink, and the second coloring material ink are applied to a check pattern forming area of the print medium in this order, and in the check pattern, the clear ink is colored in the second color and the first color in a direction from a surface side of the print medium toward a back side of the print medium in this order.

33 Claims, 62 Drawing Sheets

(56) References Cited

U.S. PATENT DOCUMENTS

| | | | |
|---|---|---|---|
| 2005/0093904 | A1 | 5/2005 | Ishimoto et al. |
| 2013/0021398 | A1 | 1/2013 | Mizes et al. |
| 2013/0329144 | A1 | 12/2013 | Fukasawa et al. |
| 2014/0139583 | A1 | 5/2014 | Kammerzell |

* cited by examiner

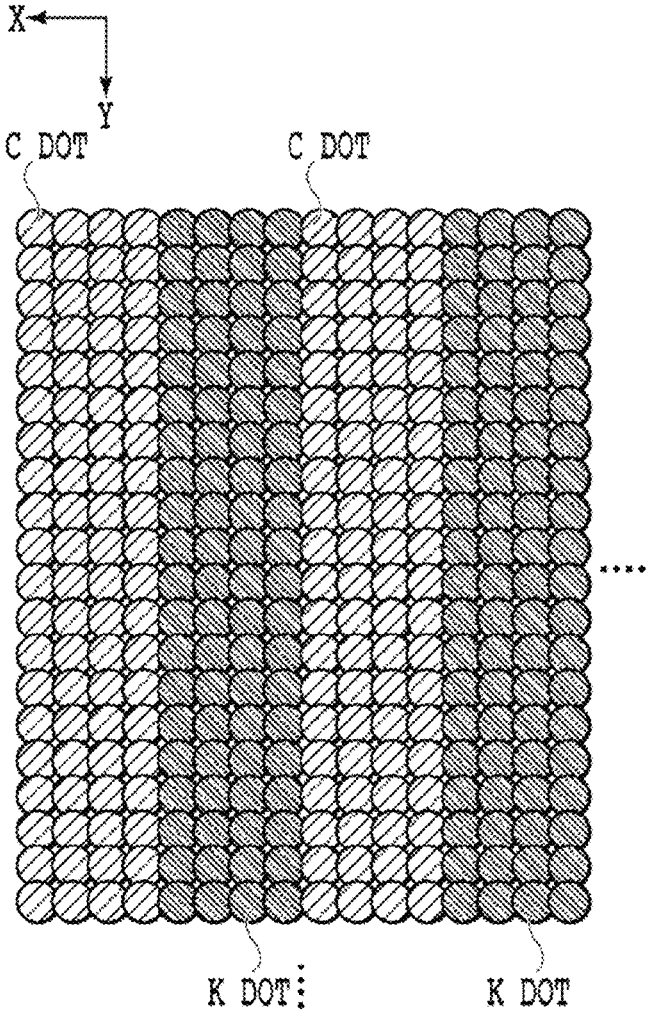
FIG.6
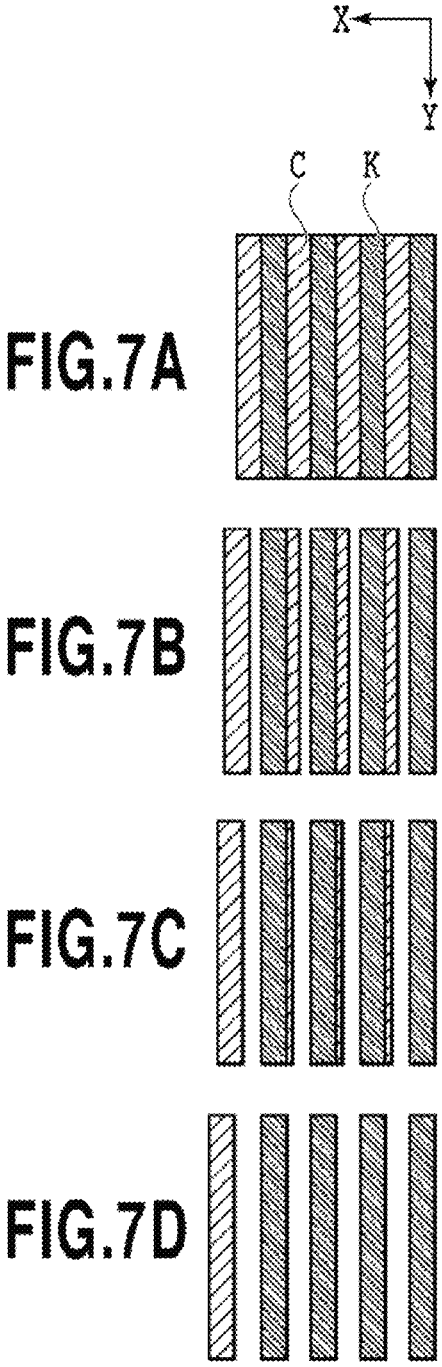

| HEAD RANK | PULSE WIDTH (μsec) |
|---|---|
| 63 | 1.21 |
| 62 | 1.2 |
| 61 | 1.19 |
| ⋮ | ⋮ |
| 39 | 0.97 |
| 38 | 0.96 |
| 37 | 0.95 |
| 36 | 0.94 |
| 35 | 0.93 |
| 34 | 0.92 |
| 33 | 0.91 |
| 32 | 0.9 |
| 31 | 0.89 |
| 30 | 0.88 |
| 29 | 0.87 |
| ⋮ | ⋮ |
| 3 | 0.61 |
| 2 | 0.6 |
| 1 | 0.59 |

FIG.46

| | No | APPLYING AMOUNT OF CLEAR INK [%] | REFLECTION DENSITY Dn | AMOUNT OF CHANGE IN REFLECTION DENSITY ΔDn |
|---|---|---|---|---|
| (a) | 1 | 0 | 0.89 | |
| (b) | 2 | 25 | 1.12 | 26% |
| (c) | 3 | 50 | 1.26 | 12% |
| (d) | 4 | 75 | 1.32 | 5% |
| (e) | 5 | 100 | 1.38 | 4% |
| (f) | 6 | 125 | 1.37 | 0% |
| (g) | 7 | 150 | 1.37 | 0% |
| (h) | 8 | 175 | 1.38 | 1% |
| (i) | 9 | 200 | 1.38 | 0% |

FIG.56

| | No | APPLYING AMOUNT OF CLEAR INK [%] | REFLECTION DENSITY Dn | AMOUNT OF CHANGE IN REFLECTION DENSITY ΔDn |
|---|---|---|---|---|
| (a) | 1 | 0 | 0.86 | |
| (b) | 2 | 25 | 1.02 | 18% |
| (c) | 3 | 50 | 1.14 | 12% |
| (d) | 4 | 75 | 1.23 | 8% |
| (e) | 5 | 100 | 1.28 | 4% |
| (f) | 6 | 125 | 1.33 | 4% |
| (g) | 7 | 150 | 1.38 | 4% |
| (h) | 8 | 175 | 1.38 | 0% |
| (i) | 9 | 200 | 1.39 | 0% |

FIG.58

| | No | APPLYING AMOUNT OF CLEAR INK [%] | REFLECTION DENSITY Dn | AMOUNT OF CHANGE IN REFLECTION DENSITY ΔDn |
|---|---|---|---|---|
| (a) | 1 | 0 | 1.28 | |
| (b) | 2 | 25 | 1.38 | 8% |
| (c) | 3 | 50 | 1.40 | 1% |
| (d) | 4 | 75 | 1.40 | 1% |
| (e) | 5 | 100 | 1.40 | 0% |
| (f) | 6 | 125 | 1.40 | 0% |
| (g) | 7 | 150 | 1.40 | 0% |
| (h) | 8 | 175 | 1.41 | 0% |
| (i) | 9 | 200 | 1.41 | 0% |

FIG.61

| | No | APPLYING AMOUNT OF CLEAR INK [%] | REFLECTION DENSITY Dn | AMOUNT OF CHANGE IN REFLECTION DENSITY ΔDn |
|---|---|---|---|---|
| (a) | 1 | 0 | 1.26 | |
| (b) | 2 | 25 | 1.37 | 8% |
| (c) | 3 | 50 | 1.38 | 1% |
| (d) | 4 | 75 | 1.39 | 1% |
| (e) | 5 | 100 | 1.39 | 0% |
| (f) | 6 | 125 | 1.39 | 0% |
| (g) | 7 | 150 | 1.39 | 0% |
| (h) | 8 | 175 | 1.40 | 0% |
| (i) | 9 | 200 | 1.40 | 0% |

FIG.63

INKJET PRINTING APPARATUS AND CHECK PATTERN PRINTING METHOD

BACKGROUND OF THE INVENTION

Field of the Invention

The present invention relates to an inkjet printing apparatus and a check pattern printing method, and more particularly, to a technique of adjusting the print position of a clear ink having no coloring material which is to be applied to a print medium together with coloring material inks to perform printing.

Description of the Related Art

Use of a clear ink together with coloring material inks can improve the fastness of a printed object and can increase a printing density (OD). There is known a technique of printing a check pattern for checking a state of ejection in order to adjust ejection of the clear ink.

For example, as patterns used for adjusting the print position of the clear ink, Japanese Patent Laid-Open No. 2000-141624 discloses printing several patterns in which the relative print position of the clear ink is shifted from that of the coloring material inks. The color of a pattern formed by the coloring material inks in a case where the patterns of the two inks overlap each other is different from the color of a pattern formed by the coloring material inks in a case where the patterns of the two inks do not overlap each other, and by using this feature, the print position shift amount of the clear ink is detected, and the print position is adjusted based on the detected shift amount.

Further, as a technique of checking the state of ejection of the clear ink, Japanese Patent Laid-Open No. 2005-22216 discloses printing the coloring material inks so as to overlap the clear ink at the time of printing a pattern for checking the state of ejection of the clear ink. In an area in which the clear ink is ejected satisfactorily, a chance in density occurs due to overlapping of the coloring material inks, and by detecting this change, the state of ejection of the clear ink is checked.

Furthermore, in a print head for ejecting the clear ink as in the case of the coloring material inks, the amount of ejection may vary depending on a nozzle because variations in the print head arise at the time of manufacturing and the print head changes over time. In order to overcome this problem, so-called head shading (HS) correction, which is well known for the coloring material inks, is performed to adjust the applying amount of the clear ink. In the case of performing the HS correction, the clear ink is ejected to print an HS pattern. It is desirable that this pattern make it possible to detect a difference in density which varies depending on the applying amount of the clear ink riot including the coloring material. Regarding the HS pattern, Japanese Patent Laid-Open No. 2005-22216 discloses a technique of detecting a change in density caused by applying the clear ink as described above.

However, in the technique disclosed in Japanese Patent Laid-Open No. 2000-141624, there is a case where the amount of change in color is relatively small between an area in which the coloring material inks and the clear ink overlap each other and an area in which the coloring material inks and the clear ink do not overlap each other. In this case, a shift of the print position cannot be detected satisfactorily, and as a result, high-accuracy adjustment of the print position cannot be performed. Further, in the technique disclosed in Japanese Patent Laid-Open No. 2005-22216, there is a case where the amount of chance in density or color is small between the area in which the clear ink and the coloring material inks overlap each other and an area in which only the coloring material inks are printed. In this case, it is difficult to check the state of ejection with high accuracy. For example, in a case where the coloring material inks have properties such that the coloring material inks are likely to remain in an upper layer of a print medium, or in a case where a print medium itself has properties such that the coloring material inks are not likely to permeate the print medium, the amount of change in density or color is small between a case where the clear ink overlaps the coloring material inks and a case where the clear ink does not overlap the coloring material inks. Further, even in a case where the technique disclosed in Japanese Patent Laid-Open No. 2005-22216 is used to print the pattern for HS (correction of the amount of application), a sufficient change in density for detecting a difference in the applying amount of the clear ink may not be obtained depending on a combination of the kind of print medium to be printed with the pattern and the inks. As a result, there is a case where it is impossible to correct the amount of application with high accuracy.

In this manner, in the case of printing the check pattern for adjusting ejection of the clear ink, the conventional technique has a problem that even in a case where the coloring material inks are printed to overlap the clear ink in order to detect a change in color or density, a sufficient difference in color or density cannot be obtained between the area in which the clear ink is printed and the area in which the clear ink is not printed.

SUMMARY OF THE INVENTION

An object of the present invention is to provide an inkjet printing apparatus and a check pattern printing method capable of increasing the amount of change in color or density between the area in which the coloring material inks and the clear ink overlap each other and the area in which the coloring material inks and the clear ink do not overlap each other in printing the check pattern with the coloring material inks and the clear ink.

In a first aspect of the present invention, there is provided an inkjet printing apparatus that uses a printing unit for ejecting a first coloring material ink of a first color and a second coloring material ink of a second color whose coloring materials are different in type from the first coloring material ink and a transparent clear ink for fixing at least the first coloring material ink to a surface of a print medium in order to perform printing on the print medium and performs check processing for checking an ejection operation of the clear ink from a print head, the inkjet printing apparatus comprising: a receiving unit configured to receive an instruction to perform the check processing; and a controlling unit configured to cause the printing unit to eject the first coloring material ink, the second coloring material ink, and the clear ink so as to print a check pattern used for the check processing, in response to the receiving unit receiving the instruction, wherein at the time of printing the check pattern, the controlling unit causes the printing unit to print the check pattern in which the clear ink, the first coloring material ink, and the second coloring material ink are applied to a check pattern forming area of the print medium in the order of the clear ink, the first coloring material ink, and the second coloring material ink, and in the check pattern, in a portion in which the first coloring material ink and the clear ink are in contact with each other, the print medium is colored in the second color and the first color in the order of the second color and the first color in a direction from a surface side of the print medium toward a back side of the print medium, and in a portion in which the first coloring material ink and the clear ink are not in contact with each other, the print medium is colored in the order of the first color and the second color in the first color and the second color in the direction.

In a second aspect of the present invention, there is provided a check pattern printing method of printing a check pattern for checking an ejection operation of a transparent clear ink from a print head by using a printing unit for ejecting a first coloring material ink of a first color and a second coloring material ink of a second color whose coloring materials are different in type from the first coloring material ink and the clear ink for fixing at least the first coloring material ink to a surface of the print medium so as to perform printing on a print medium, the check pattern printing method comprising: printing the check pattern used for the check processing by ejecting the first coloring material ink, the second coloring material ink, and the clear ink, wherein in the printing step, at the time of printing the check pattern, the check pattern is printed in which the clear ink, the first coloring material ink, and the second coloring material ink are applied to a check pattern forming area of the print medium in the order of the clear ink, the first coloring material ink, and the second coloring material ink, and in the check pattern, in a portion in which the first coloring material ink and the clear ink are in contact with each other, the print medium is colored in the second color and the first color in the order of the second color and the first color in a direction from a surface side of the print medium toward a back side of the print medium, and in a portion in which the first coloring material ink and the clear ink are not in contact with each other, the print medium is colored in the order of the first color and the second color in the first color and the second color in the direction.

According to the above configuration, it becomes possible to increase the amount of change in color or density between the area in which the coloring material inks and the clear ink overlap each other and the area in which the coloring material inks and the clear ink do not overlap each other at the time of printing the check pattern with the coloring material inks and the clear ink.

Further features of the present invention will become apparent from the following description of exemplary embodiments (with reference to the attached drawings).

BRIEF DESCRIPTION OF THE DRAWINGS

FIG. 6 is a schematic diagram for explaining a pattern used for adjusting the print position of coloring material inks according to the first embodiment of the present invention;

FIGS. 7A to 7D are views showing patterns shown in FIG. 6 in which the print positions of K dots and C dots are relatively displaced by four shift amounts;

FIGS. 18A to 19D are graphs for explaining measurement principles using the optical characteristics of light emitted from the light emitting section;

FIGS. 19A to 19D are graphs for explaining the optical characteristics of dots of a black (K) coloring material ink printed on the print medium and measurement results obtained by using an optical sensor;

FIG. 46 is a diagram showing an example of a table representing a relationship between the pulse width of a heater driving pulse and a head rank according to the variation of the second embodiment;

FIG. 56 is a diagram showing densities and amounts of change in density measured by using the chip for the results of measurements shown in FIG. 55;

FIG. 58 is a diagram showing densities and amounts of change in density measured by using the chip for the results of measurements shown in FIG. 57;

FIG. 61 is a diagram showing densities and amounts of change in density measured by using the chip for the results of measurements shown in FIG. 60;

FIG. 63 is a diagram showing densities and amounts of change in density measured by using the chip for the results of measurements shown in FIG. 62;

DESCRIPTION OF THE EMBODIMENTS

Embodiments of the present invention will be described below in detail with reference to the drawings.

First Embodiment

A first embodiment of the present invention relates to a mode of printing, as a check pattern, a pattern for adjusting the print position of the clear ink with a clear ink and coloring material inks in an overlapping manner so that the amount of change in color is large between an area in which the coloring material inks and the clear ink overlap each other and an area in which the coloring material inks and the clear ink do not overlap each other.

Figure 1:
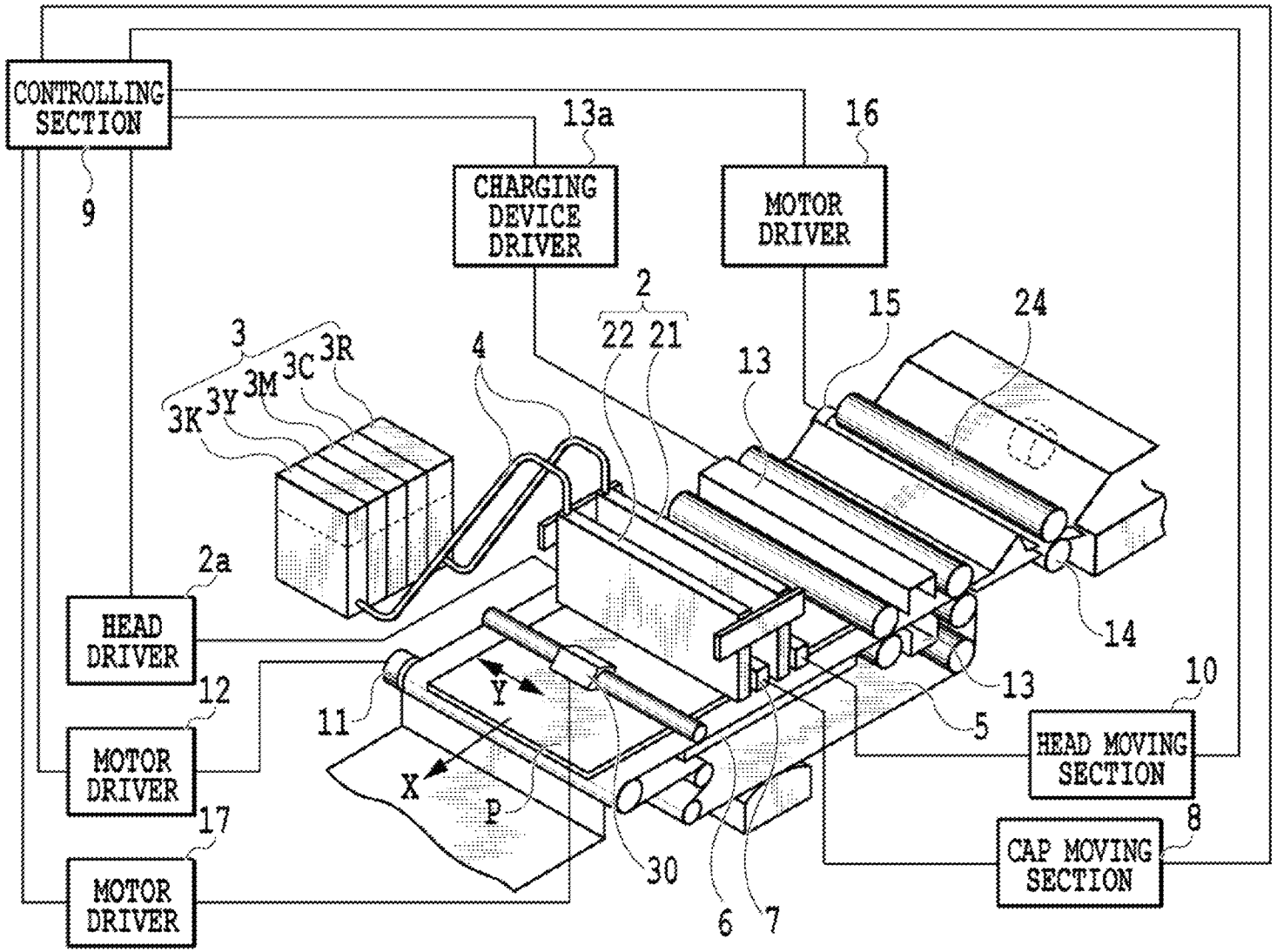
FIG. 1 is a schematic diagram showing the schematic configuration of an inkjet printing apparatus of a first embodiment of the present invention.

FIG. 1 is a schematic diagram showing the schematic configuration of an inkjet printing apparatus of the embodiment of the present invention. A printing apparatus 1 includes so-called full line type print heads 2 in which nozzles are arranged in an area corresponding to the width of a print medium. As the print heads 2, the printing apparatus 1 includes a print head 21 for ejecting the clear ink and a head 22 for ejecting the coloring material inks (one head for C, M, Y, and K inks). These print heads are positioned to extend in a direction (a nozzle array direction: a Y direction) perpendicular to a conveying direction (a sub-scan direction: an X direction) of a print medium P. Further, the print head 21 for the clear ink is positioned upstream of the print head 22 for the coloring material inks in the conveying direction, and accordingly, the clear ink is ejected and applied to the print medium earlier than the coloring material inks. The print heads 2 are positioned to face a platen 6 across a conveying belt 5. A head moving section 10 moves up or down the print heads 2 in a direction facing the platen 6. A controlling section 9 controls the operation of the head moving section 10. Further, the print heads 2 include nozzles for ejecting the inks, a common liquid chamber to which the inks in ink tanks 3 are supplied, and ink paths for leading the inks from the common liquid chamber to the nozzles. Each nozzle is provided with, for example, a heating resistor element (a heater) for generating bubbles in the ink, and a head driver drives the heater, thereby ejecting the ink from the nozzle. The heater of the nozzle is electrically connected to the controlling section 9 via a head driver 2*a*, and driving of the heater is controlled according to an on/off signal (an ejection/non-ejection signal) from the controlling section 9.

The print heads 2 for the inks are connected to five ink tanks 3P, 3C, 3M, 3Y, and 3K (hereinafter collectively referred to as the ink tanks 3) for storing the clear ink, a cyan (C) ink, a magenta (M) ink, a yellow (Y) ink, and a black (K) ink, respectively via a connection pipe 4. Further, the ink tanks 3 can be individually attached or detached.

The controlling section 9 collectively controls various types of processing in the printing apparatus 1. The controlling section 9 includes, for example, a CPU 33, memories such as a ROM 34 and a RAM 35, an ASIC, and the like.

Figure 4:
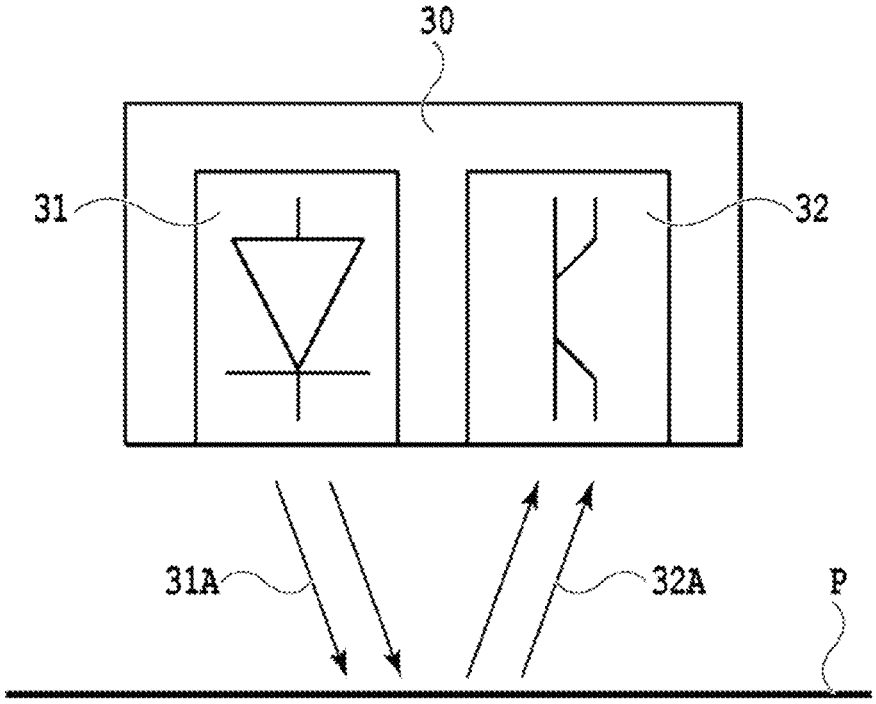
FIG. 4 is a schematic diagram for explaining the details of a reflective optical sensor shown in FIG. 1.

Caps 7 are positioned next to the print heads 2 at a distance of half a pitch of an interval between the print heads 2 from the print heads 2. The cap moving section 8 whose operation is controlled by the controlling section 9 can move the caps 7 between positions next to the print heads 2 and positions immediately below the print heads 2, and this makes it possible to cap the print heads and perform recovery processing such as preliminary ejection. A reflective optical sensor 30, which will be described later with reference to FIG. 4, is provided downstream of the print heads 2 in the conveying direction of the print medium. A carriage for the reflective optical sensor 30 enables the reflective optical sensor 30 to move in the Y direction, and the moving of the reflective optical sensor 30 is controlled via a motor driver 17.

The conveying belt 5 is laid around a driving roller coupled to a belt driving motor 11, and the print medium P is conveyed by rotating and driving the driving roller. The operation of the conveying belt 5 is controlled via a motor driver 12. A charging device 13 is provided upstream of the conveying belt 5. The charging device 13 charges the conveying belt 5, thereby bringing the print medium P into close contact with the conveying belt 5. The charging device 13 is turned on/off via a charging device driver 13*a*. A pair of feed rollers 14 supplies the print medium P onto the conveying belt 5. A feed motor 15 drives and rotates the pair of feed rollers 14. The operation of the feed motor 15 is controlled via a motor driver 16.

Incidentally, the configuration of the printing apparatus for carrying out the present invention as shown in FIG. 1 is just an example, and the present invention is not necessarily limited to this configuration. For example, the present invention only has to have the configuration in which the print heads and the print medium move relatively, and the configuration of the present invention is not particularly limited. For example, the present invention may have the configuration in which the print heads move relative to the print medium.

Figure 2:
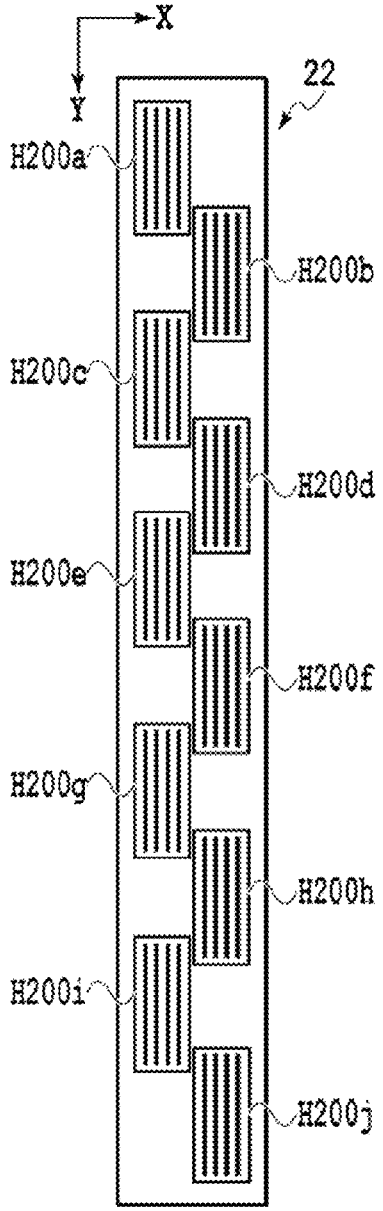
FIG. 2 is a view for explaining the configuration of print chips in which nozzles of print heads shown in FIG. 1 are arranged.

FIG. 2 is a view for explaining the configuration of print chips in which nozzles of the print heads 2 shown in FIG. 1 are arranged. Since the print head 21 for the clear ink and the print head 22 for the coloring material inks have the same configuration, the print head 22 for the coloring material inks, for example, will be described. The print head 22 has an effective ejection width of about 1 inch, for example, and ten print chips H200 (H200*a* to H200*j*) formed of silicon are arranged on a base substrate (a support member) in a zigzag manner. The print chips H200 adjacent to each other in the Y direction are arranged to have a predetermined overlapping width in the nozzle array direction (the Y direction), and this makes it possible to perform seamless printing even with overlapping portions of the adjacent print chips.

Figure 3:
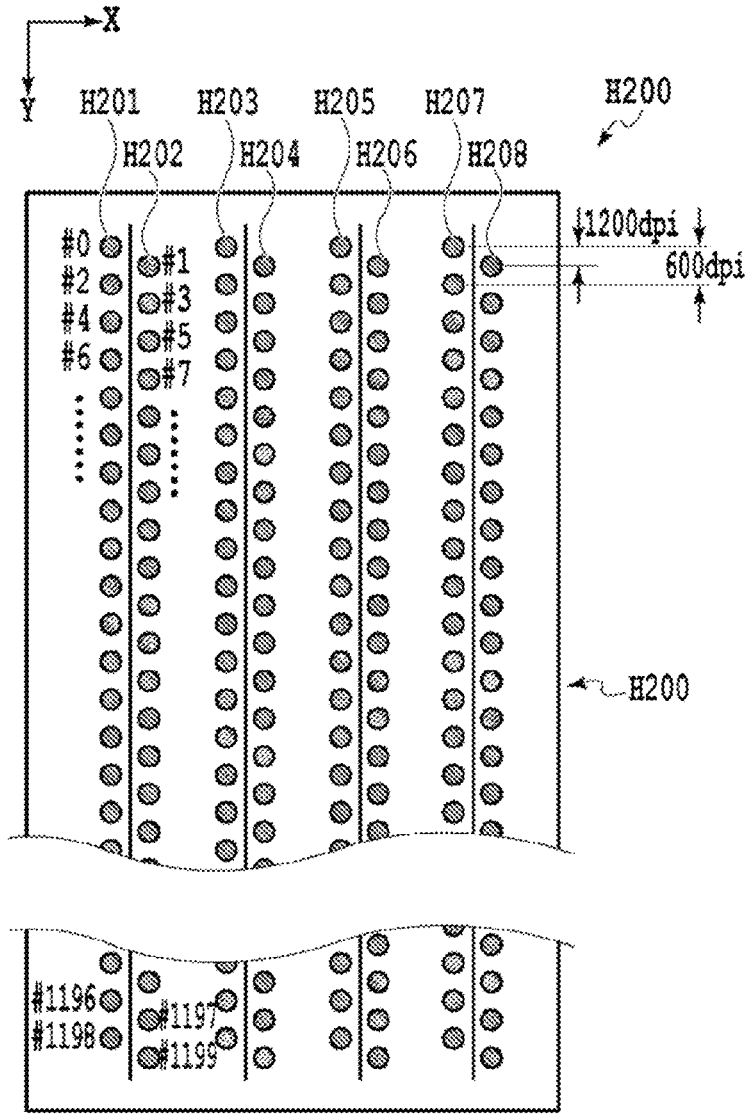
FIG. 3 is a view for explaining, in particular, the nozzle arrangement of each print chip shown in FIG. 2.

FIG. 3 is a view for explaining, in particular, the nozzle arrangement of each print chip H200 shown in FIG. 2. The print chip H200 includes eight nozzle arrays H201 to H208. The nozzle arrays H201 and H202 correspond to the cyan ink, the nozzle arrays H203 and H204 correspond to the magenta ink, the nozzle arrays H205 and H206 correspond to the yellow ink, and the nozzle arrays H207 and H208 correspond to the black ink. The nozzle arrangement pitch of each nozzle array is 600 dpi, and the two nozzle arrays of each color deviate from each other by half a pitch. This makes it possible to use each color ink to perform printing with a resolution of 1200 dpi in the Y direction. Further, each nozzle array is formed of 600 nozzles, and accordingly, 1200 nozzles are provided for each color ink.

On the other hand, in the print chip in the print head 21 for the clear ink according to the present embodiment, two nozzle arrays (H207, H208) are provided. These two nozzle arrays also deviate from each other by half a pitch, and this makes it possible to perform printing with a resolution of 1200 dpi in the Y direction. Further, the number or nozzles is also 1200. Incidentally, like the print head 22 for the coloring material inks shown in FIG. 3, the print chip for the clear ink may have the configuration in which eight nozzle arrays are provided, only the two nozzle arrays H207 and H208 are used, and nozzle arrays H201 to H206 are not used. Incidentally, in this case, there is no limitation on performing printing with all nozzle arrays in order to improve robustness or using another nozzle array as auxiliary nozzles for compensating for non-ejection.

FIG. 4 is a schematic diagram for explaining the details of the reflective optical sensor 30 shown in FIG. 1. The reflective optical sensor 30 is mounted on a carriage (not shown) which can move in the Y direction, and has a light emitting section 31 and a light receiving section 32. Light (incident light) 31A emitted from the light emitting section 31 is reflected from the print medium P, and reflection light 32A is detected by the light receiving section 32. A detection signal (an analog signal) for the reflection light 32A is transmitted to the controlling section 9 (FIG. 1) via a flexible cable (not shown), and converted into a digital signal by an A/D converter in the controlling section. An optical sensor having relatively low resolution can be used as the optical sensor 30, and this can reduce the cost.

Figure 5:
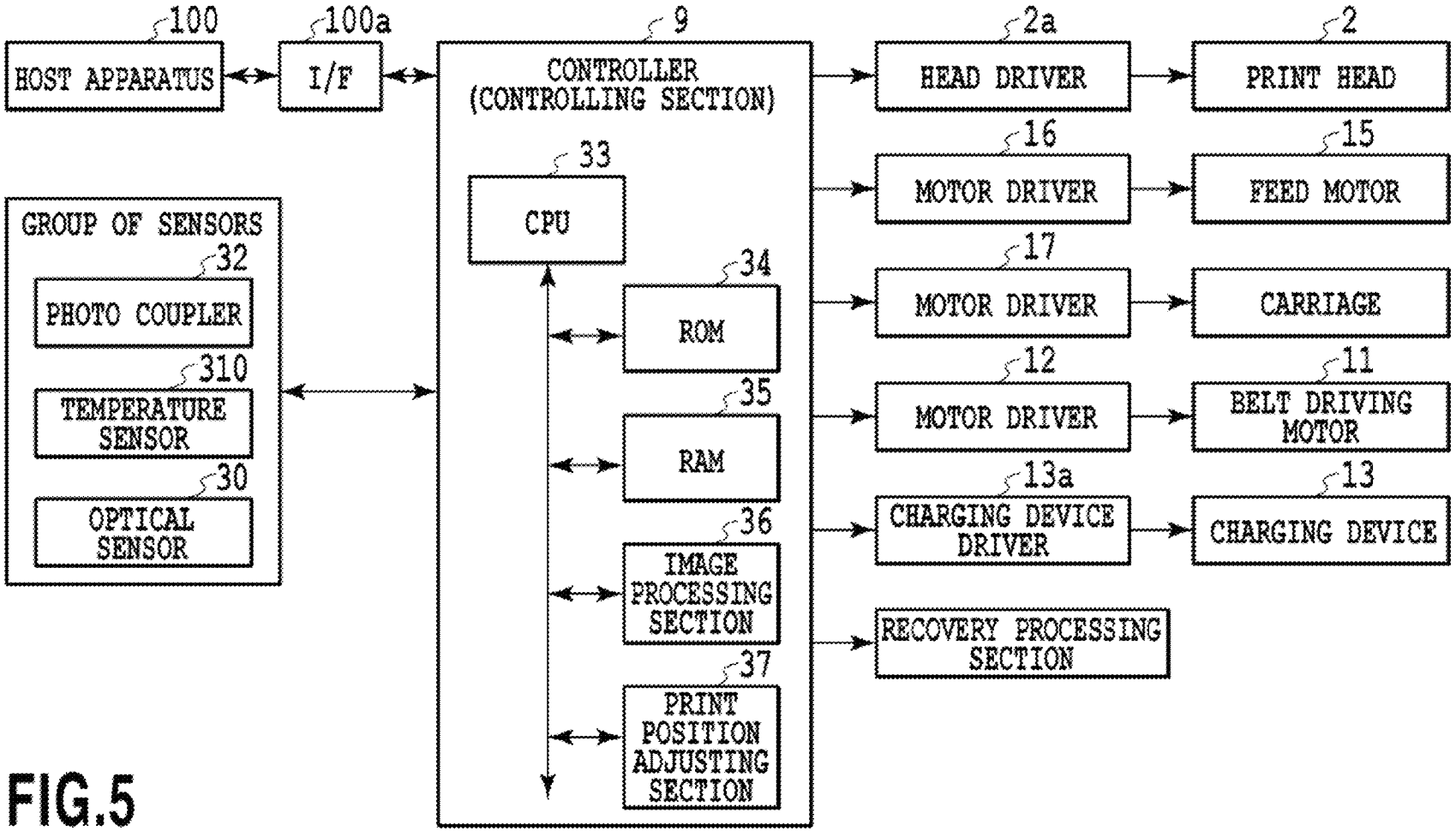
FIG. 5 is a block diagram showing the control configuration of the inkjet printing apparatus of the first embodiment of the present invention.

FIG. 5 is a block diagram showing the control configuration of the inkjet printing apparatus according to the embodiment of the present invention, and mainly shows the detailed configuration of the controlling section 9 shown in FIG. 1.

The controller (controlling section) 9 has, as the functional elements, the CPU 33, the ROM 34, a RAM 35, an image processing section 36, and a print position adjusting section 37. The CPU 33 collectively controls the entire operation of the printing apparatus of the present embodiment. For example, the CPU 33 controls the operation of each section according to a program stored in the ROM 34. The RUM 34 stores various types of data. The ROM 34 stores, for example, information on the type of print medium, information on the inks, information on an environment such as a temperature and a humidity, and various types of control programs. The image processing section 36 performs image processing on image data input from a host apparatus 100 via an interface 100*a*. For example, multi-valued image data is quantized into N-valued image data for each pixel, and a dot arrangement pattern corresponding to a gradation value indicated by each quantized pixel is allocated. Finally, ejection data (print data) corresponding to each nozzle array is generated. The print position adjusting section 37 performs print position adjustment processing (registration adjustment processing) which will be described later with reference to FIG. 27 and the like.

The host apparatus 100 is a supply source of image data, and can be a computer for creating data such as an image relating to printing and performing processing or the like. The host apparatus may be a reader for reading an image or the like. Image data, other commands, a status signal, and the like are transmitted to and received from the controller 9 via the interface (I/F) 100*a*. A group of sensors is a group of sensors for detecting the state of the apparatus, and has the reflective optical sensor 30, the photo coupler 32 for detecting a home position, and the temperature sensor 310 provided in an appropriate portion in order to detect an environmental temperature as described above with reference to FIG. 4. The head driver 2*a* is a driver for driving the print heads 2 according to the print data and the like. The head driver 2*a* has a shift register for aligning print data to correspond to the position of an ejection heater, and a latch circuit for performing latching at an appropriate timing, a logic circuit element for operating the ejection heater in synchronization with a driving timing signal, a timing setting section for appropriately setting a driving timing (an ejection timing) to adjust a print position, and the like. The motor driver 16 is a driver for controlling driving of the feed motor 15, and is used to feed the print medium. The motor driver 12 is a driver for controlling driving of the belt driving motor 11 for driving the conveying belt 5, and is used to convey the print medium P in the X direction. The motor driver 17 is a driver for controlling driving of the carriage for the reflective optical sensor 30. The charging device driver 13*a* drives the charging device to charge the conveying belt 5 for bring the print medium P into close contact with the conveying belt 5.

<Coloring Material Inks and Clear Ink>

The clear ink is a liquid which does not include a coloring material, and its component coagulates or precipitates pigment coloring materials in a case where the coloring material inks are pigment inks, and precipitates dye in a case where the coloring material inks are dye inks. In the present embodiment, the clear ink includes calcium nitrate tetrahydrate, glycerin, a surfactant, and water, and pigment inks including pigments as coloring materials are used as the coloring material inks. In a case where the clear ink lands on an area of the print medium to which the clear ink is applied beforehand, multivalent metal salt affects pigments or dyes which are the coloring materials in the coloring material inks, and coagulates or precipitates an insoluble or hardly soluble metal composite. As a result, coloring material components in the coloring material inks are suppressed from permeating the print medium, and are likely to remain near a surface layer of the print medium.

<Print Position Adjustment Pattern for the Coloring Material Inks>

In the following explanation, a ratio of a portion on the print medium printed by the printing apparatus to a predetermined portion on the print medium is referred to as "an area factor." For example, the area factor is 100% in a case where dots are printed throughout the predetermined portion on the print medium; the area factor is 0% in a case where dots are not printed at all; and the area factor is 50% in a case where the area of the printed portion is half the area of the predetermined portion.

FIG. 5 is a schematic diagram for explaining a pattern (a registration adjustment pattern) used for adjusting the print position of coloring material inks according to the embodiment of the present invention. FIG. 6 shows print position adjustment (inter-color X direction print position adjustment) pattern for adjusting the print position of the cyan (C) in the X direction ink in the same print chip to match the print position of the black (K) ink among print position adjustment patterns for the C, M, Y, and K inks, which are the coloring material inks. In FIG. 6, relatively dark shaded dots are dots printed with the ink ejected from the nozzles of the nozzle arrays for the K ink, and relatively pale shaded dots are dots printed with the C ink in the same manner. Dot intervals in the X and Y directions are both 1200 dpi, and four K-ink dots and our C-ink dots are alternately arranged in the X direction.

FIGS. 7A to 7D are views showing patterns shown in FIG. 6 in which the print positions of the K ink and the C ink are relatively displaced by four shift amounts. For simplification of illustration, an area in which the K dots are printed is represented by a dark shaded rectangle, and an area in which the C dots are printed is represented by a pale shaded rectangle.

FIG. 7A shows a pattern in a state in which the relative print positions of the K ink and the C ink ideally match each other (the shift amount is zero). On the other hand, FIG. 7B shows a state in which the relative print positions are displaced by a predetermined amount, and FIGS. 7C and 7D show patterns in states in which the relative print positions are further displaced. As is clear from these drawings, as the relative print position shift amount of the print position adjustment pattern becomes larger, the density of the whole pattern becomes lower. More specifically, in the pattern shown in FIG. 7A, the area factor for a combination of the K dots and the C dots is about 100%. As shown in FIGS. 7B to 7D, as a print position shift amount becomes larger, an area in which the K dots and the C dots overlap each other becomes larger, and an area in which dots are not formed, that is, an area which is not covered with dots becomes larger. The density of the entire pattern greatly depends on a change in the area factor, rather than on a change in the density caused by overlapping of dots. Accordingly, as the area factor becomes lower, the density of the entire pattern becomes lower.

In the present embodiment, the print position adjustment patterns explained with reference to FIGS. 6 and 7A to 7D are printed by shifting a timing of ejection from the C ink nozzle arrays relative to a timing of ejection from the K ink nozzle arrays by a predetermined amount.

Incidentally, patterns for print position adjustment in the Y direction can be patterns obtained by turning the patterns shown in FIGS. 7A to 7D by 90 degrees. These patterns are printed with a predetermined number of contiguous nozzles for each color ink, and can be printed by displacing a range of the predetermined number of contiguous nozzles used for printing the patterns.

Figure 8:
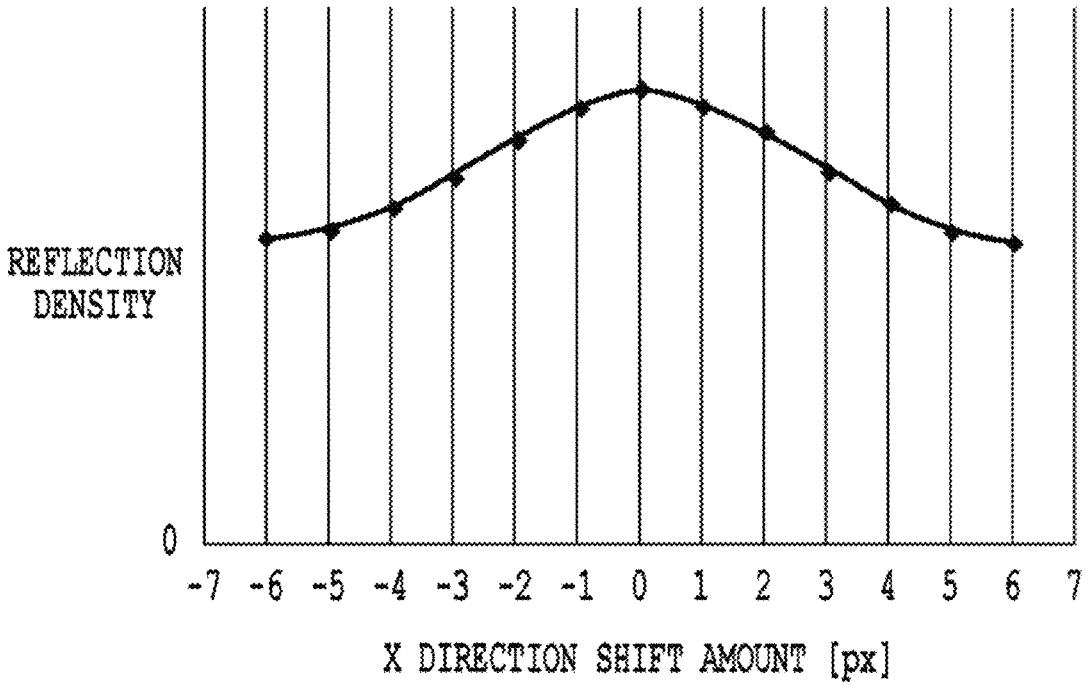
FIG. 8 is a graph for explaining a relationship between a print position shift amount and a reflection density at the time of using the patterns for adjusting the print positions shown in FIGS. 7A to 7D.

FIG. 8 is a graph for explaining a relationship between a print position shift amount and a reflection density in the case of using the nine patterns for adjusting the print positions shown in FIGS. 7A to 7D. In FIG. 8, a vertical axis represents a reflection density (OD value), and a horizontal axis represents a print position shift amount. In the case of using the optical sensor 30 (FIG. 4), a reflectance R is represented by R=Iref/Iin, and a transmissivity T=1−R. A reflection density d satisfies the relationship d=−Log (R). As described above, in a case where the print position shift amount of the C dots and the K dots is "zero," the area factor is 100%, and accordingly, the reflectance K becomes the lowest, that is, the reflection density d becomes the highest. Further, the reflection density d becomes low in a case where the print positions of the C dots or the K dots are displaced in the +X direction or in the −X direction.

Figure 14:
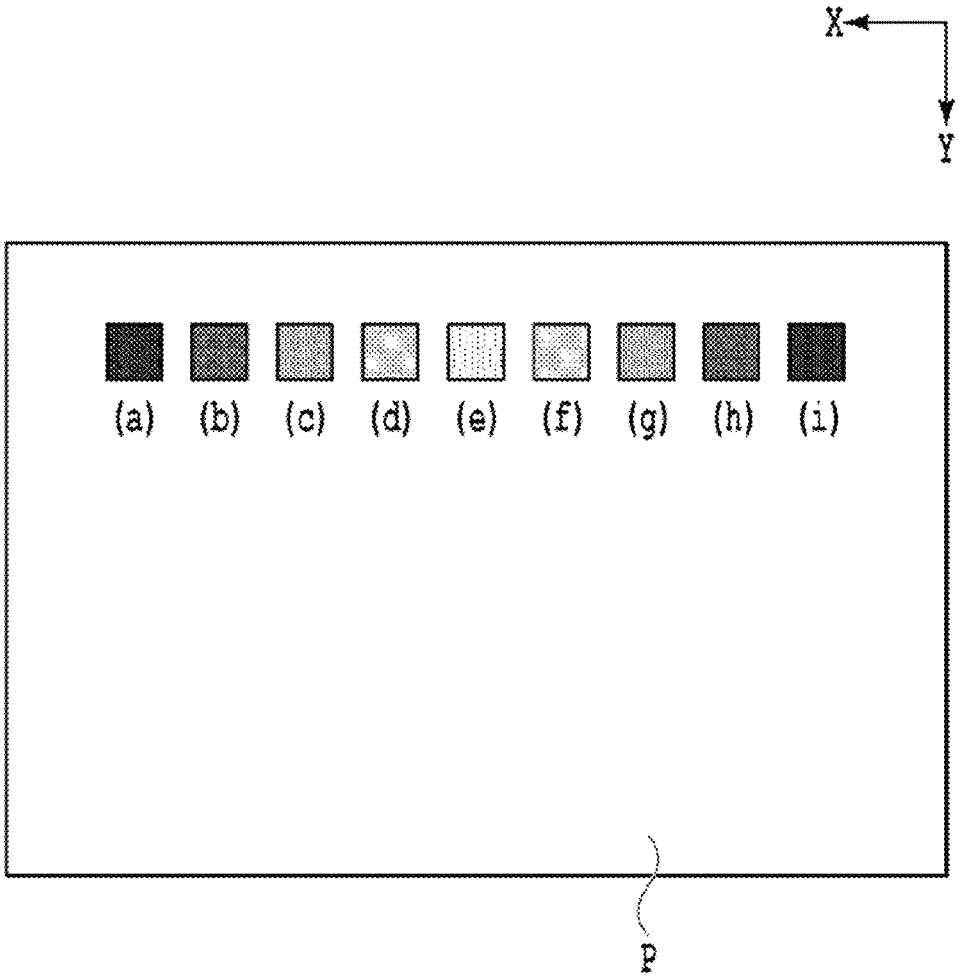
FIG. 14 is a view showing an example of printing, on a print medium P, patterns for adjusting the print position of the coloring material inks shown in FIG. 6.

In processing for obtaining an adjustment value for adjusting a print position, nine print position adjustment patterns having different relative shift amounts as shown in FIG. 14 are printed, and their densities are measured. Then a curved line corresponding to displacement of a print position as shown in FIG. 8 is obtained from four measured densities by performing curve approximation by the least squares method, for example, and a position of a maximum density is obtained from the curved line. A shift amount in the X direction corresponding to the maximum density corresponds to a print timing in which the print positions match each other most. Accordingly, the print timing corresponding to this shift amount can be used as an adjustment value.

Incidentally, in the above example, explanation has been made on an example of an adjustment pattern used for inter-color X print position adjustment so that the print position of the C ink in the X direction in the same print chip matches the print position of the K ink. However, it is possible to perform Y-direction inter-color print position adjustment (inter-color Y print position adjustment) in the same manner. Further, regarding overlapping areas of adjacent print chips, it is also possible to perform print position adjustment for adjacent print chips (inter-chip print position adjustment) in the same manner by forming patterns with the K ink of the print chips.

<Print Position Adjustment Pattern for the Clear Ink>

Figure 9:
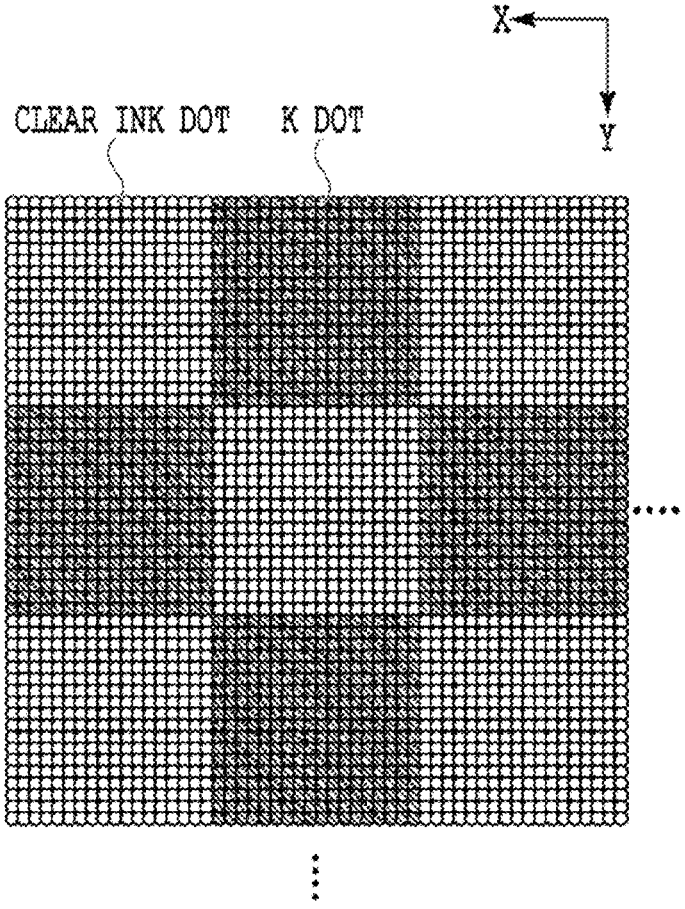
FIG. 9 is a schematic diagram for explaining a pattern for adjusting the print position of a clear ink (a registration adjustment pattern)

FIG. 9 is a schematic diagram for explaining a pattern for adjusting the print position of the clear ink (a registration adjustment pattern). The pattern shown in the drawing is a pattern for adjusting the print positions of the clear ink and the coloring material inks in the X direction. Explanation will be made below by taking, as an example, a pattern for adjusting the print position of the clear ink based on the print position of the black (K) ink.

In FIG. 9, pale white dots represent dots of the clear ink, and shaded dark dots represent dots of the K ink. Dot intervals are 1200 dpi both in the X and Y directions, and squares formed of dots and having a side of 18 dots are arranged in a zigzag manner so that the squares do not overlap each other. Here, a state in which one dot is formed in each pixel of 1200 dpi is referred to as "solid" printing. In standard plain paper, the area factor in the case of performing solid printing is about 100%.

FIGS. 10A to 10D are views showing patterns shown in FIG. 9 in which the print positions of the clear ink and the K ink are relatively displaced by four shift amounts. For simplification of illustration, areas in which clear-ink dots are printed (clear-ink solid areas) are represented by white squares, and areas in which K dots are printed (K solid areas) are represented by shaded squares.

Figure 10A:
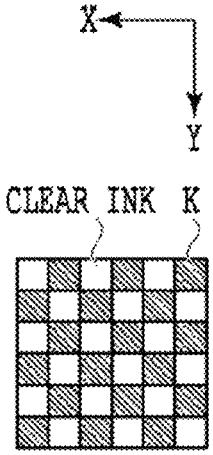
FIGS. 10A to 10D are views showing patterns shown in FIG. 9 in which the print positions of the clear ink and a K ink are relatively displaced by four shift amounts.
Figure 10B:
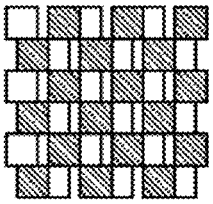
Figure 10C:
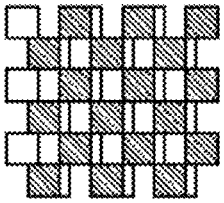
Figure 10D:
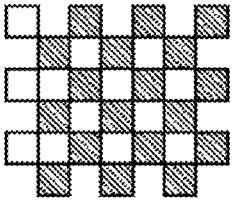

FIG. 10A snows a pattern in a state in which the relative print positions of the clear ink and the K ink ideally match each other (the shift amount is zero). On the other hand, FIG. 10B shows a state in which the relative print positions are displaced by a small amount, FIG. 10C shows a state in which the relative print positions are displaced by a little larger amount, and FIG. 10D shows a state in which the relative print positions are displaced by a larger amount. In the print position adjustment pattern, as a print position shift amount becomes larger, an area in which the clear-ink dots and the K -ink dots overlap each other is increased, and in the overlapping area, the K ink coagulates to increase its density, thereby increasing the density of the entire pattern. More specifically, in the state shown in FIG. 10A, the overlapping rate is about 0%. As shown in FIGS. 10B and 10C, as a print position shift amount becomes larger, the overlapping rate becomes higher, and in FIG. 10D, the overlapping rate as about 100%. In this manner, the overlapping rate and the above-described area factor conflict each other. Since the clear ink does not include a coloring material, the clear ink when singly used does not contribute to the density even in a case where the area factor is increased. However, in a case where the clear ink overlaps the K ink, the K ink in the overlapping area coagulates to increase the density. More specifically, unlike in inter-ink print position adjustment for the coloring material inks shown in FIGS. 7A to 7D, as the overlapping rate of the clear-ink dots and the K-ink dots becomes larger, the density of the entire pattern becomes higher.

Incidentally, patterns for print position adjustment in the Y direction can be patterns obtained by turning the patterns shown in FIGS. 10A to 10D by 90 degrees. These patterns are printed with a predetermined number of contiguous nozzles for each color ink, and can be printed by displacing a range of the predetermined number of contiguous nozzles used for printing the patterns.

Figure 11:
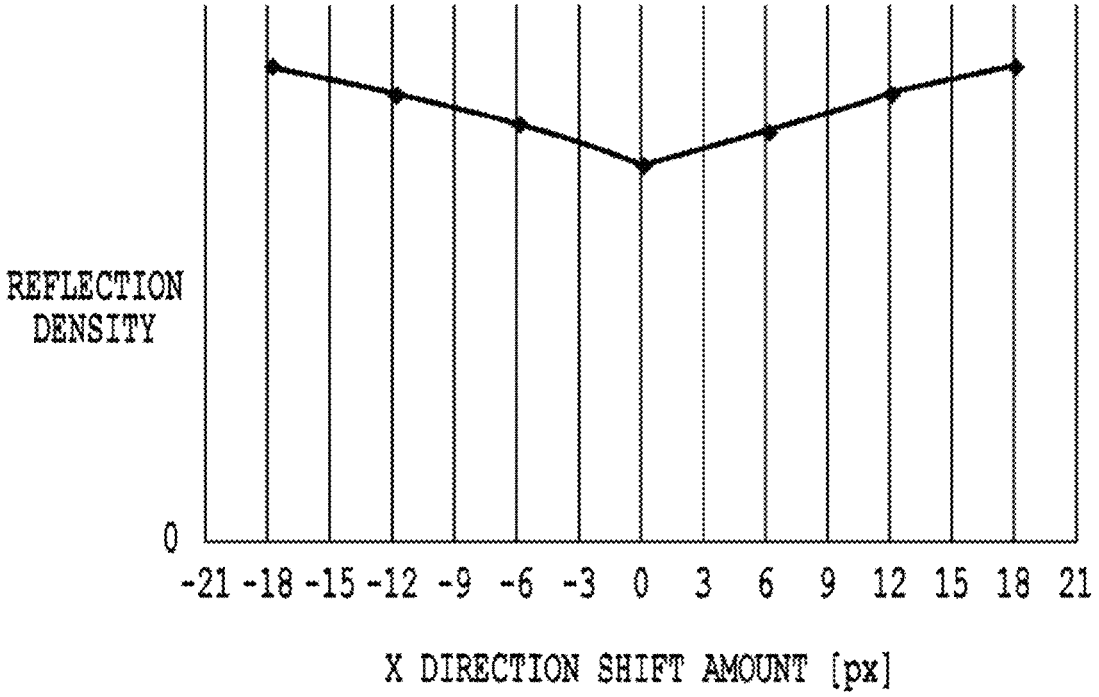
FIG. 11 is a graph for explaining a relationship between a print position shift amount and a reflection density at the time of using the patterns for adjusting the print positions shown in FIGS. 10A to 10D.

FIG. 11 is a graph for explaining a relationship between a print position shift amount and a reflection density in the case of using seven of the patterns for adjusting the print positions shown in FIGS. 10A to 10D. In a case where the print position shift amount of the clear ink dots and the K ink dots is "zero," the overlapping rate is about 0%, and the reflectance R becomes the highest, that is, the reflection density d becomes the lowest. Further, the reflection density d increases in a case where the print positions of the clear-ink dots or the K-ink dots are displaced in the +X direction or in the −X direction.

Figure 16:
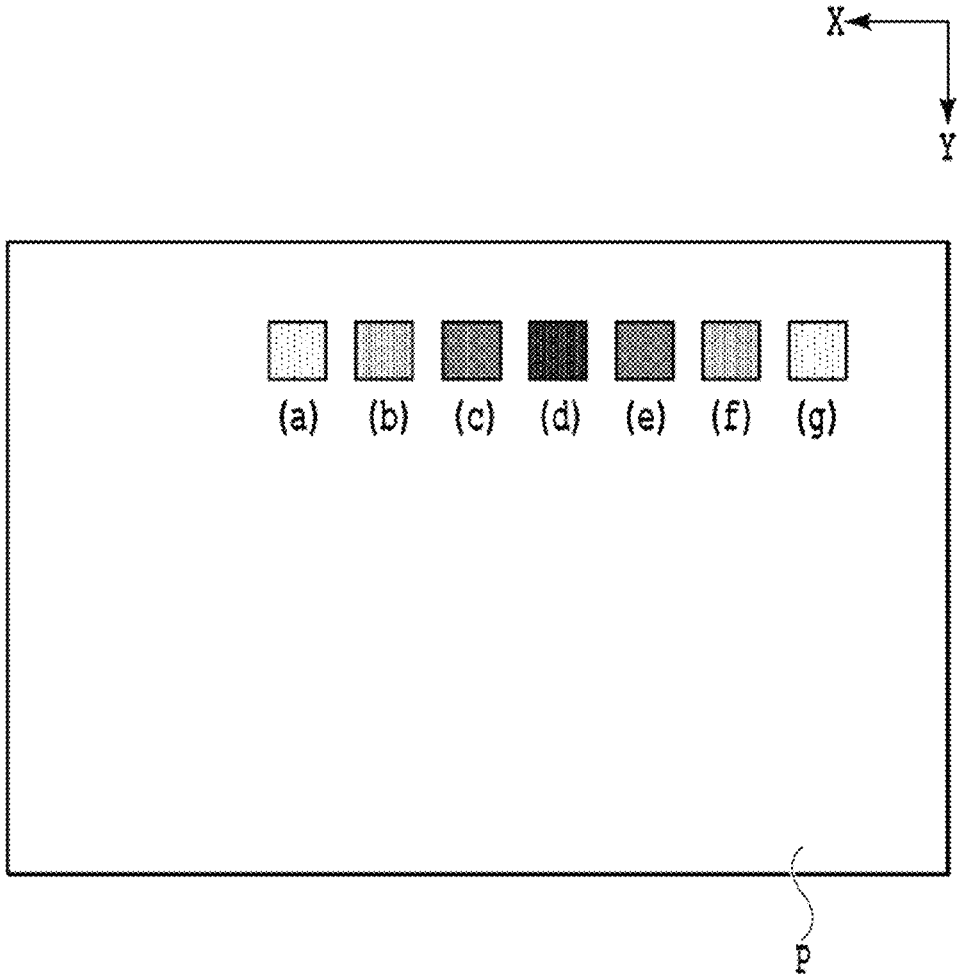
FIG. 16 is a view showing an example of printing, on the print medium, patterns for adjusting the print position of the clear in shown in FIG. 9.

In processing for obtaining an adjustment value for adjusting the print position of the clear ink, seven print position adjustment patterns having different relative shift amounts as shown in FIG. 16 are printed, and their densities are measured. Then a curved line corresponding to displacement of a print position as shown in FIG. 11 is obtained from four measured densities by performing curve approximation by the least squares method, for example, and a position of a minimum density is obtained from the curved line. A shift amount in the X direction corresponding to the minimum density corresponds to a print timing in which the print positions match each other most. Accordingly, the print timing corresponding to this shift amount can be used as an adjustment value.

In this example, the print position is displaced in the X direction by shifting a timing of ejecting the clear ink relative to a timing of ejecting the K ink. The print position can be displaced in the Y direction by shifting print data for the nozzles as in inter-ink print position adjustment for the coloring material inks. Further, it is also possible to change patterns according to a dot sire, the accuracy of print position adjustment, or the like.

<Print Position Adjustment>

Figure 12:
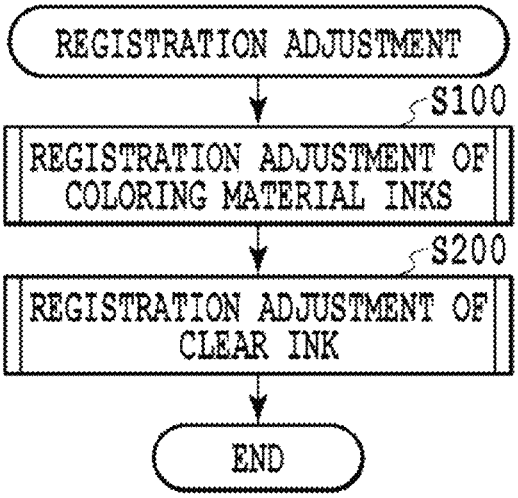
FIG. 12 is a flowchart showing processing for adjusting a print position.

FIG. 12 is a flowchart showing print position adjustment processing.

First, in step 100, print position adjustment (registration adjustment) for the coloring material inks is performed. Print position adjustment for the coloring material inks includes inter-chip print position adjustment for adjusting the print positions of adjacent print chips, and inter-color print position adjustment for adjusting the print position to match the print position of an ink of another color in the same chip. In the inter-chip print position adjustment, the print positions of adjacent print chips are adjusted relative to the print chip H200*a* (FIG. 2).

In the inter-chip print position adjustment, the print position adjustment patterns are printed with the K ink of the print chips, and their measurement values are used as the representative values of the print chips. Adjustment of the print position in the X direction is performed by controlling an ejection timing for each print chip, and adjustment of the print position in the Y direction is performed by shifting ejection data for each print chip in the Y direction. In inter-color print position adjustment, the print positions for the nozzle arrays for the C, M, and Y inks are adjusted for each print chip, relative to the nozzle arrays H207 and H208 for the K ink. Regarding an adjustment value, a print position adjustment pattern is printed in black and a relevant color in the print chip, and its measurement value is used as an adjustment value for the nozzle arrays for the relevant color. Adjustment of the print position in the X direction is performed by controlling an ejection timing for each print chip and each color, and adjustment of the print position in the Y direction is performed by shifting ejection data for each print chip and each color in the Y direction.

Next, in step 200, the print position of the clear ink is adjusted. Adjustment of print position of the clear ink is to adjust the print positions of the print chips in the same position in the Y direction, and is performed for each print chip. For example, print position adjustment is performed for the print chip H200*a* of the print head 21 for the clear ink and the print chip H200*a* of the print head 22 for the coloring material inks.

In adjustment of the print position of the clear ink, the print positions for the nozzle arrays for the clear ink are adjusted for each print chip relative to the nozzle arrays H207 and H208 for the K ink. Regarding an adjustment value, a print position adjustment pattern is printed with the clear ink and a coloring material ink, and its measurement value is used as an adjustment value for the print chip for the clear ink. Adjustment of the print position in the X direction is performed by controlling a timing of ejecting the clear ink for each print chip, and adjustment of the print position in the Y direction is performed by shifting ejection data for the clear ink for each print chip in the Y direction, that is, by shifting the range of the nozzles to be used. Resolution for adjustment of the print position in the Y direction is 1200 dpi, which is the substantial resolution of the nozzles, and adjustment of the print position in the X direction can be performed at the resolution of up to 4000 dpi by controlling an ejection timing.

Figure 13:
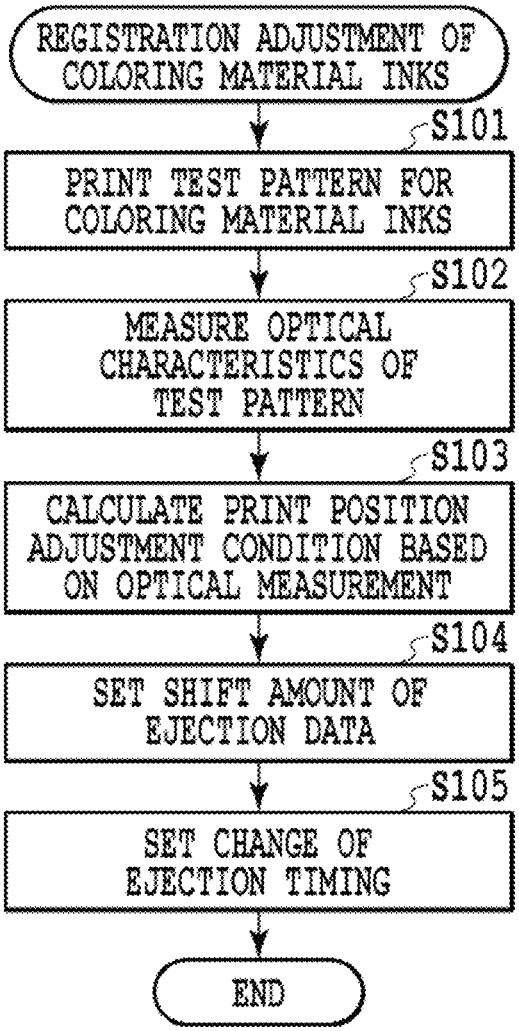
FIG. 13 is a flowchart snowing the details of adjustment of the print position of the coloring material inks in step 100 shown in FIG. 12.

FIG. 13 is a flowchart showing the details of adjustment of the print position of the coloring material inks in step 100 shown in FIG. 12.

First, in step 101, the print position adjustment patterns for the coloring material inks are printed for each of the X direction and the Y direction. The print position adjustment patterns for the coloring material inks include an inter-chip print position adjustment pattern and an inter-color print position adjustment pattern. Next, in step 102, the optical sensor 30 measures the optical characteristics (densities in the present embodiment) of these patterns. In step 103, an appropriate condition (an adjustment value) for adjusting the print position is obtained for each of the X direction and the Y direction based on the measured optical characteristics of the patterns. The condition for adjusting the print position can be obtained by using a peak value in curve approximation performed by the least-squares method, for example, as described above. In steps 104 and 105, the shift amount of the ejection data is set for the Y direction (step 104), and a change of an ejection timing is set for the X direction (step 105) based on the obtained print position adjustment condition.

FIG. 14 is a view showing an example of printing, on a print medium P, patterns for adjusting the print position of the coloring material inks shown in FIG. 6. Unlike the four examples shown in FIGS. 7A to 7D, the shown example includes nine printed patterns having different print position shift amounts of the K ink and the C ink. Hereinafter these patterns are also referred to as patches. Regarding print start timings for the K ink and the C ink for the nine patches, for example, the print start timing for the K ink is fixed, and a total of nine timings, that is, a currently set start timing, four earlier start timings, and four later start timings are used as the start timings for the C ink to perform printing. Setting of the print start timings and printing of the nine patches based on the print start timings can be performed by a program to be started in response to input of a predetermined instruction.

After the patches (a) to (i) are printed as the print position adjustment patterns in this manner, the print medium P and the carriage are moved so that the reflective optical sensor 30 mounted in the carriage is positioned to face the patches, and the optical characteristics (density) of each patch are measured. The results of measurement correspond to a state of displacement of a print position at the time of adjustment as described above with reference to FIG. 8, and it is natural that a density at a center is not necessarily the highest.

Incidentally, in order to reduce the effects of noise, it is possible to stop the carriage to perform measurement, use a sensor having a larger spot diameter, and average the results of measurement of a plurality of points. This makes it possible to average the uneven local optical characteristics (for example, reflective optical densities) of the printed patterns, and measure reflective optical densities with high accuracy.

Figure 15:
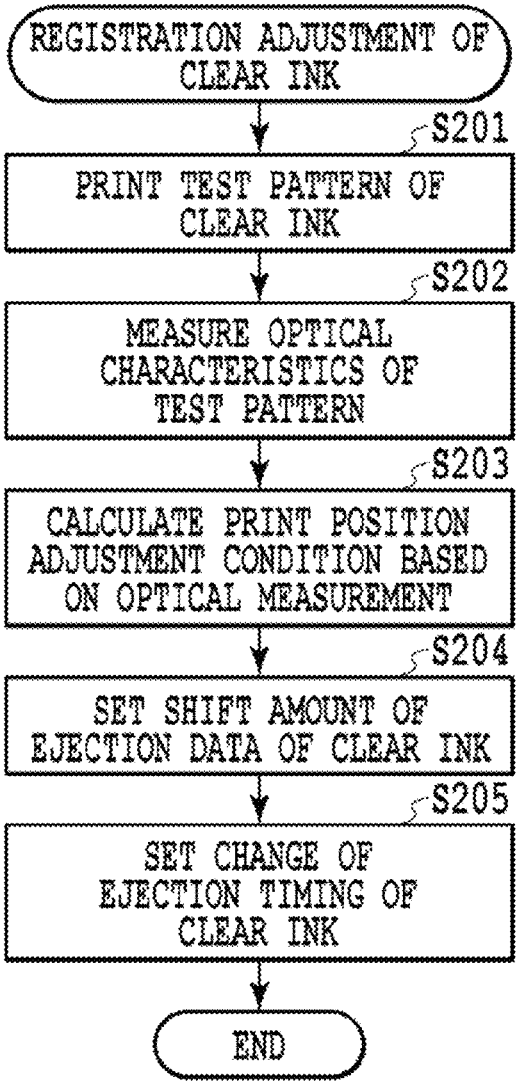
FIG. 15 is a flowchart showing the details of adjustment of the print position of the clear ink in step 200 shown in FIG. 12.

FIG. 15 is a flowchart showing the details of adjustment of the print position of the clear ink in step 200.

First, in step 201, the print position adjustment patterns for the clear ink are printed for the X direction and the Y direction. Next, in step 202, the optical sensor 30 measures the optical characteristics (densities) of the patterns. Then, in step 203, an appropriate condition (an adjustment value) for adjusting the print position is obtained for each of the X direction and the Y direction based on the measured optical characteristics of the patterns. The condition for adjusting the print position can be obtained by using a peak value in curve approximation performed by the least-squares method, for example, as described above with reference to FIG. 11. Then, the shift amount of the ejection data for the clear ink is set for the Y direction (step 204), and a change of an ejection timing is set for the X direction (step 205) based on the obtained print position adjustment condition.

FIG. 16 is a view showing an example of printing, on a print medium P, patterns for adjusting the print position of the clear ink described above with reference to FIG. 9. Unlike four patch patterns shown in FIGS. 10A to 10D, the example shown in FIG. 16 is an example of seven patches having different print position relative shift amounts. Regarding print start timings for the clear ink and the K ink for the seven patches, the print start timing for the K ink, which serves as a reference, is fixed, and a total of seven timings, that is, a currently set start timing, three earlier start timings, and three later start timings are used as the start timings for the clear ink. Setting of the print start timings and printing of the seven patches based on the print start timings can be performed by a program to be started in response to input of a predetermined instruction.

<Sensor Light Source and Reflection Density>

Next, explanation will be made on the details of measurement of the print position adjustment patterns for the clear ink by using the optical sensor 30. The reflective optical sensor 30 of the present embodiment selects and uses, as the light emitting section 31, any of three types of red (an R light source), green (a G light source), and blue (a B light source) light emitting diodes (LEDs) according to the color tones of the clear ink and the coloring material ink used by the printing apparatus, the configuration of the print head, and the like.

Figure 17:
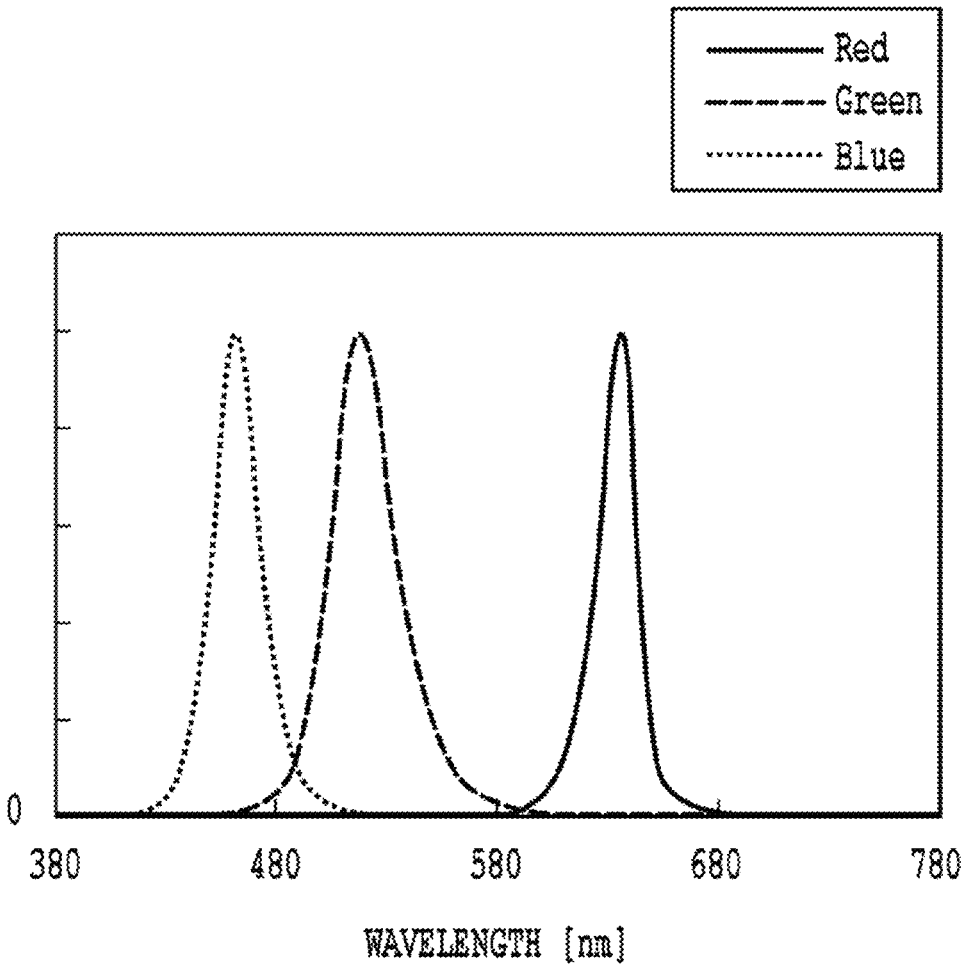
FIG. 17 is a graph showing the color-wavelength characteristics of R, G, and B light emitting diodes used in a light emitting section according to the embodiment of the present invention.

FIG. 17 is a graph showing the color-wavelength characteristics of R, G, and B light emitting diodes used in the light emitting section 31, and shows the light intensity of the light source for each color and each wavelength. As shown in FIG. 17, from left to right, the blue light emitting diode (B light source) has the wavelength characteristics that its peak wavelength is around 470 nm, the green light emitting diode (G light source) has the wavelength characteristics that its peak wavelength is around 530 nm, and the red light emitting diode (R light source) has the wavelength characteristics that its peak wavelength is around 620 nm.

Figure 18A:
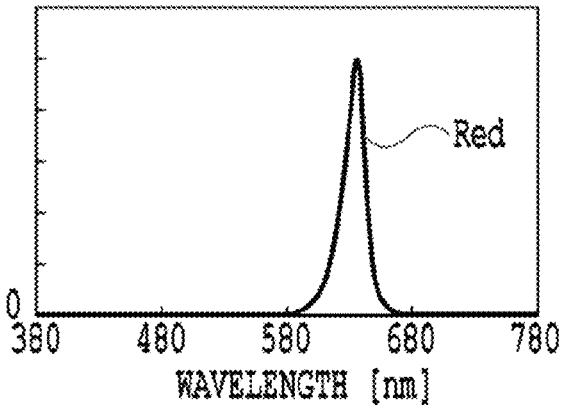
Figure 18B:
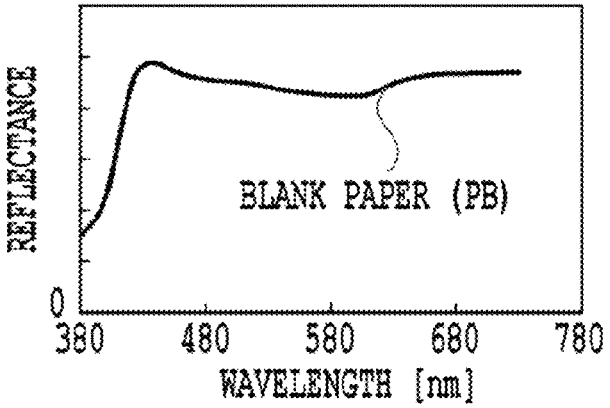
Figure 18C:
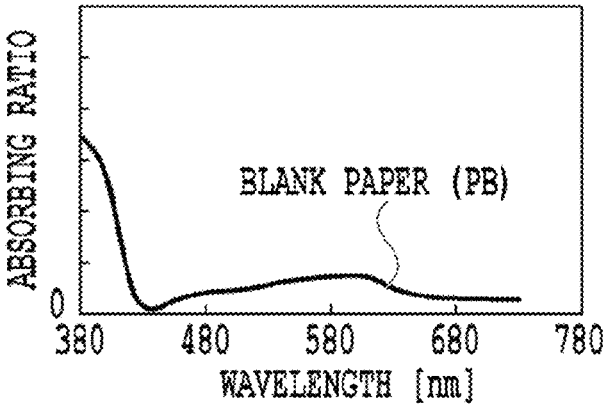
Figure 18D:
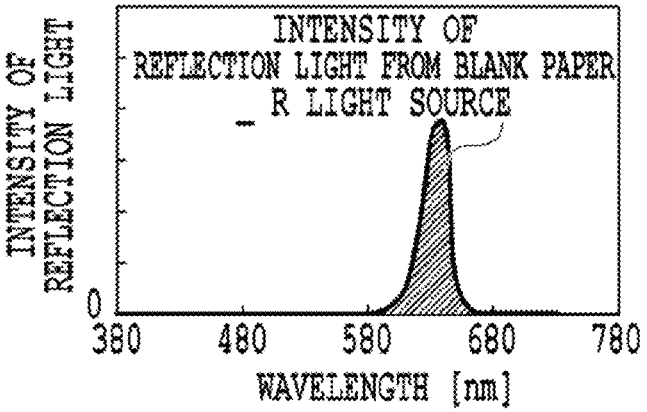

FIGS. 18A to 18D are graphs for explaining measurement principles using the optical characteristics of light emitted from the light emitting section 31. FIG. 18A shows wavelength characteristics under the R light source out of the R, G, and B light sources of the light emitting section 31. FIG. 18B shows the wavelength characteristics (reflectance) of the print medium on which dots are not formed, and shows the reflectance of the color of a dot non-forming portion of the print medium itself. FIG. 18C snows the wavelength characteristics (light absorbing ratio) of the print medium itself, and the light absorbing ratio is obtained by subtracting the above reflectance from 100%. FIG. 18D shows the wavelength characteristics of reflection light emitted from the R light source and reflected from the print medium, and represents a relationship between a wavelength and light intensity (reflection light intensity).

As shown in FIGS. 18B and 18C, the print medium used in the present embodiment has a high reflectance and low absorbing ratio over an entire visible wavelength region. Accordingly, regarding the optical characteristics of reflection light from the R light source shown in FIG. 18D, the light intensity slightly decreases due to absorption of light by the print medium. However, the wavelength characteristics do not differ much from those under the R light source shown in FIG. 18A. A shaded portion in FIG. 18D is a portion which contributes to the measurement output of an element for measuring the intensity of light in the visible wavelength region. Actually, the sensitivity characteristics of the measuring element are affected, but for simple explanation, it is assumed below that the area of the shaded portion directly corresponds to the measurement results (reflection densities) of the optical sensor. In a case where the area of the shaded portion is large, the reflection density is low, and in a case where the area of the shaded portion is small, the reflection density is high.

Next, explanation will be made on a relationship between the color tones of the coloring material inks and a light source color. Explanation will be made below on by taking as an example a case where the R light source is used as the light source color.

FIGS. 19A to 22D are graphs for explaining the optical characteristics of dots of the black (K), cyan (C), magenta (M), and yellow (Y) coloring material inks formed on the print medium and measurement results obtained by using the optical sensor. FIGS. 19A, 20A, 21A, and 22A show wavelength characteristics under the R light source. FIGS. 19B, 20B, 21B, and 22B show the reflectance of a dot forming portion (a printed portion) for each color ink of the print medium, and this is due to color development of the dot forming portion with the color ink. FIGS. 19C, 20C, 21C, and 22C show the absorbing ratio of the dot forming portion of the print medium for each ink, and the absorbing ratio is obtained by subtracting the reflectance from 100%. FIGS. 19D, 20D, 21D, and 22D show the wavelength characteristics of reflection light emitted from the R light source and reflected from the print medium, and represent a relationship between the wavelength and intensity of the reflection light.

Figure 19A:
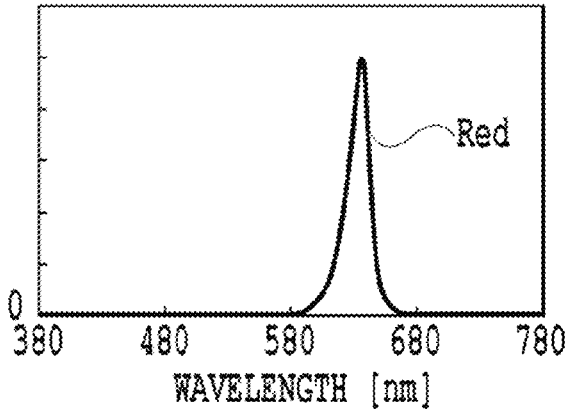
Figure 19B:
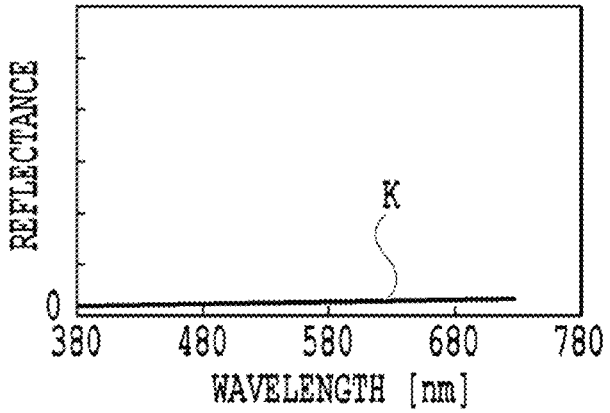
Figure 19C:
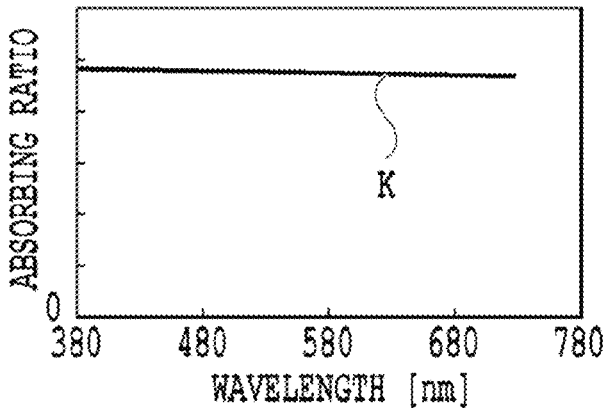
Figure 19D:
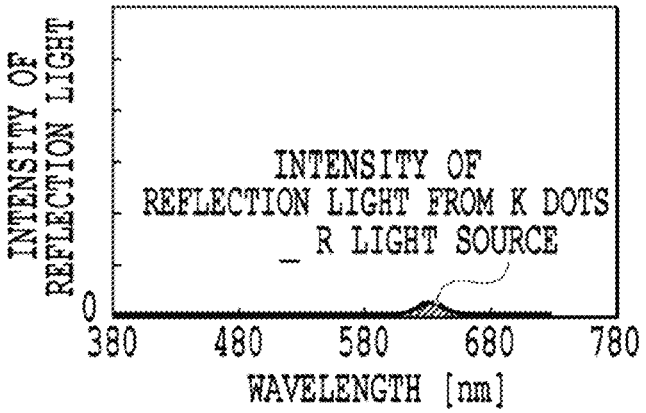

For example, in the case of the K ink as shown in FIGS. 19A to 19D, it is found that as shown in FIG. 19B, the reflectance is low over an entire wavelength range, and conversely, as shown in FIG. 19C, the absorbing ratio is high over the entire wavelength range. Accordingly, as shown in FIG. 19D, the intensity of reflection light reflected from the K dots is low at a wavelength of around 620 nm, which is a red region, and accordingly, a reflection density becomes high. As a result, a difference becomes large between the intensity of reflection light reflected from the K dots and the intensity of reflection light reflected from a blank portion (of the print medium) as shown in FIG. 18D.

Figure 20A:
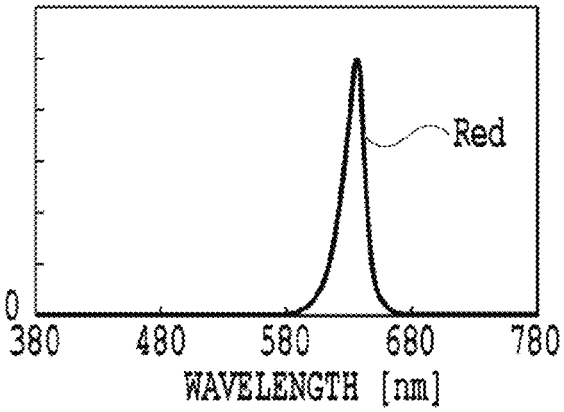
FIGS. 20A to 20D are graphs for explaining the optical characteristics of dots of a cyan (C) coloring material ink similarly printed on the print medium and measurement results obtained by using the optical sensor.
Figure 20B:
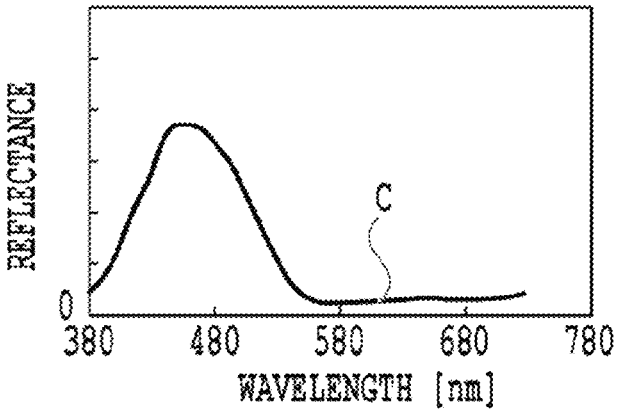
Figure 20C:
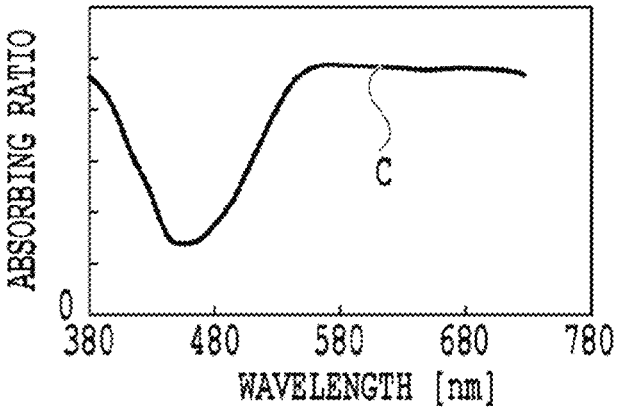
Figure 20D:
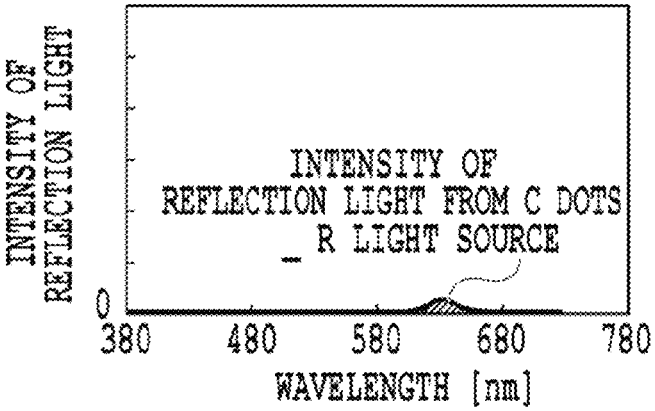

In the case of the C ink as shown in FIGS. 20A to 20D, it is found that as shown in FIG. 20B, the reflectance peaks at a wavelength of around 460 nm, which corresponds to this color tone, and conversely, as shown in FIG. 20C, an absorbing ratio becomes high in a visible region other than wavelengths corresponding to this color tone. Accordingly, as shown in FIG. 20D, the intensity of reflection light reflected from the C dots is low at a wavelength of around 620 nm, which is the red region, and accordingly, a reflection density becomes high. As a result, a difference becomes relatively large between the intensity of reflection light reflected from the C dots and the intensity of reflection light reflected from a blank portion as in the case of the K ink.

Figure 21A:
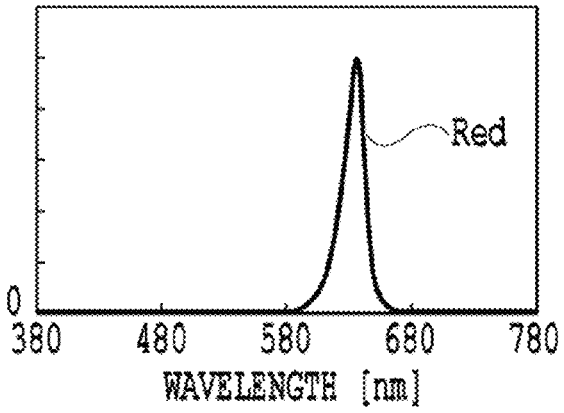
FIGS. 21A to 21D are graphs for explaining the optical characteristics of dots of a magenta (M) coloring material ink similarly printed on the print medium and measurement results obtained by using the optical sensor.
Figure 21B:
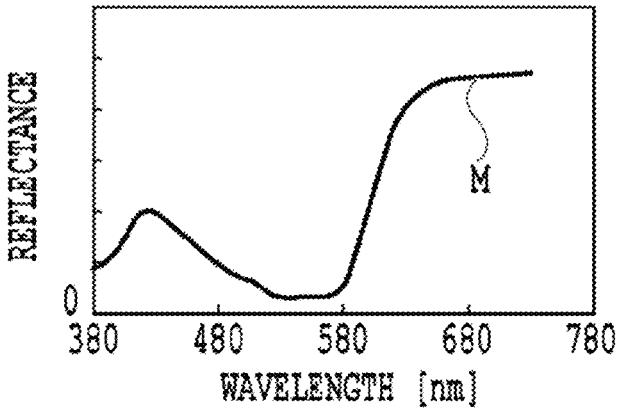
Figure 21C:
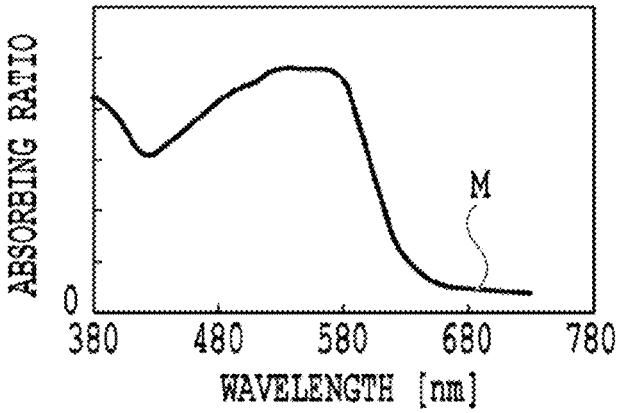
Figure 21D:
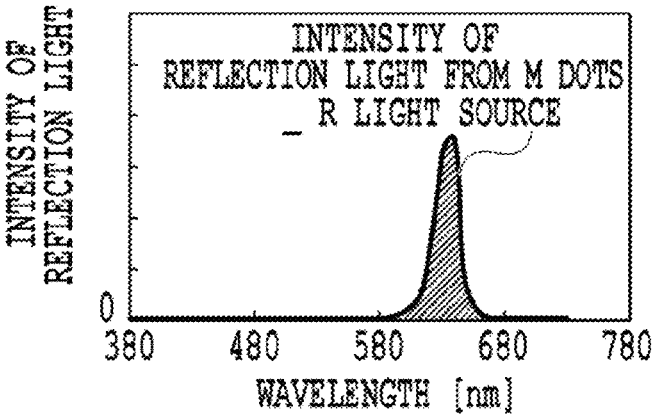
Figure 22A:
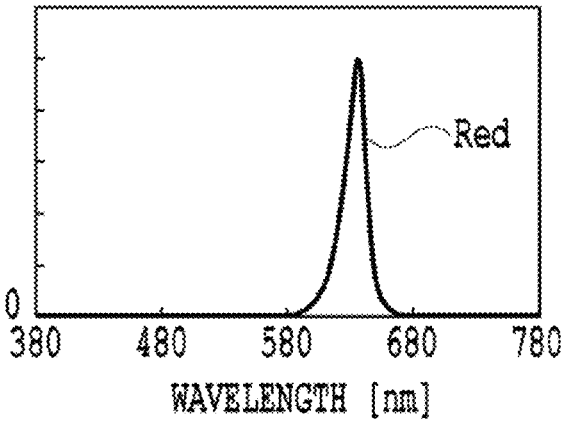
FIGS. 22A to 22D are graphs for explaining the optical characteristics of dots of a yellow (Y) coloring material ink similarly printed on the print medium and measurement results obtained by using the optical sensor.
Figure 22B:
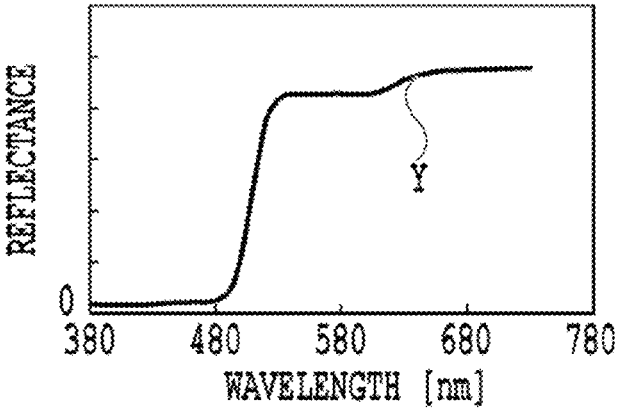
Figure 22C:
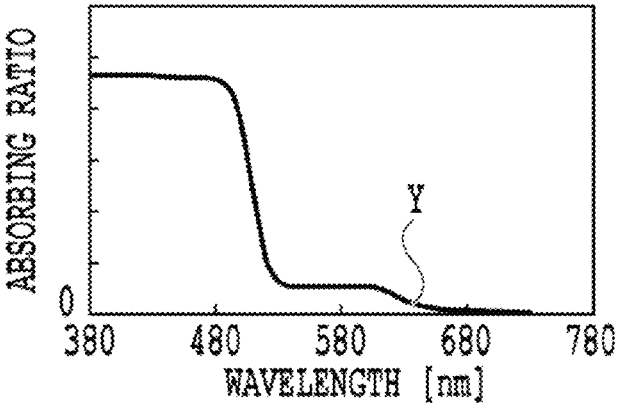
Figure 22D:
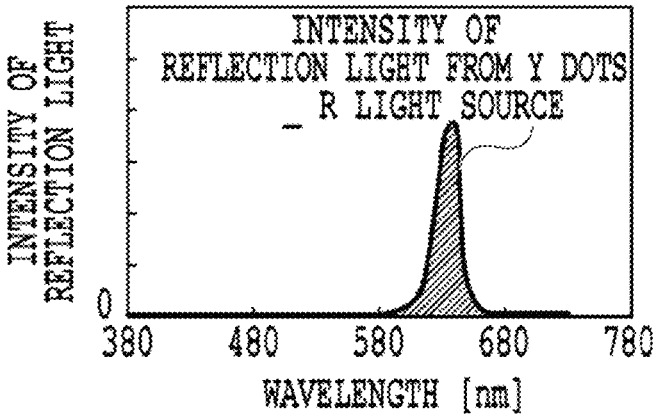

The M ink shown in FIGS. 21A to 21D and the Y ink shown in FIGS. 22A to 22D have wavelength characteristics (reflectivities) shown in FIGS. 21B and 22B, respectively, and as a result, absorptivities are achieved as shown in FIGS. 21C and 22C. More specifically, it is found that the absorptivities of the M ink and the Y ink are low at a wavelength of around 620 nm, which is the red region. Accordingly, the intensities of light beams emitted from the R light source and reflected from the M dots and the Y dots become relatively high as shown in FIGS. 21D and 22D, and reflection densities become relatively low. As a result, a difference becomes small between the intensities of light beams reflected from the M dots and the Y dots and the intensity of reflection light reflected from a blank portion as shown in FIG. 18D.

<Reflection Densities of Print Position Adjustment Patterns>

The print positions of the coloring material inks are adjusted by using the patterns shown in FIGS. 7A to 7D to detect a change in area factor corresponding to displacement of the print positions. In this respect, as a difference in the intensity of reflection light from the light source between a blank portion (a background portion of the print medium) and the dot forming portion becomes larger, an S/N ratio improves, and a detection accuracy can be increased. Accordingly, in the case of adjusting the print positions of the coloring material inks, it is preferable to select a light source color such that the intensities of light beams reflected from the two inks to be adjusted become lower than the relatively large intensity of reflection light reflected from a blank portion (such that reflection densities become higher).

Specifically, in the case of adjusting the print positions of the K ink and the C ink, for example, it is preferable to select red as the light source color. More specifically, in a case where the print positions of the K ink and the C ink match each other, a total area factor of the K dots and the C dots is about 100% as shown in FIG. 7A. As a result, under the R light source, the intensities of reflection light beams shown in FIGS. 19D and 20D exist in a mixed manner, and accordingly, a reflection density becomes high. On the other hand, in a case where the print positions of the inks are displaced from each other by a relatively large amount, and an area factor is low as shown in FIG. 7D, the exposed area of the print medium becomes large. As a result, under the R light source, the intensity of reflection light is on the same level as the intensity of reflection light reflected from a blank portion as shown in FIG. 18D, and the reflection density of an entire printed portion is low.

For a similar reason, in a case where the print positions of the K ink and the M ink are adjusted, it is preferable to select and use green as the light source color, and in a case where the print positions of the K ink and the Y ink are adjusted, it is preferable to select and use blue as the light source color.

Incidentally, the print positions of the color (CMY) inks other than the black ink can be adjusted by adjusting all the print positions of the colors to match the print position of the black ink, for example. Since the intensity of light emitted from all RGB light sources and reflected from the black ink is low, a light source color which has excellent light absorption characteristics can be selected from red (the R light source), green (the G light source), and blue (the B light source) according to the color tones of the other coloring material inks whose print positions are adjusted to match the print position of the black ink, so as to measure optical characteristics. This makes it possible to detect, with high accuracy, a change in the total area factor of the coloring material ink dots of the patches. As a result, it is possible to improve accuracy in adjusting the print positions of the coloring material inks.

Further, a relationship between (the color tone of) the coloring material ink used for adjusting the print position of the clear ink and the light source color will be described below.

As described above with reference to FIGS. 10A to 10D and FIG. 11, the print position of the clear ink is adjusted by changing the relative shift amount of the coloring material inks which serve as a reference and the clear ink to perform printing and detecting a change in the color of an overlapping portion as a change in optical characteristics.

Figure 23A:
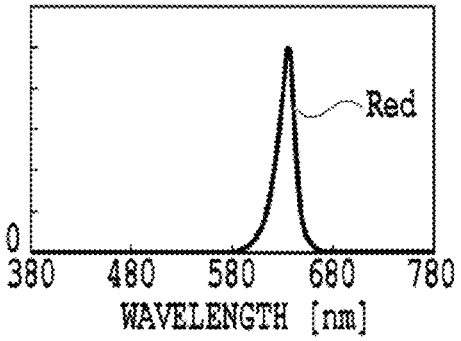
FIGS. 23A to 23E are graphs for explaining optical characteristics in a case where the clear ink and the single-color coloring material ink are printed to overlap each other and in a case where the clear ink and the single-color coloring material ink are printed not to overlap each other.

FIGS. 23A to 23E are graphs for explaining optical characteristics in a case where the clear ink and the single-color coloring material ink are printed to overlap each other and a case where the clear ink and the single-color coloring material ink are printed not to overlap each other. FIG. 23A shows wavelength characteristics under the R light source like the drawings for explaining the above-described optical characteristics.

Figure 23B:
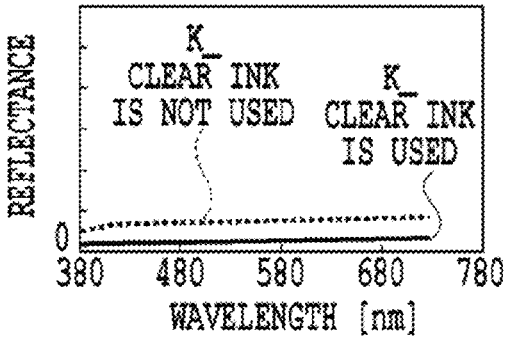
Figure 23C:
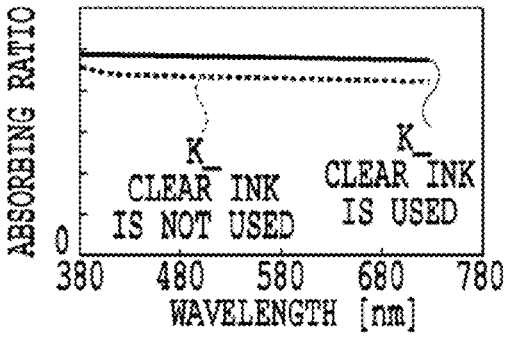
Figure 23D:
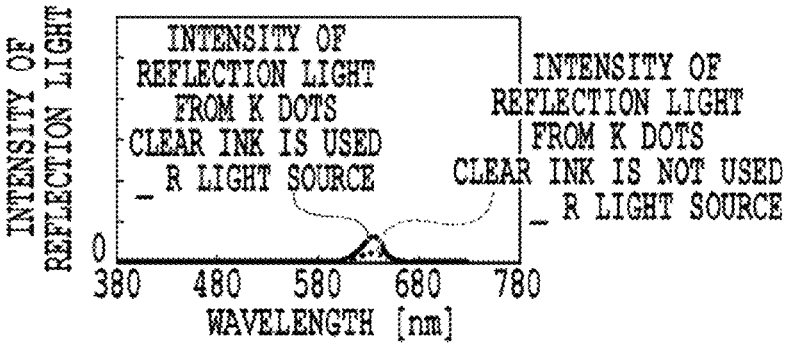
Figure 23E:
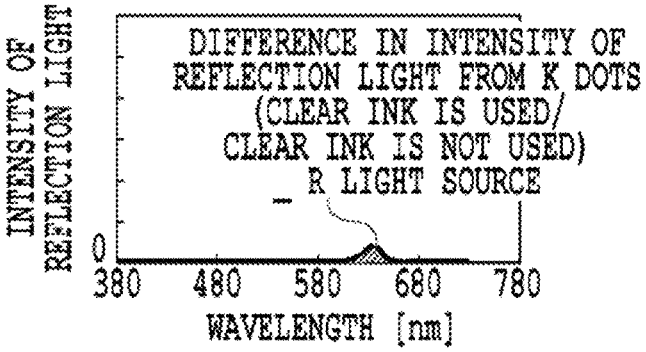

FIG. 23B shows the wavelength characteristics (reflectance) of the dot forming portion in a case where the K ink is singly printed on the print medium or in a case where the K ink overlaps the clear ink. In FIG. 23B, a solid line represents characteristics in a case where the K ink overlaps the clear ink, and a dashed line represents characteristics in a case where the K ink is singly used. The same can be said for FIGS. 23C and 23D. In FIG. 23A, a reflectance in a case where the K ink overlaps the clear ink as indicated by the solid line is lower over the entire wavelength range than a reflectance in a case where the K ink is singly used as indicated by the dashed line. More specifically, it is found that in a case where the K ink overlaps the clear ink, a density becomes high. FIG. 23C shows the wavelength characteristics (absorbing ratio) of a K dot forming portion on the print medium. This absorbing ratio is obtained by subtracting the above-described reflectance from 100%. FIG. 23D shows the wavelength characteristics of reflection light reflected from the print medium under the R light source, and shows a relationship between the wavelength and intensity of the reflection light. FIG. 23E shows a difference from the wavelength characteristics of the reflection light (the intensity of the reflection light) shown by FIG. 23D. This represents a difference in the intensity of the reflection light for the wavelength of the reflection light between a case where the K ink is singly used and a case where the K ink overlaps the clear ink. In the embodiment of the present invention, the print position of the clear ink is adjusted by using the above difference.

More specifically, in a print position relationship in which the clear ink dots and the K dots do not overlap each other as shown in FIG. 10A, the intensity of the reflection light shown in FIG. 18D and the intensity of the reflection light shown by the dashed line in FIG. 23D exist in a mixed manner. Further, in a print position relationship in which the clear ink dots and the K dots completely overlap each other as shown in FIG. 10D, the intensity of the reflection light shown in FIG. 18D and the intensity of the reflection light shown by the solid line an FIG. 23D exist in a mixed manner. More specifically, in the above-described adjustment of the print position using the feature that the clear ink and the K ink simply overlap each other, there is a case where no large difference in the intensity of reflection light, that is, the measured density exists between a case where the clear ink and the K ink overlap each other and a case where the clear ink and the K ink do not overlap each other. In this case, it is impossible to significantly detect a change in density according to a change in area factor which is caused by displacement of the print position. Accordingly, single use of the clear ink dots scarcely contributes to absorption in any of the wavelength regions of the R, G, and B light source, and it is difficult to detect a change in area factor as a change in the intensity of the reflection light as described above regarding adjustment of the print positions of the coloring material inks.

Incidentally, adjustment of the print position of the clear ink by a conventional technique uses coagulation of the coloring material inks by the clear ink, and detects, as a difference in optical characteristics, a difference in density between a case where the clear ink and the coloring material inks overlap each other and a case where the clear ink and the coloring material inks do not overlap each other to detect a relative position relationship. However, the amount of change in reflection density caused by coagulation using the print position adjustment patterns for the clear ink is small as compared with the case of detecting a change in area factor as in the print position adjustment patterns for the coloring material inks as described above, and detection accuracy may be decreased. For example, in a case where the above amount of change is lowered by the cost-down of devices such as a reflective optical sensor and an electrical circuit and the characteristics of media and inks to be used, there is a possibility that a difference to be detected may be buried in noise, and become difficult to detect.

On the other hand, the present invention prints a print position adjustment pattern whose difference in reflection density is large between a case where the clear ink and the coloring material inks overlap each other and a case where the clear ink and the coloring material inks do not overlap each other. Explanation will be made be low on several embodiments.

FIGS. 24A to 24D and 25A to 25F are cross-sectional views of the print medium for explaining a manner of permeation in a case where the coloring material inks of two different color tones land on the same position of the print medium. FIGS. 24A to 24D show a case where the coloring material inks of colors 1 and 2 land on the print medium in this order, and FIGS. 25A to 25F show a case where the clear ink and the inks of the colors 1 and 2 land on the print medium in this order.

Figure 24A:
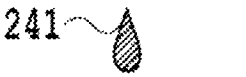
FIGS. 24A to 24D are cross-sectional views of the print medium for explaining how coloring material inks of colors 1 and 2 permeate the print medium in a case where the coloring material inks of the colors 1 and 2 land on the print medium in this order.
Figure 24B:
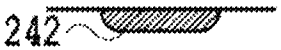
Figure 24C:
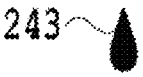
Figure 24D:
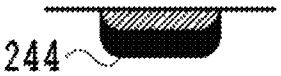

As shown in FIG. 24A, an ink droplet 241 of the color 1 is ejected from the print head. This ink droplet lands on the blank portion of the print medium, whereby a solvent in an ink permeates the print medium, and a coloring material, which is a solid in the ink, is fixed to a surface layer of the print medium. In this manner, as shown in FIG. 24B, a dot 242 is formed. Then, as shown in FIG. 24C, an ink droplet 243 of the color 2 is ejected from the print head. This ink droplet lands on the dot 242 formed on the print medium in an overlapping manner. In a case where the ink droplet already lands on the print medium to form the dot in this manner, as shown in FIG. 24D, the ink droplet 243 lands on the same position later, and permeates down to the depth of the dot 242 and permeates down to the position of a dot 244. This is because the firstly landing ink increases the wet of the print medium, and enables a subsequently landing ink to permeate easily. In a case where inks of two different color tones are ejected on an area in which the clear ink does not exist, the subsequently landing ink droplet 243 of the color 2 permeates down to the depth of the print medium, whereby the dot 242 of the firstly landing ink droplet 241 of the color 1 remains in the upper surface of the print medium. As a result, the color 1 is mainly observed in a portion in which the dots overlap each other. Incidentally, FIGS. 24A to 24D show the dot 242 and the dot 244 so that the dot 242 and the dot 244 are separated in order to show a permeation position in a simple manner, but there is a case where part of the coloring material of the subsequently landing ink droplet 243 of the color 2 also remains in the surface layer.

Figures 25A, 25B, 25C, 25D, 25E, 25F:
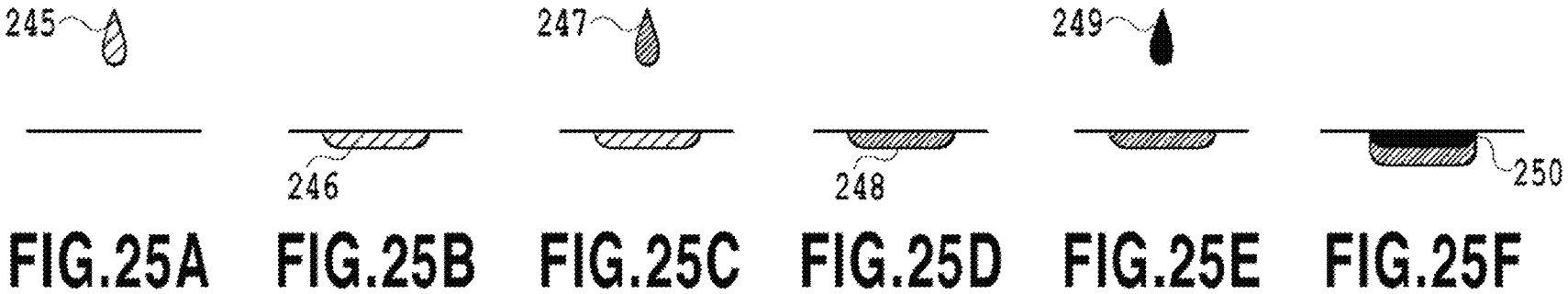
FIGS. 25A to 25F are cross-sectional views of the print medium for explaining how the clear ink and the inks of the colors 1 and 2 permeate the print medium in a case where the clear ink and the inks of the colors 1 and 2 land on the print medium in this order.

Further, in a case where the clear ink and two types of inks are used, as shown in FIG. 25A, an ink droplet 245 of the clear ink is ejected from the print head. As shown in FIG. 25B, this ink droplet lands on a blank portion of the print medium, and is fixed to the surface layer of the print medium to form a dot 246. Next, as shown in FIG. 25C, an ink droplet 247 of the color 1 is ejected from the print head, and lands on the dot 246 of the clear ink formed in the print medium in an overlapping manner. In a case where the ink of the color 1 contacts the clear ink and coagulates, the solvent in the ink permeates the print medium, and as shown in FIG. 25D, a coloring material included in the ink droplet 247 is fixed to an area closer to the surface layer of the print medium as compared with the case shown in FIGS. 24A to 24D, and forms a dot 248. Then, as shown in FIG. 25E, an ink droplet 249 of the color 2 is ejected from the print head, and as shown in FIG. 25F, the dot 248 of the firstly landing ink 1 lands in an overlapping manner. Since a component of the firstly landing clear ink dot 246 remains in the surface layer of the print medium, a coloring material of the ink droplet 249 of the color 2 does not permeate to the depth of the dot as shown in FIGS. 24A to 24D, and is fixed to an upper side of the dot 248 of the color 1.

As described above, in a case where the two types of inks and the clear ink are used, the coloring materials of the inks of the color 1 and the color 2 are fixed to a portion closer to the surface layer of the print medium as compared with the case of not using the clear ink as shown in FIGS. 24A to 24D. As a result, the density of the dot portions is improved, and as its color tone, the color 2 fixed to the upper layer can be dominantly seen.

Figure 26A:
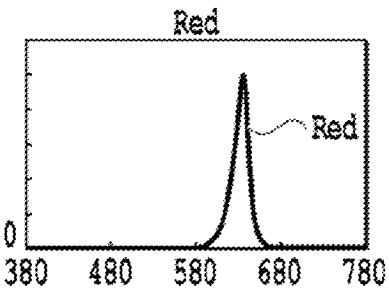
FIGS. 26A to 26K are graphs for explaining a difference in optical characteristics between a case where the clear ink is used and a case where the clear ink is not used.
Figure 26B:
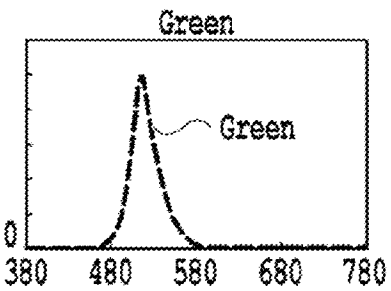
Figure 26C:
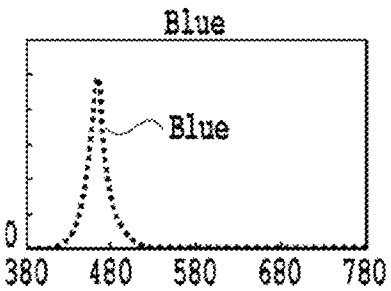

FIGS. 26A to 26K are graphs for explaining a difference in optical characteristics between a case where the clear ink is used and a case where the clear ink is not used as described above with reference to FIGS. 24A to 24D and 25A to 25F, and show a case where the yellow (Y) ink is used as the color 1 ink and the black (K) ink is used as the color 2 ink. FIG. 26A, FIG. 26B, and FIG. 26C show the wavelength characteristics of light emitting diodes of the R, G, and B light sources of the light emitting section 31, respectively.

Figure 26D:
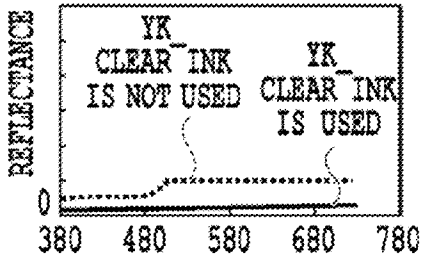

FIG. 26D shows the wavelength characteristics (reflectivities) of an area in which dots are formed in a case where the Y ink and the K ink are applied to the print medium in an overlapping manner in the order named (a dashed line) and a case where the clear ink, the Y ink, and the K ink are applied to the print medium in an overlapping manner in the order named (a solid line). Incidentally, the dashed line and the solid line in the drawings mean the same in FIGS. 26E to 26H as well.

Figure 26E:
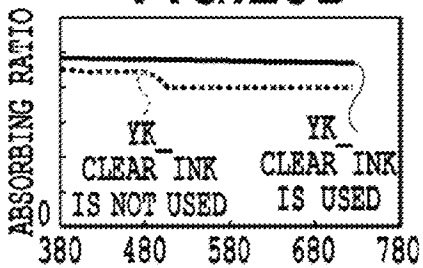

As shown in FIG. 26D, in a case where the clear ink is used (the solid line), a reflectance is low (a reflection density is high) over the entire wavelength range. Further, upon comparison of a case where the clear ink exists (the solid line) with a case where the clear ink does not exist (the dashed line), it is found that the shape of a curved line indicative of a reflectance changes over a predetermined wavelength range. This is because a fixed position relationship between the color 1 ink and the color 2 ink changes according to the presence or absence of the clear ink, whereby the color tone changes as described above with respect to FIGS. 24A to 24D and 25A to 25F. More specifically, in a case where the clear ink exists, the subsequently landing K ink is fixed to the upper layer and forms the main color tone, and accordingly, a reflectance is low over the entire wavelength range, and the shape of the curved line is substantially flat. On the other hand, in a case where the clear ink does not exist, the firstly landing Y ink is fixed to the upper layer and forms a main color tone. Accordingly, a reflectance is relatively low over a range close to the peak wavelength of the B light source shown in FIG. 26C, whereas a reflectance is relatively high over a range close to the peak wavelength of the R and G light sources shown in FIGS. 26A and 26B. FIG. 26E shows the wavelength characteristics (absorbing ratio) of the dot forming portion of the print medium. This absorbing ratio is obtained by subtracting the above-described reflectance from 100%.

Figures 26F, 26G, 26H:
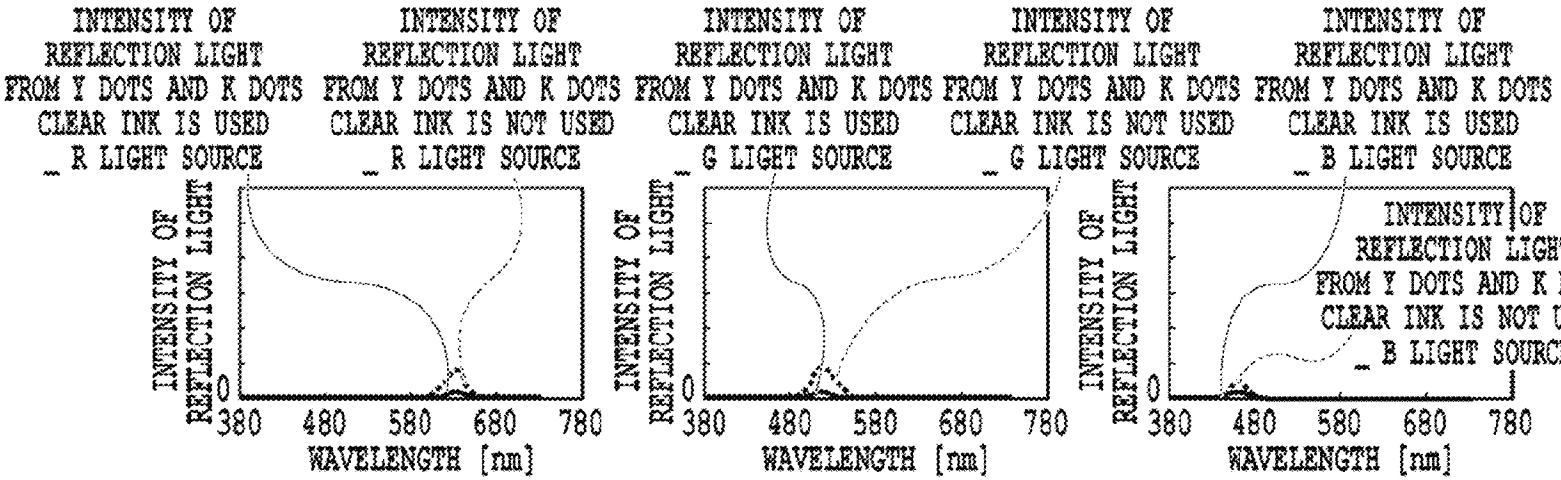

FIGS. 26F, 26G, and 26H show the wavelength characteristics of reflection light beams reflected from the dot forming portion of the print medium under the R, G, and B light sources. In a case where the clear ink exists (a solid line), black is a main color tone, and accordingly, under any light source, the intensity of reflection light is low, and a reflection density is high. On the other hand, in a case where the clear ink does not exist (a dashed line), yellow is a main color tone, and accordingly, the intensity of reflection light is high (a reflection density is low) under the R and G light sources, and the intensity of reflection light is low (the reflection density is high) under the B light source. In this respect, a difference in reflection density between a case where the clear ink exists and a case where the clear ink does not exist can be increased by selecting the R and G light sources in which in a case where the clear ink does not exist, the reflection density of the dot forming portion becomes relatively low.

Figures 26I, 26J, 26K:
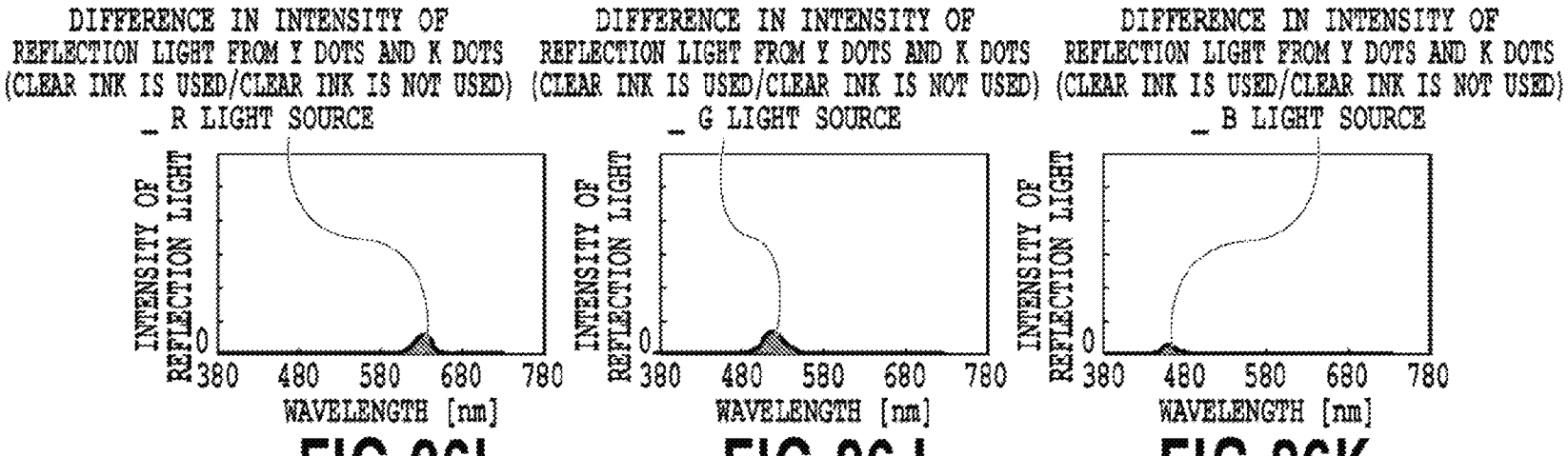

FIGS. 26I, 26J, and 26K show a difference in the wavelength characteristics of reflection light beams under the R, G, and B light sources which vary depending on whether or not the clear ink exists. In each drawing, the area of a shaded portion represents a difference in the intensity of reflection light, and the area of the shaded portion in the case of the R and G light sources is larger than the area of the shaded portion in the case of the B light source. As the area of the shaded portion becomes larger, a difference in reflection density becomes larger, and detection accuracy improves.

Incidentally, in the above example, explanation has been made on a case where the Y ink and the K ink are printed in this order, but it is possible to achieve similar advantageous results by appropriately combining the color tones of the coloring material inks, printing order, and a light source color. More specifically, for a certain light source color, a color tone whose reflection density is low is selected as the firstly landing color 1 ink and a color tone whose reflection density is high is selected as the subsequently landing color 2 ink. This makes it possible to increase the amount of change in reflection density as compared with the case of using one type of coloring material ink (a single color) and to improve the detectability of a difference between a case where the clear ink exists and a case where the clear ink does not exist.

<Adjustment of the Print Position of the Clear Ink in the Embodiment>

Figure 27:
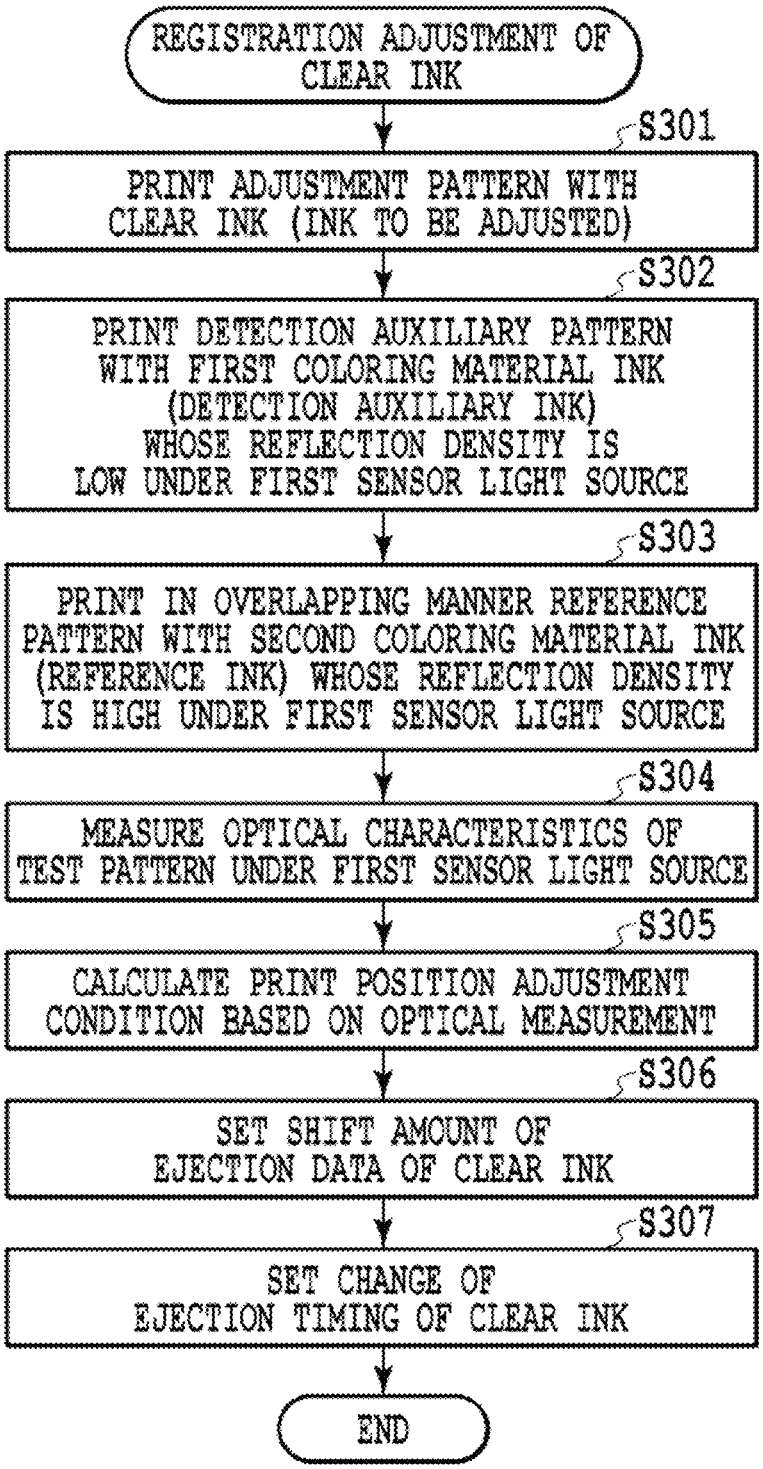
FIG. 27 is a flowchart showing processing for adjusting the print position of the clear ink according to the first embodiment of the present invention.

FIG. 27 is a flowchart showing processing for adjusting the print position of the clear ink according to the present embodiment. Further, FIGS. 28A to 28H are schematic cross-sectional views of the print medium for explaining printing of an adjustment pattern for adjusting the print position of the clear ink according to the present embodiment. Incidentally, adjustment of the print position of the clear ink according to the present embodiment is to adjust the print position of the clear ink, and the K ink is used as an ink at its reference position and the Y ink is used as a detection auxiliary ink. More specifically, the color 1 ink and the color 2 ink described above with reference to FIGS. 25A to 25F correspond to the Y ink and the K ink, respectively. In the present embodiment, red (the R light source) is used as the light source color.

Figures 28A, 28B, 28C, 28D, 28E, 28F, 28G, 28H:
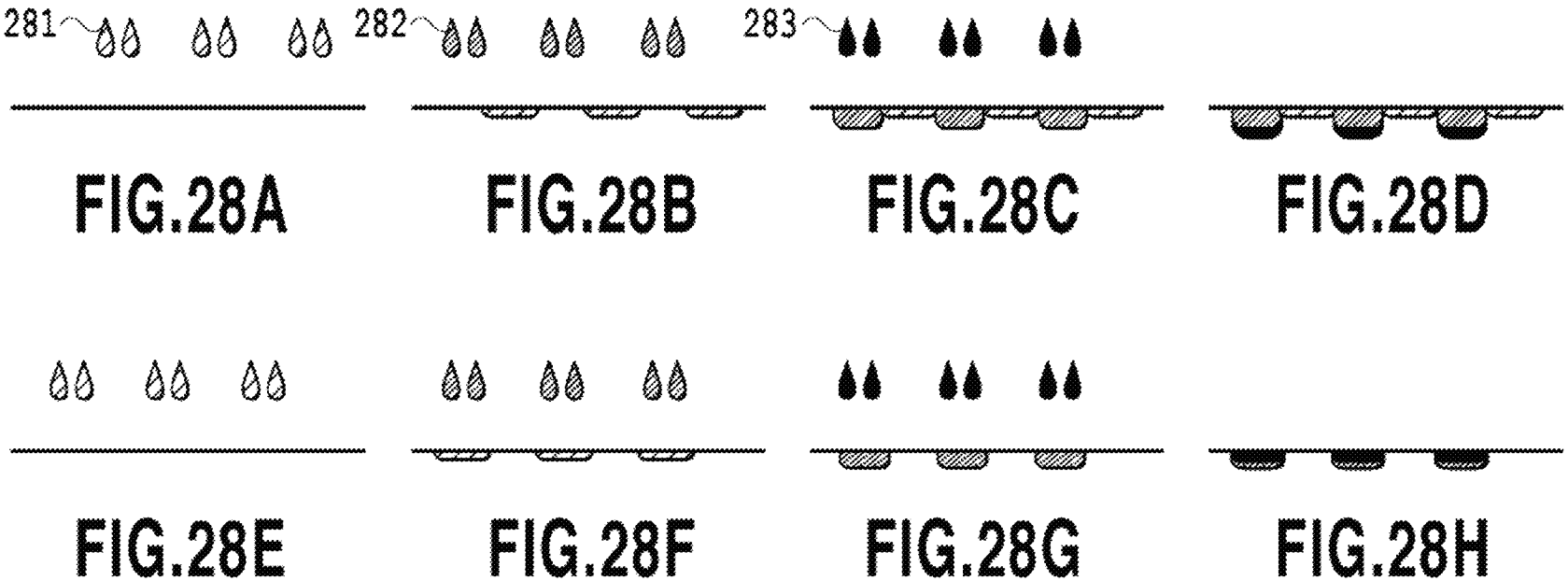
FIGS. 28A to 28H are schematic cross-sectional views of the print medium for explaining printing of an adjustment pattern for adjusting the print position shown in FIG. 27.

In FIG. 27, firstly, in step 301, a print position adjustment pattern 281 (FIG. 28A) is printed with the clear ink (an ink to be adjusted). The adjustment pattern 281 of the present embodiment is a zigzag pattern like the patterns described above with reference to FIGS. 9 and 10A to 10D. FIGS. 28A and 28E show printing the adjustment patterns with the clear ink shown in FIGS. 10A and 10D, respectively.

Next, in step 302, the detection auxiliary pattern 282 (FIG. 28B) is printed with the Y ink as the detection auxiliary ink. The detection auxiliary pattern 282 of the embodiment is printed by printing the same pattern at the same position as a reference pattern 283 to be printed with the K ink later. FIGS. 28B and 28F show a manner in which the detection auxiliary pattern 282 is printed.

Next, in step 303, the reference pattern 283 (FIG. 28C) is printed with the K ink serving as a reference ink. The reference pattern 283 of the present embodiment is printed like the patterns explained with reference to FIGS. 9 and 10A to 10D, and FIGS. 28C and 28G show a manner in which the reference patterns shown in FIGS. 10A and 10D are printed with the K ink, respectively. In this manner, the reference pattern 283 is printed in an overlapping manner on a printed portion of the detection auxiliary pattern 282 printed with the Y ink in step 302.

Figure 29:
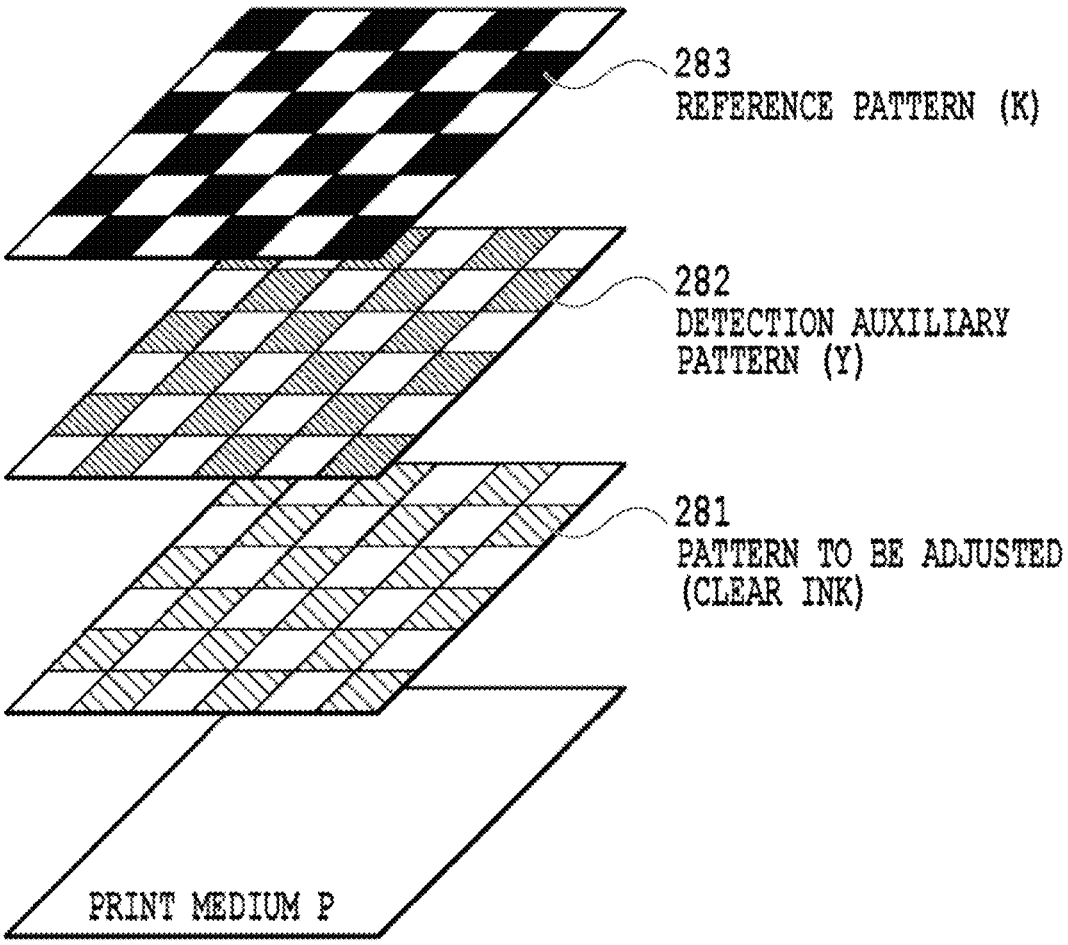
FIG. 29 is a view showing a pattern for adjusting the print position of the clear ink and its printing order according to the first embodiment of the present invention.

FIG. 29 is a view showing a printed pattern for adjusting the print position of the clear ink and its printing order as described above with reference to FIGS. 27 and 28A to 28H. As shown in FIG. 29, the adjustment pattern 281 of the clear ink, the detection auxiliary pattern 282 of the Y ink, and the reference pattern 283 of the K ink are printed on the print medium in this order. Such patterns are printed in nine manners as shown in FIG. 14 by shifting the print position shift amount of the clear ink. The above processing is performed in each of the X direction and the Y direction.

With reference to FIG. 27 again, after the above printing, the optical characteristics under the R light source are measured in step 304, and an appropriate print position adjustment condition (an adjustment value) is obtained in step 305. Further, in step 306, based on the obtained adjustment value, the amount of a shift of ejection data of the clear ink in the Y direction is set (step 306), and a change of ejection timing in the X direction is set (step 307).

<Comparison of Measurement Values of Print Position Adjustment Patterns>

Figure 30:
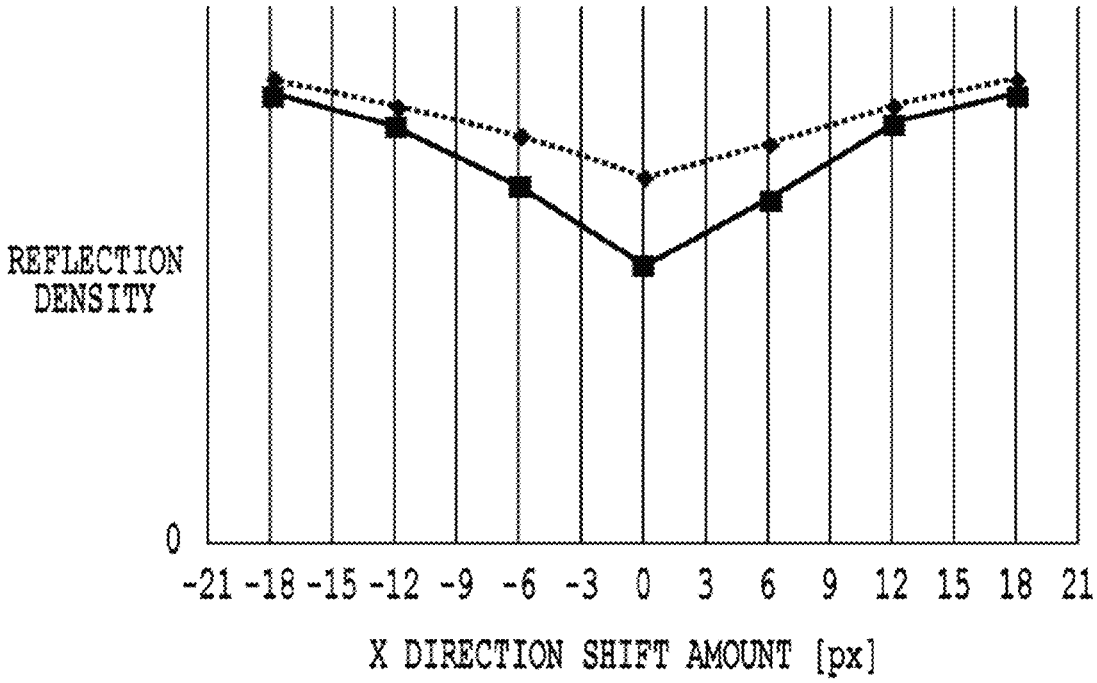
FIG. 30 is a graph for explaining the reflection density of each patch in adjustment of the print position of the clear ink according to the first embodiment of the present invention.
Figures 31A, 31B, 31C, 31D, 31E, 31F, 31G, 31H:
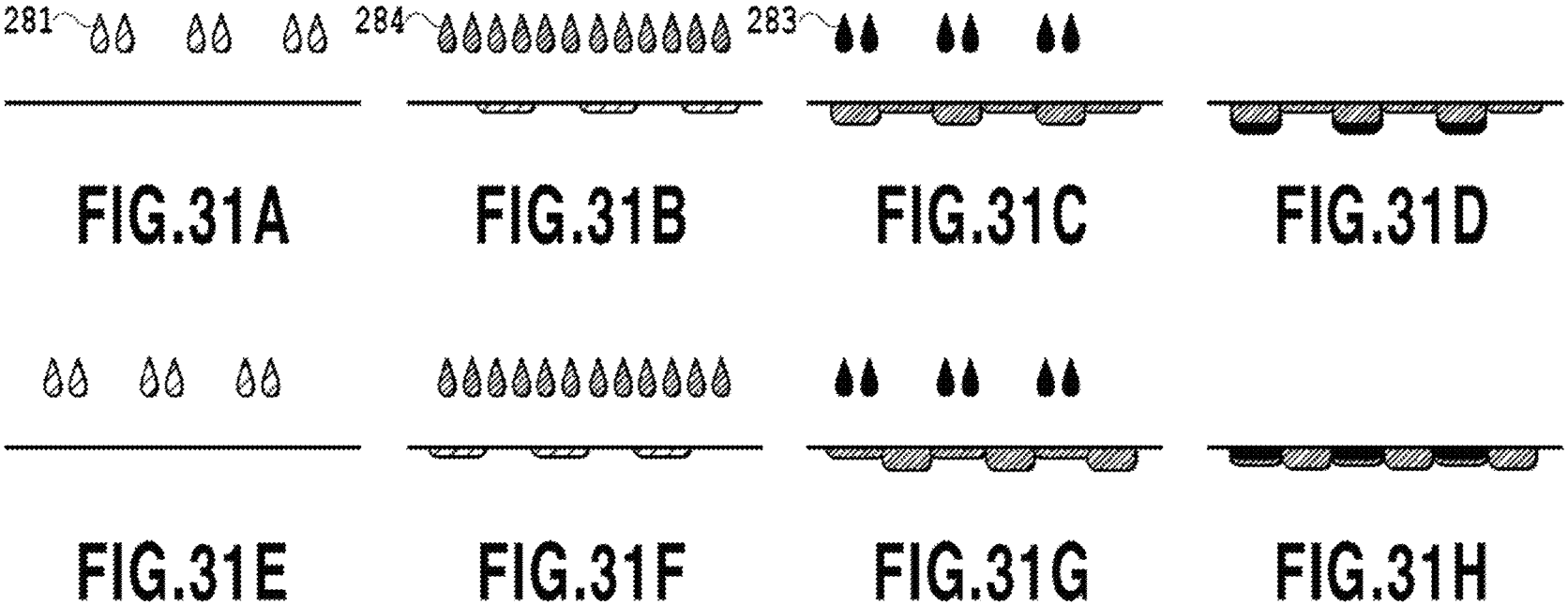
FIGS. 31A to 31H are schematic cross-sectional views for explaining printing of a detection auxiliary pattern and a reference pattern according to a variation of the first embodiment of the present invention.

FIG. 30 is a graph for explaining the reflection density (a solid line) of each patch in adjustment of the print position of the clear ink according to the present embodiment as compared with the reflection density (a dashed line) of each patch in adjustment of the print position of the clear ink according to a comparative example described above with reference to FIG. 15. In FIG. 30, the dashed line represents a change in reflection density according to displacement of the print position in a case where the K ink (the reference ink) is singly used as the coloring material ink, and the solid line represents a change in reflection density in a case where the Y ink (the detection auxiliary ink) and the K ink (the reference ink) are used as the coloring material inks. A state in which a shift amount corresponding to a point at which a reflection density is at a minimum (the X axis) is zero corresponds to the state shown in FIG. 10A or FIG. 28D, that is, a state in which the print position of the clear ink matches the print position of the K ink as the reference ink. On the other hand, a point having a shift amount at which a reflection density is at a maximum corresponds to the state shown in FIG. 10D or FIG. 28H, that is, a state in which the print position of the clear ink is greatly displaced from the print position of the K ink as the reference ink.

Assuming that in adjustment of the print position of the clear ink singly using the K ink, the variation width of the reflection density is 1.0, in adjustment of the print position of the clear ink according to the present embodiment, the variation width of the reflection density is about 1.8, and the variation width becomes larger. In this manner, by appropriately combining a combination of the coloring material inks of the two colors, printing order, and the light source color used for measurement, it becomes possible to increase a difference in optical characteristics between a case where the clear ink exists and a case where the clear ink does not exist, and improve the detectability of the difference.

<Combination of the Sensor Light Source Color, the Detection Auxiliary Ink, and the Reference Ink>

In the above explanation of the embodiment, the red (R) light source is used as the light source color, the Y ink is used as the detection auxiliary coloring material ink to be firstly applied to the print medium, and the K ink is used as the reference coloring material ink to be subsequently applied. However, there is another combination which achieves the same advantageous results.

As described above, for the light source color used for a test, the present invention selects an ink having a color tone such that a reflection density is low as the detection auxiliary coloring material ink to be firstly applied, and selects an ink having a color tone such that a reflection density is high as the reference coloring material ink to be subsequently applied. Assuming that as a representative combination, R, G, and B are used as the sensor light source colors, and C, M, Y, and K are the ideal colors of the coloring material inks, under the red (R) light source, the Y ink or the M ink is selected as the detection auxiliary ink, and the K ink or the C ink is selected as the reference ink. Under the green (G) light source, the C ink or the Y ink is selected as the detection auxiliary ink, and the K ink or the M ink is selected as the reference ink for combination. Further, under the blue (B) light source, the M ink or the C ink is selected as the detection auxiliary ink, and the K ink or the Y ink is selected as the reference ink for combination. Incidentally, there are many cases where the C, M, Y, and K coloring material inks used for the inkjet printing apparatus are not ideal C, M, Y, and K. Further, the color development of the print medium to be used and the configuration of the printing apparatus also put limitations on dot overlapping order. In this respect, it is desirable to actually print patterns on the print medium used for printing under various conditions to obtain an optimal combination beforehand.

<Regarding Detection of Optical Characteristics>

In the above explanation of the embodiment, the reflective optical sensor for emitting limit from the color (R, G, or B) light source having a predetermined peak wavelength and measuring the intensity (reflection density) of its reflection light is used as a detecting unit configured to detect optical characteristics. However, it is natural that it is possible to use another detecting unit as long as the other detecting unit detects optical characteristics over a specific wavelength range. For example, it is also possible to emit white light from a white light source, disperse its amplified reflection light by using color filters for RGB, and read the dispersed reflection light by using a CCD sensor, which is an imaging element, thereby obtaining RGB information. Further, the RGB information can also be obtained by reading reflection light from the RGB light sources with a CMOS sensor, which is an imaging device. In these cases, the same advantageous results can be obtained by reading the luminance value of an appropriate channel of the obtained RGB information as the above-described reflection density.

Further, in another mode, in a case where a test is conducted through visual observation, an ink having a color tone whose reflection density is low (lightness is high) under the white light is selected as the detection auxiliary coloring material ink to be firstly applied, and an ink having a color tone whose reflection density is high (lightness is low) under the white light is selected as the reference coloring material ink to be subsequently applied. This can increase the amount of change in reflection density (lightness) between a case where the clear ink and the reference coloring material ink overlap each other and a case where the clear ink and the reference coloring material ink do not overlap each other. A user observes the print position adjustment patterns printed in the above manner as shown in FIG. 16, selects the lowest-density patch from the nine patches as explained with reference to FIG. 30, and inputs, as an adjustment value, a shift amount corresponding to the selected patch. As an example of a specific combination of inks, the Y ink is used as the detection auxiliary coloring material ink, and the K ink is used as the reference coloring material ink.

<Variation of a Test Pattern>

Incidentally, in the present embodiment, as the detection auxiliary pattern, a pattern having the same shape is printed at the same position as the reference pattern. However, as long as the detection auxiliary pattern includes an entire printed portion of the reference pattern, it is possible to achieve the advantageous results of the present invention.

Figure 32:
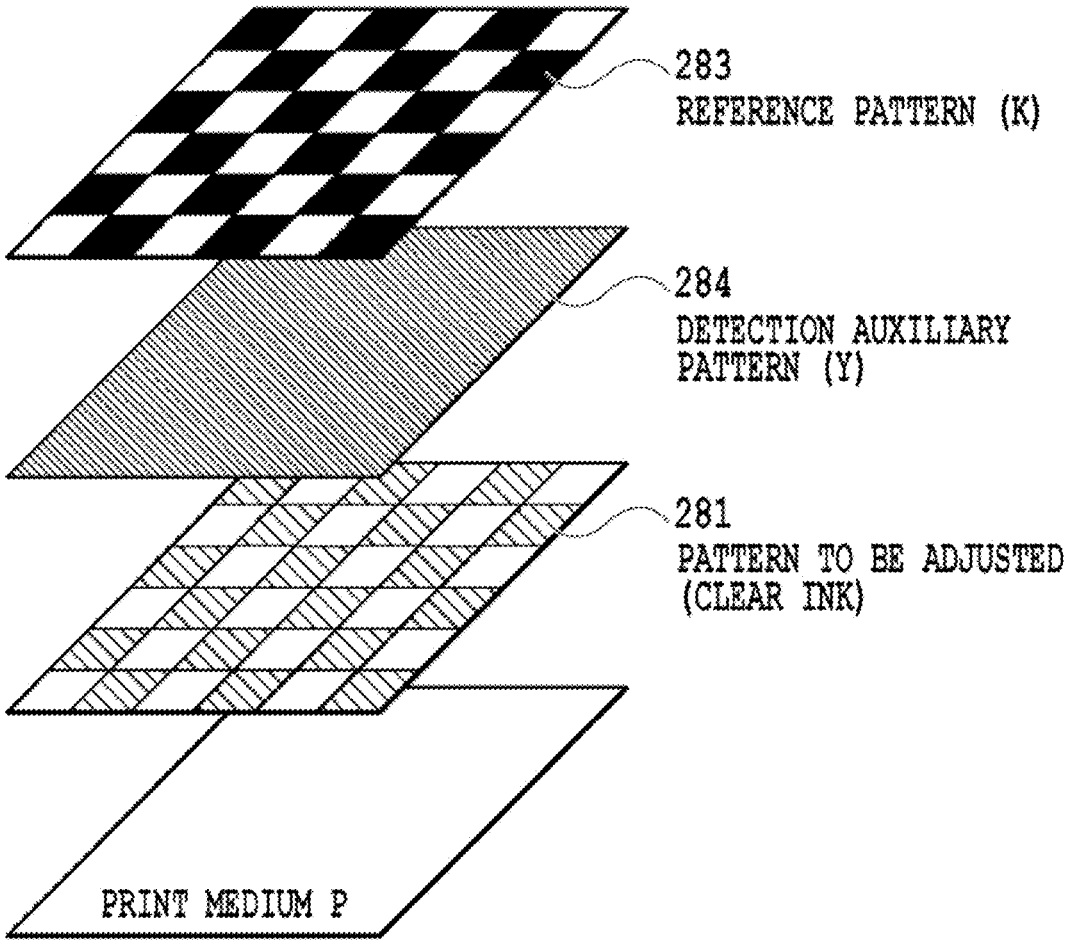
FIG. 32 is a view showing the printing order of printing a pattern for adjusting a print position shown in FIGS. 31A to 31H.

FIGS. 31A to 31H are schematic cross-sectional views showing a manner in which a detection auxiliary pattern 284 and the reference pattern 283 according to the present variation are printed, and are similar to FIGS. 28A to 28H. Further, FIG. 32 is a view showing the printing order of printing a pattern for adjusting a print position shown in FIGS. 31A to 31H. As disclosed in these drawings, the detection auxiliary pattern 284 is printed to include the entire reference pattern 283.

More specifically, since the reflection density of a portion printed with the Y ink is low under the R light source, even in a case where the Y ink exists in an area other than the K ink reference pattern 283, the effects of the entire print position adjustment pattern on the reflection density are small. Accordingly, as described above, in a case where for the light source color, an ink whose reflection density is low is selected as the detection auxiliary color no material ink, and an ink whose reflection density is high is selected as the reference coloring material ink, a difference between the detection values of states shown in FIGS. 31D and 31H becomes larger than the one in the case of using one ink as the reference ink as in the case explained with reference to FIGS. 28A to 28H. By using the detection auxiliary pattern 284, it becomes possible to improve the accuracy of adjustment of the print position of the clear ink even in a case where the print positions of the coloring material inks are not adjusted accurately. As a result, for example, it is possible to perform only adjustment of the print position of the clear ink as adjustment of the print position, and eliminate a step for feeding back the adjustment values of the print positions of the coloring material inks before adjustment of the print position of the clear ink, thereby reducing control load and required time. Further, the print position adjustment patterns for the coloring material inks and the print position adjustment pattern for the clear ink can be printed at one time by performing a series of operations, and it is also possible to reduce the number of print media to be used.

In the above-described embodiment, the print position is adjusted in the X direction (a conveying direction) and the Y direction (a nozzle array direction), but it is natural that the present invention is not limited to this embodiment. As necessary, the print position may be adjusted in either direction. Further, in the above-described embodiment, full multi-heads are used, and even in the case of a serial scan-type printing apparatus, it is natural that the present invention can be applied to, for example, adjustment of the print position of the carriage moving in a right direction and the print position of the carriage moving in a left direction.

Further, the pattern used for adjusting the print position of the clear ink may be a ruled line pattern used for adjustment of the print positions of the coloring material inks, for example, and is possible to appropriately change the pattern as long as the overlapping rate varies depending on the shift amount. Further, it is also possible to change the size of the pattern according to the adjustment range of the printing apparatus to be implemented.

Variation of the First Embodiment

<Selection of an Optimal Combination of Coloring Material Inks of Two Colors and Light Source>

In the above-described first embodiment, red is used as the light source color (the R light source), the Y ink is used as the color 1 ink, and the K ink is used as the color 2 ink to adjust the print position of the clear ink. An optimal combination for a test may vary depending on the characteristics (such as permeability and color development) of the print medium used for adjustment of the print position, the color tones (such as dark and pale) of the mounted coloring material inks, the color of the mounted light source, and the like.

Figure 33:
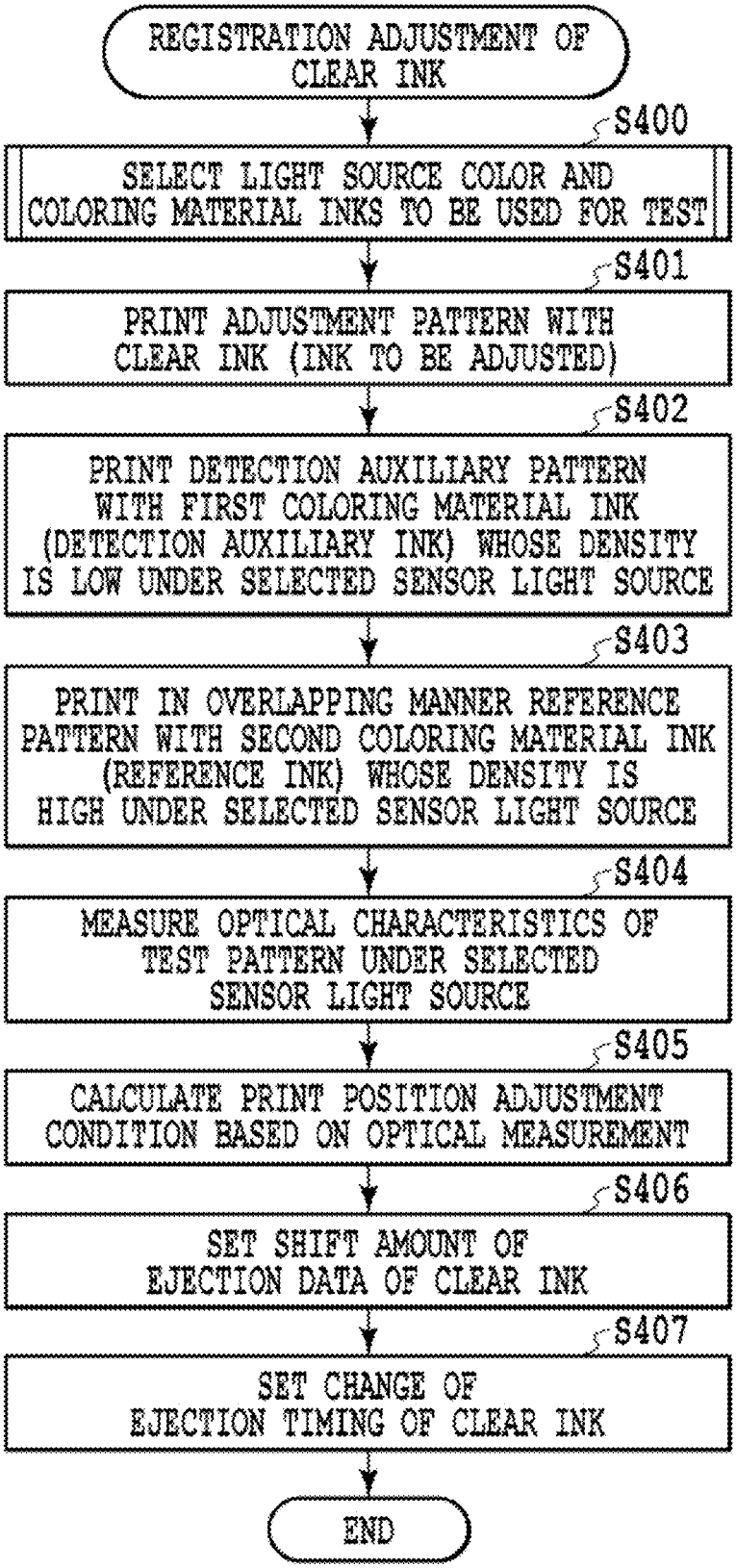
FIG. 33 is a flowchart showing processing for adjusting the print position of the clear ink according to the variation of the first embodiment of the present invention.

FIG. 33 is a flowchart showing processing for adjusting the print position of the clear ink according to variation of the first embodiment of the present invention. In adjustment of the print position of the clear ink according to the present embodiment, a combination of the coloring material inks of the two colors whose detectability is the highest and the light source color is selected prior to printing of the print position adjustment pattern (step 400). After this selection, processing in steps 401 to 407 is the same as the processing in steps 301 to 307 according to the above-described first embodiment, and their explanation will be omitted.

Figure 34:
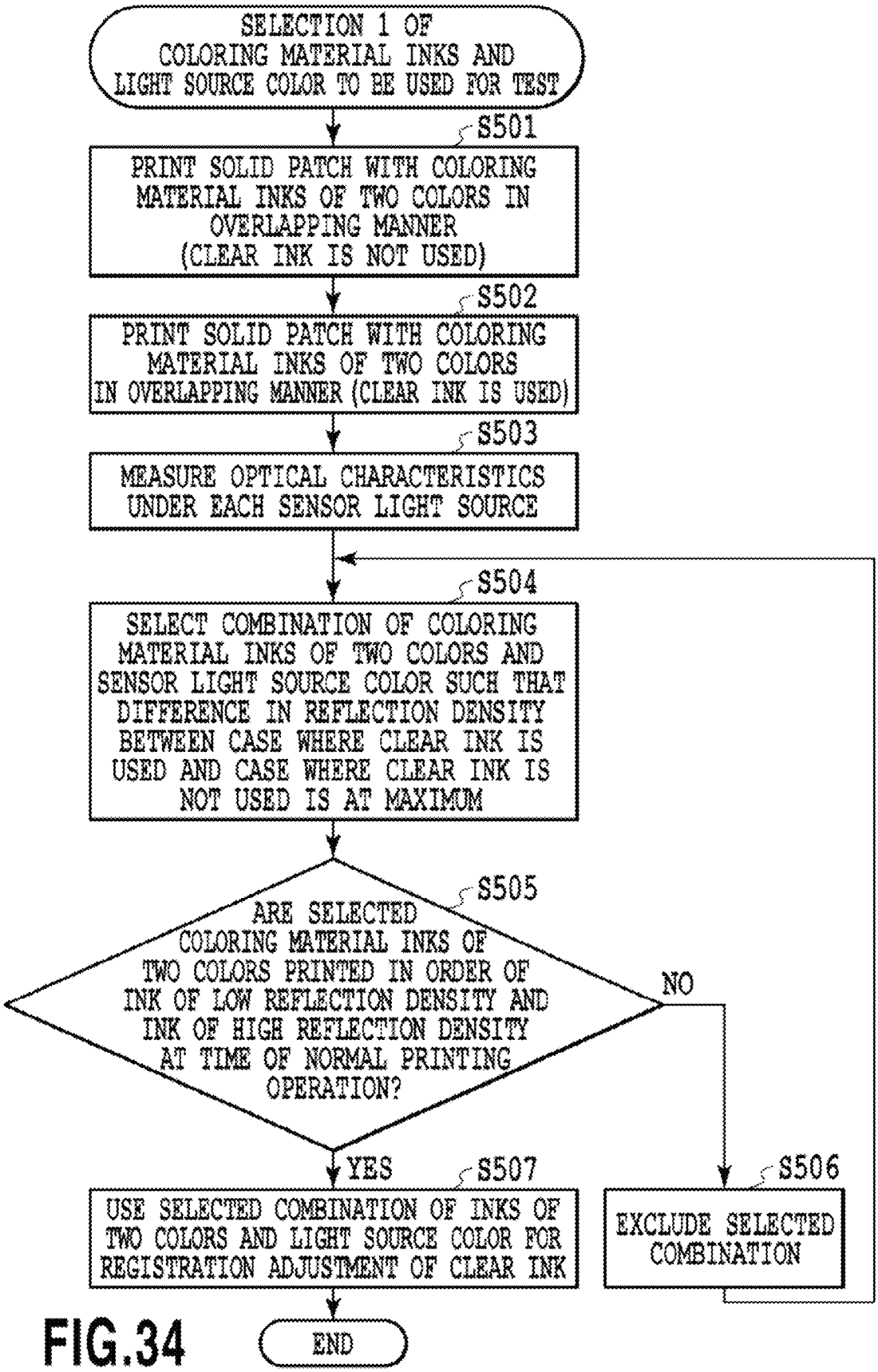
FIG. 34 is a flowchart showing processing for selecting an ink to be checked and a light source color in step 400 of FIG. 33.

FIG. 34 is a flowchart showing processing for selecting an ink to be checked and a light source color in step 400. First, in step 501, the two colors of the coloring material inks are selected, and these inks are printed in an overlapping manner to print the patch without using the clear ink. A dot arrangement pattern at this time is a so-called solid pattern in which one dot is arranged in one pixel of 1200 dpi for each color. In the present embodiment, the inks of four colors C, M, Y, and K are mounted as the coloring material inks, and solid patches in which color inks over each other are printed with all six presumable combinations (CM, CY, CK, MY, MK, and YK). Incidentally, in the present embodiment, full line type print heads are used, and the print medium is conveyed in one carrying direction. Accordingly, the above-described six combinations are all combinations of inks of two colors which can be realized in print operations including printing order. Next, in step 502, the same combinations of the coloring material inks in the above-described step 501 are further combined with the clear ink to print the same solid patches.

Next, in step 503, the optical characteristics of a total of 12 printed solid patches are measured with the colors (R, G, and B) of the mounted light sources. In step 504, there is selected a combination of the light source color and a combination of inks of two colors in which a difference in reflection density is at a maximum between a case where the clear ink exists and a case where the clear ink does not exist. In step 505, whether or not the coloring material ink whose reflection density is low and the coloring material ink whose reflection density is high are ejected in the order named is determined in a normal printing operation with the selected combination of the inks of the two colors. Regarding a reflection density, in a case where the coloring material inks are not ejected in the above-described order, the selected combination is excluded in step 506, and in step 504, a combination of the coloring material inks of the two colors and the light source color is selected again. In a case where in step 505, it is determined that the coloring material inks of the reflection densities are ejected in the above-described order, in step 507, the selected combination of the coloring material inks of the two colors and the light source color is set as a combination used for adjusting the print position of the clear ink.

As another mode, there is a mode of reducing the number of combinations of the coloring material inks to be selected. More specifically, in the print medium used for adjusting the print position of the clear ink, a larger difference in the reflection density of solid printing between the detection auxiliary coloring material ink and the reference coloring material ink tends to lead to a larger amount of change between a case where the clear ink exists and a case where the clear ink does not exist. By using this tendency, it is possible to select an optimal combination of the coloring material inks of the two colors and the light source color more easily. More specifically, in a case where two or more light sources such as the R, G, and B light sources and three or more coloring material inks such as the C, M, Y, and K inks are used, prior to adjustment of the print position of the clear ink, a single-color solid patch is printed with the coloring material ink, and a reflection density is measured under each color light source. Then, a combination of the light source and the coloring material inks of the two colors in which a difference in reflection density is at a maximum under condition of a same light source is selected for conducting a test on the clear ink.

Figure 35:
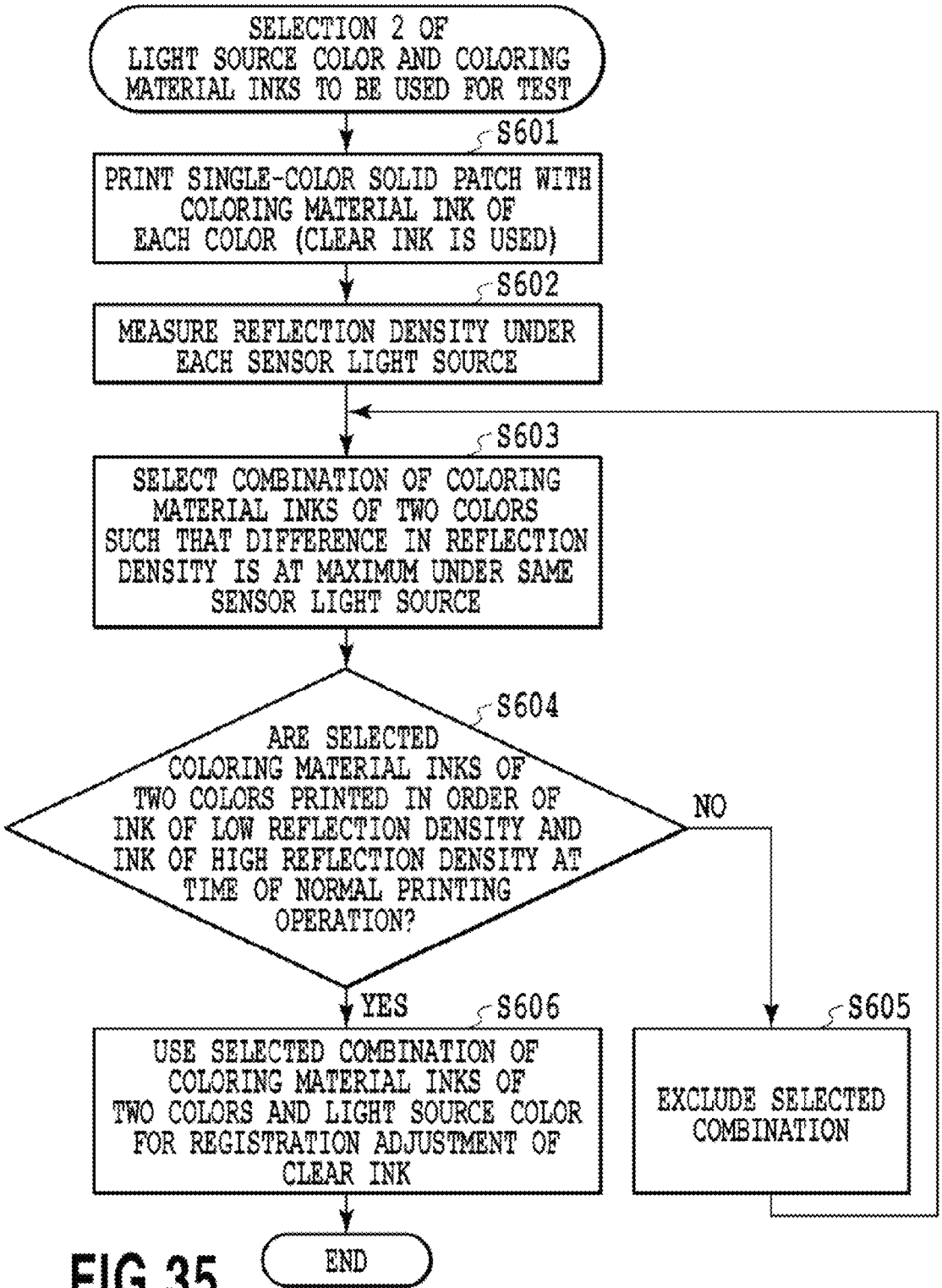
FIG. 35 is a flowchart showing processing for selecting an ink to be checked and a light source color according to a variation of the embodiment of the present invention.

FIG. 35 is a flowchart showing processing for selecting an ink to be checked and a light source color according to the present embodiment. Selection processing of the present embodiment is used, whereby the number of patches for solid printing for selecting a combination of the inks and the light source is four (C, M, Y, and K), and in a case where the number of mounted inks is large, it is possible to reduce the number of patches printed for selecting a combination of the inks and the light source.

Second Embodiment

A second embodiment of the present invention relates to a mode of printing a pattern for checking the ejection state of the clear ink as a check pattern with the clear ink and the coloring material inks in an overlapping manner, and increases the amount of change in density or color between an area in which the coloring material inks and the clear ink overlap each other and an area in which the coloring material inks and the clear ink do not overlap each other. In the following explanation of the second embodiment, the same reference numerals are allocated to the same elements in the above-described first embodiment, and their explanation will be omitted.

Figure 36:
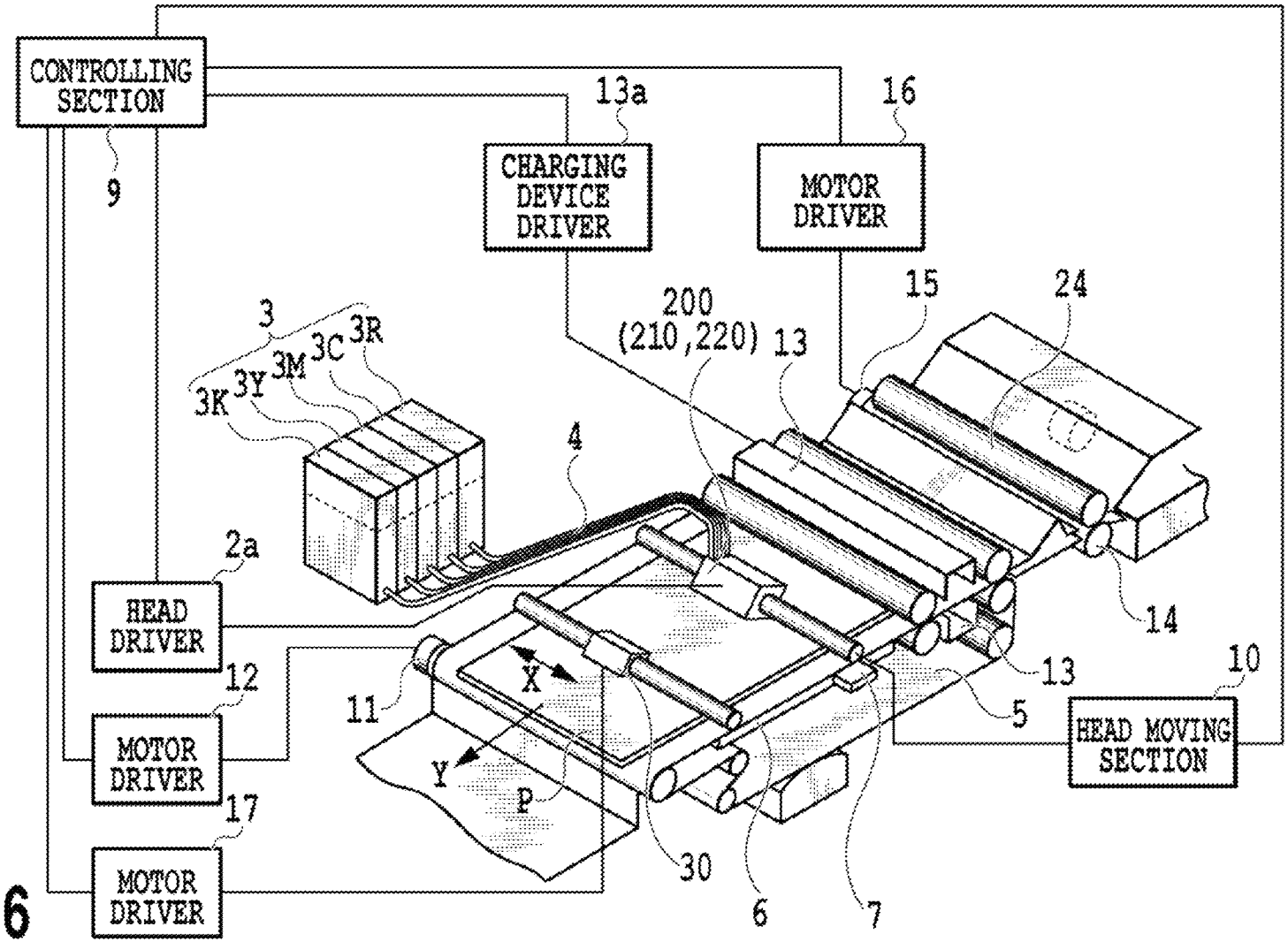
FIG. 36 is a schematic diagram showing the schematic configuration of an inkjet printing apparatus according to a second embodiment of the present invention.

FIG. 36 is a schematic diagram showing the schematic configuration of an inkjet printing apparatus according to the second embodiment of the present invention. The printing apparatus of the present embodiment is different from the printing apparatus of the first embodiment in that the print heads are so-called serial type print heads 200 for scanning and printing the print medium. The print heads 200 integrally include two print heads, that is, a print head 210 for ejecting the clear ink and a print head 220 for ejecting the coloring material inks, that is, the cyan (C), magenta (M), yellow (Y), and black (K) inks. In these print heads, a plurality of nozzles for each ink are arranged along the conveying direction of the print medium P (the sub-scan direction: the Y direction). Further, the print heads 200 include nozzles for ejecting the inks, a common liquid chamber to which the inks in the ink tanks 3 are supplied, and ink paths for leading the inks from the common liquid chamber to the nozzles. Each nozzle is provided with, for example, a heating resistor element (a heater) for generating bubbles in the ink, and a head driver drives the ejection heater, thereby ejecting the ink from the nozzle. The ejection heater of the nozzle is electrically connected to the controlling section 9 via the head driver 2*a*, and driving of the heater is controlled according to an on/off signal (an ejection/non-ejection signal) from the controlling section 9. The print heads 200 for the inks are connected to five ink tanks 3R, 3C, 3M, 3Y, and 3K (hereinafter collectively referred to as the ink tanks 3) for storing the clear ink, the cyan ink (the C ink), the magenta ink (the M ink), the yellow ink (the Y ink), and the black ink (the K ink), respectively via the connection pipe 4 such as a tube. Further, the ink tanks 3 can be individually attached or detached.

The print heads 2 can move in the X direction and its opposite direction in an area to be printed to face the platen 6 across the conveying belt 5, whereby the print heads 2 can scan the print medium. The head moving section 10 moves the print heads 2 to perform scanning. The controlling section 9 controls the operation of the head moving section 10.

The reflective optical sensor 30, which has been described above regarding the first embodiment with reference to FIG. 4, is provided downstream of the print heads 2 in the conveying direction of the print medium. The carriage for the reflective optical sensor 30 enables the reflective optical sensor 30 to move in the Y direction, and the operation of the reflective optical sensor 30 is controlled via the motor driver 17.

The conveying belt 5 is laid around a driving roller coupled to the belt driving motor 11, and the print medium P is conveyed by rotating and driving the driving roller. The operation of the conveying belt 5 is controlled via the motor driver 12. The charging device 13 is provided upstream of the conveying belt 5. The charging device 13 charges the conveying belt 3, thereby bringing the print medium P into close contact with the conveying belt 5. The charging device 13 is turned on/off via the charging device driver 13*a*. The pair of feed rollers 14 supplies the print medium P onto the conveying belt 5. The feed motor 15 drives and rotates the pair of feed rollers 14. The operation of the feed motor 15 is controlled via the motor driver 16.

Incidentally, the configuration of the printing apparatus for carrying out the present invention as shown in FIG. 36 is just an example, and the present invention is not necessarily limited to this configuration. For example, the present invention only has to have the configuration in which the print heads and the print medium move relatively, and the configuration of the present invention is not particularly limited. For example, it is clear from the following explanation as well that the present invention can also be applied to a so-called full line type printing apparatus in which nozzles are arranged over the width of the print medium to be conveyed. In an example of the full line type printing apparatus, an array of arranged nozzles is fixed to the apparatus during the printing operation, and printing is performed on the print medium which is moved in a direction crossing the arrangement direction of the nozzles.

Figure 37:
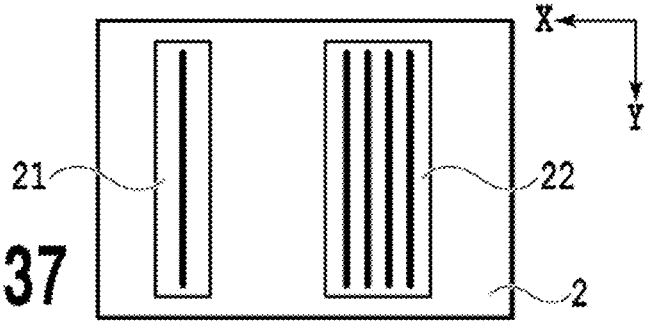
FIG. 37 is a view showing the arrangement of nozzle arrays for inks of print heads shown in FIG. 36.
Figures 38A, 38B:
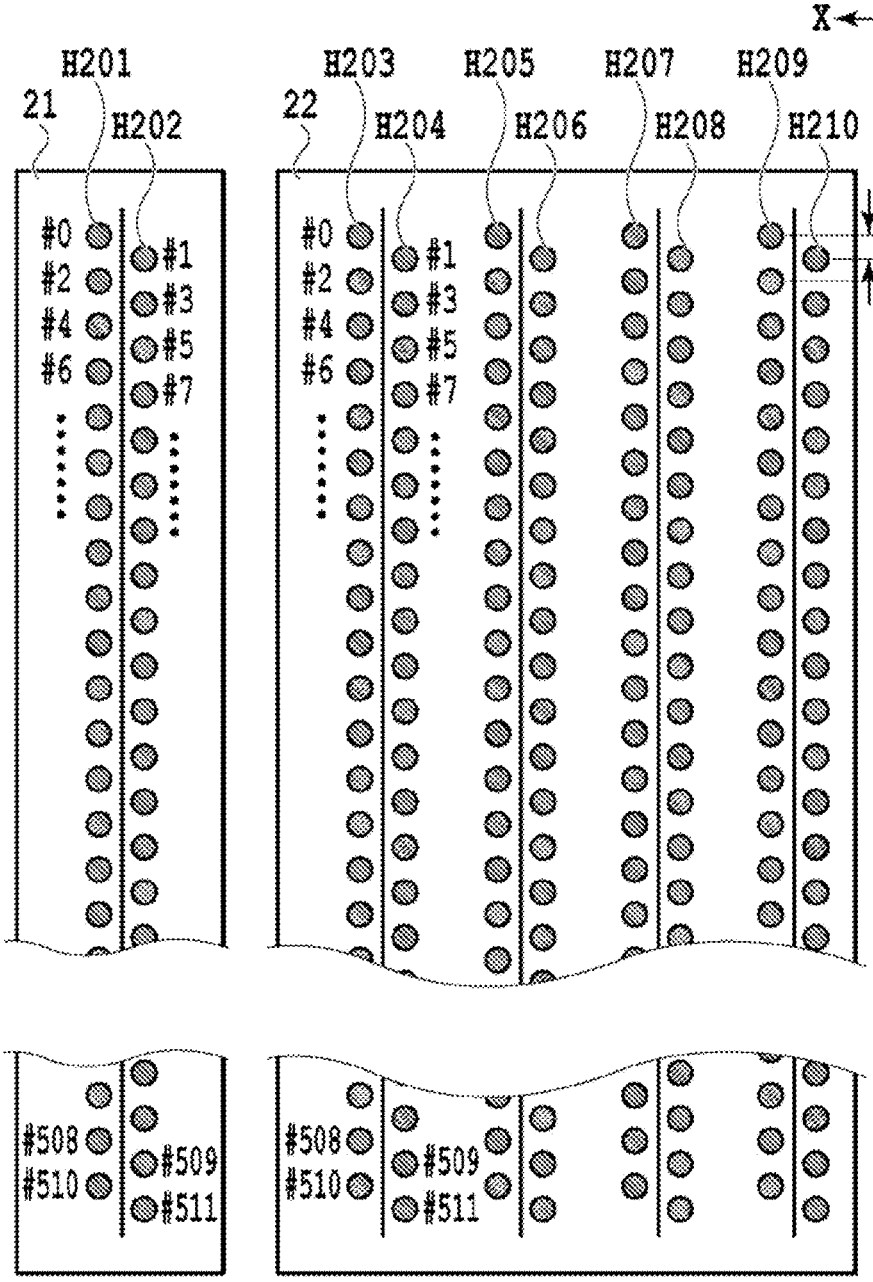
FIGS. 38A and 38B are views for explaining, in particular, the nozzle arrangement of print heads 21 and 22 shown in FIG. 37, respectively.

FIG. 37 is a view showing the arrangement of nozzle arrays for the inks of the print heads 200 shown in FIG. 36. As FIGS. 38A and 38B show the details of the print head 210, the print head 210 for the clear ink has two nozzle arrays. The print head 220 for the coloring material inks similarly has two nozzle arrays for each of the C, M, Y, and K inks.

FIGS. 38A and 38B are views for explaining, in particular, the nozzle arrangement of the print heads 210 and 220 shown in FIG. 37, respectively. As shown in FIG. 38A, the nozzle arrays of the print head 210 are formed by the two nozzle arrays H201 and H202. In the nozzle array H201, the 256 nozzles #0, #2, . . . , #510 are arranged, and in the nozzle array H202, the 256 nozzles #1, #3, . . . , #511 are arranged. In the nozzle arrays H201 and H202, the nozzles are arranged at a density of 600 dpi, and the nozzle arrays deviate from each other by half a pitch. An array of 512 nozzles is arranged at an arrangement density of 1200 dpi. The same can be said for the nozzle arrays H203 and H204 for the C ink, the nozzle arrays H205 and H206 for the M ink, the nozzle arrays H207 and H208 for the Y ink, and the nozzle arrays H209 and H210 for the K ink in the print head 220 for the coloring material inks, and an array of 512 nozzles is arranged at an arrangement density of 1200 dpi.

Figure 39:
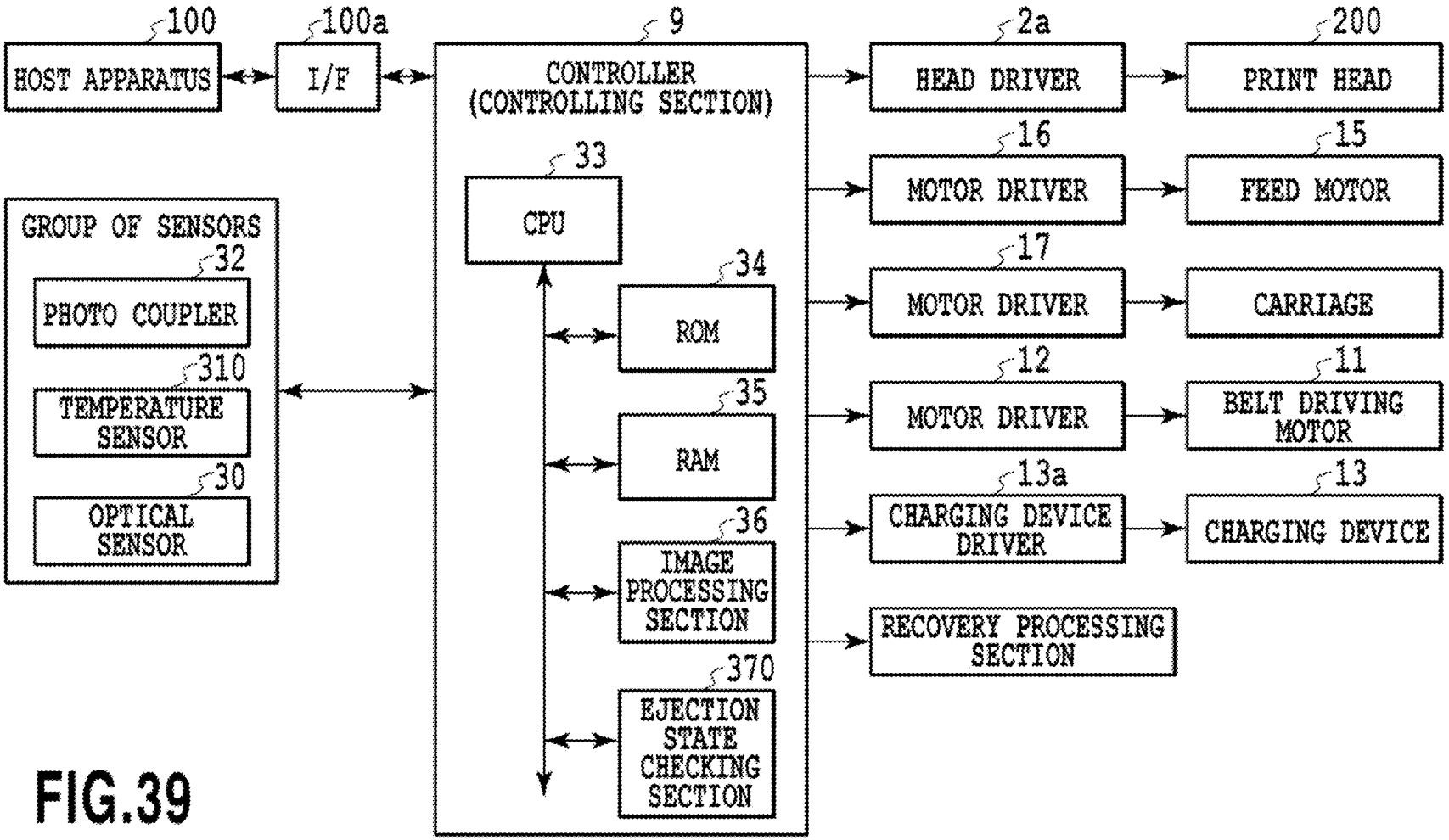
FIG. 39 is a block diagram showing the control configuration of the inkjet printing apparatus of the second embodiment.

FIG. 39 is a block diagram showing the control configuration of the inkjet printing apparatus of the present embodiment. FIG. 39 mainly shows the detailed configuration of the controlling section 9 shown in FIG. 36. The configuration shown in FIG. 39 is different from the configuration of the first embodiment shown in FIG. 5 in that the second embodiment includes an ejection state checking section 370, and the second embodiment performs a check of the ejection state, which will be described later with reference to FIG. 44 and the like.

The motor driver 12 is a driver for controlling driving of the belt driving motor 11 for driving the conveying belt 5, and is used to convey the print medium P in the X direction. The motor driver 17 is a driver for controlling driving of the carriage for the reflective optical sensor 30. The charging device driver 13*a* charges the conveying belt 5, and is used to bring the print medium P into close contact with the conveying belt 5.

<Coloring Material Inks and Clear Ink>

The clear ink used in the present embodiment is the same as the clear ink used in the first embodiment.

<Sensor Light Source and Reflection Density>

In a check of an ejection state test pattern for the clear ink, the reflective optical sensor 30 of the present embodiment selects and uses, as the light emitting section 31, any of three types of red (the R light source), green (the G light source), and blue (the B light source) light emitting diodes (LEDs) according to the color tones of the clear ink and the coloring material inks used by the printing apparatus of the present embodiment, the configuration of the print head, and the like.

The print medium used in the present embodiment has a high reflectance over an entire visible wavelength region and thus has a low absorbing ratio as shown in FIG. 18B or 18C regarding the first embodiment. As a result, regarding the optical characteristics of reflection light from the R light source shown in FIG. 18D, the intensity of light decreases slightly due to absorption of light by the print medium, but the optical characteristics do not differ much from those of the R light source itself shown in FIG. 18A. The shaded portion in FIG. 18D contributes to the measurement output of an element for measuring the intensity of light in the visible wavelength region. Actually, the shaded portion in FIG. 18D affects the sensitivity characteristics of the measurement element, but for simple explanation, the area of the shaded portion directly corresponds to the measurement results (reflection density) of the optical sensor. In a case where the area of the shaded portion is large, the reflection density is low, and in a case where the area of the shaded portion is small, the reflection density is high.

In the second embodiment of the present invention, inks of two different color tones are used to print a test pattern for checking the ejection state of the clear ink.

In a case where the two types of inks and the clear ink are used, the coloring materials in the two types of color inks are fixed to a position closer to the surface layer of the print medium as compared with the case of not using the clear ink as described above with reference to FIGS. 24A to 24D and 25A to 25F regarding the first embodiment. As a result, the density of a portion (a printed portion) in which dots are printed improves, and the color 2 fixed to the upper layer portion becomes dominant as the color tone of the printed portion.

Figure 40A:
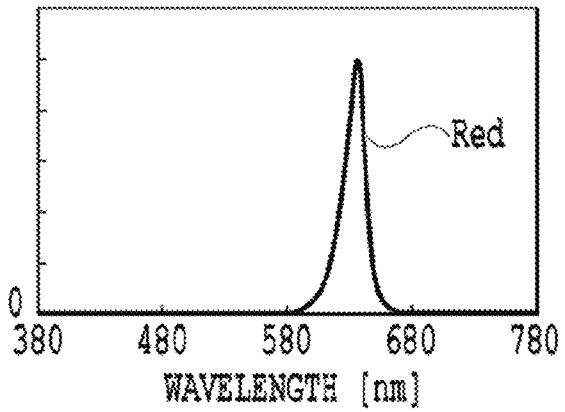
FIGS. 40A to 40D are graphs for explaining a difference in optical characteristics between a case where the clear ink is used and a case where the clear ink is not used.

FIGS. 40A to 40D are graphs for explaining a difference in optical characteristics between a case where the clear ink is used and a case where the clear ink is not used as described above with reference to FIGS. 24A to 24D and 25A to 25F, and show a case where the yellow (Y) ink is used as the color 1 ink and the black (K) ink is used as the color 2 ink. FIG. 40A shows the wavelength characteristics of light emitting diodes of the R, G, and B light sources of the light emitting section 31.

Figure 40B:
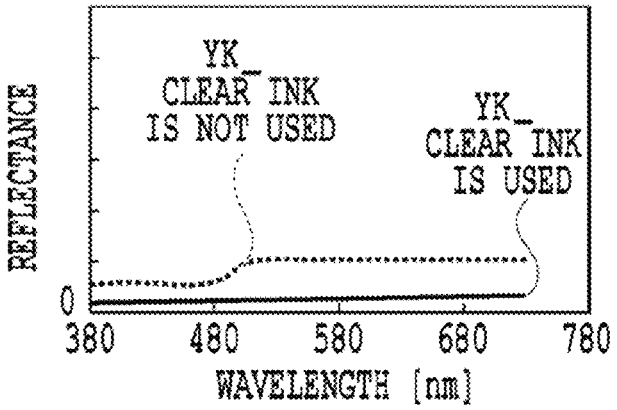

FIG. 40B shows the wavelength characteristics (reflectivities) of an area in which dots are formed in a case where the Y ink and the K ink are applied to the print medium in an overlapping manner in the order named (a dashed line) and a case where the clear ink, the Y ink, and the K ink are applied to the print medium in an overlapping manner in the order named (a solid line). Incidentally, the dashed line and the solid line in the drawings mean the same in FIGS. 40C and 40D as well.

Figure 40C:
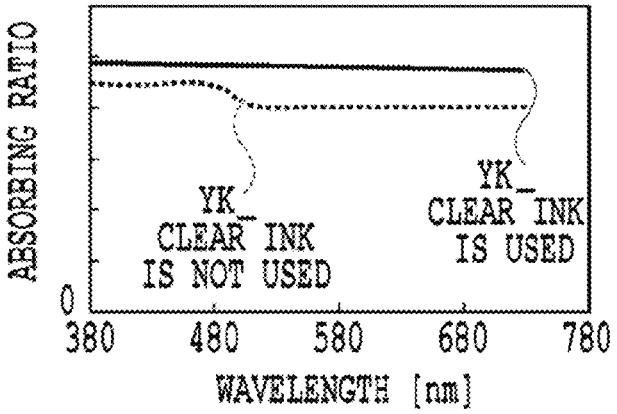

As shown in FIG. 40B, in a case where the clear ink is used (the solid line), a reflectance is low (a reflection density is high) over the entire wavelength range. Further, upon comparison of a case where the clear ink does not exist (the dashed line) with a case where the clear ink exists (the solid line), it is found that in a case where the clear ink does not exist (the dashed line), the shape of a curved line indicative of a reflectance changes over a predetermined wavelength range. This is because a fixed position relationship between the color 1 ink and the color 2 ink changes according to the presence or absence of the clear ink, whereby the color tone changes as described above with reference to FIGS. 24A to 24D and 25A to 25F. More specifically, in a case where the clear ink exists, the subsequently landing K ink is fixed to the upper layer and forms the main color tone, and accordingly, a reflectance is low over the entire wavelength range, and the shape of the curved line is substantially flat. On the other hand, in a case where the clear ink does not exist, the firstly landing Y ink is fixed to the upper layer and forms a main color tone. Accordingly, a reflectance is relatively low over the range of a wavelength of about 500 nm or less, whereas a reflectance is relatively high over a range close to the peak wavelength of the R light source (620 nm). FIG. 40C shows the wavelength characteristics (absorbing ratio) of the dot forming portion of the print medium. This absorbing ratio is obtained by subtracting the above-described reflectance from 100%.

Figure 40D:
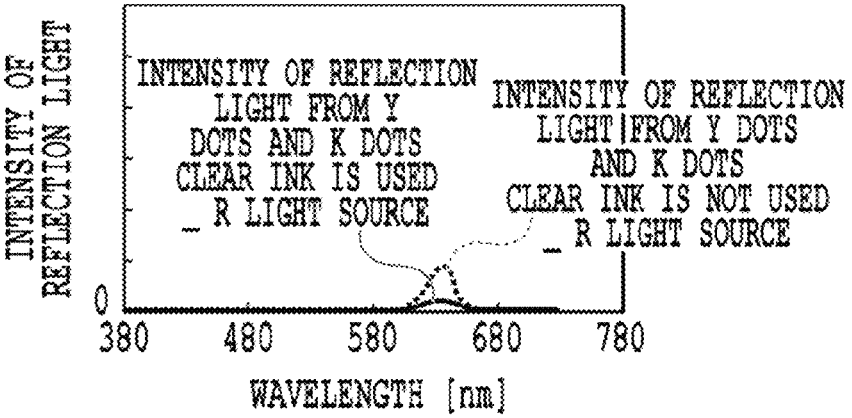

FIG. 40D shows the wavelength characteristics of reflection light reflected from the dot forming portion of the print medium under the K light source. In a case where the clear ink exists (a solid line), black is a main color tone, and accordingly, under the R light source, in a range close to the peak wavelength as compared with a case where the clear ink does not exist (a dashed line), the intensity of reflection light is low, and a reflection density is high. On the other hand, in a case where the clear ink does not exist (a dashed line), yellow is a main color tone, and accordingly, the intensity of reflection light is higher (a reflection density is lower). In this respect, a difference in reflection density between a case where the clear ink exists and a case where the clear ink does not exist can be increased by selecting the R light source in which in a case where the clear ink does not exist, the reflection density of the dot forming portion becomes relatively low.

Incidentally, in the above example, explanation has been made on a case where the Y ink and the K ink are printed in this order, but it is possible to achieve similar advantageous results by appropriately combining the color tones of the coloring material inks, printing order, and a light source color. More specifically, for a certain light source color, a color tone whose reflection density is low is selected as the firstly landing color 1 ink and a color tone whose reflection density is high is selected as the subsequently landing color 2 ink. This makes it possible to increase the amount of change in reflection density as compared with the case of using one type of coloring material ink (a single color) and to improve the detectability of a difference between a case where the clear ink exists and a case where the clear ink does not exist.

More specifically, the above-described example of using the Y ink and the K ink exhibits the wavelength characteristics of the absorbing ratio of the dot forming portion of the print medium as shown in FIG. 40C. In this case, similar advantageous results can be achieved also in a case where the green (G) light source whose peak wavelength is about 550 nm is used, for example. Further, in a case where the blue (B) light source whose peak wavelength is about 470 nm is used, a reflection density is measured in an area where a difference in characteristics between reflection light beams is small, and it is impossible to increase a difference in density or color between a case where the clear ink exists and a case where the clear ink does not exist.

<Check of the Ejection State of the Clear Ink>

Figure 41:
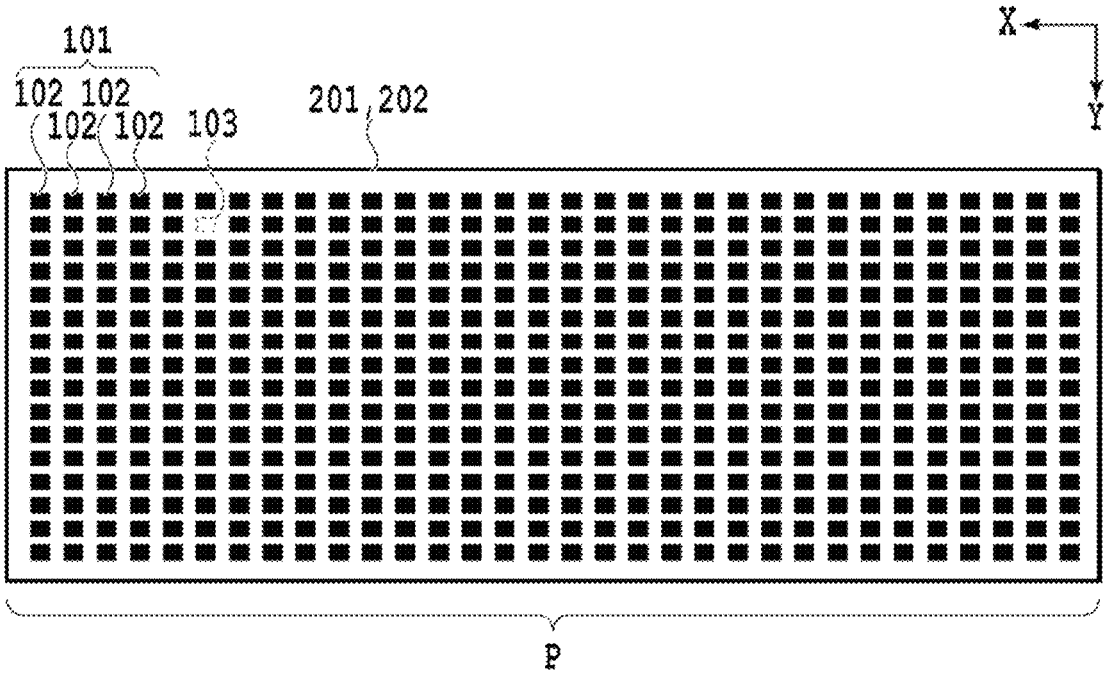
FIG. 41 is a view showing an ejection test pattern used for checking ejection of the clear ink according to the second embodiment of the present invention.

FIG. 41 is a view showing an ejection test pattern used for checking ejection of the clear ink according to the second embodiment of the present invention. An ejection test pattern P is formed by an ejection determining pattern 101 of the clear ink, a detection auxiliary pattern 201 of the coloring material ink 1, and a detection auxiliary pattern 202 of the coloring material ink 2. In the present embodiment, the Y ink is used as the coloring material ink 1, and the K ink is used as the coloring material ink 2.

As shown in FIG. 41, the ejection test pattern P is formed in a rectangular area of the print medium having predetermined sizes, and the detection auxiliary pattern 201 of the coloring material ink 1 and the detection auxiliary pattern 202 of the coloring material ink 2 are printed in an overlapping manner in the entire rectangular area. The ejection determining pattern 101 of the clear ink is not printed on the entire rectangular area, but printed so that rectangular black blocks (patches) 102 in the drawing are arranged in 16 columns×32 rows.

Figure 42:
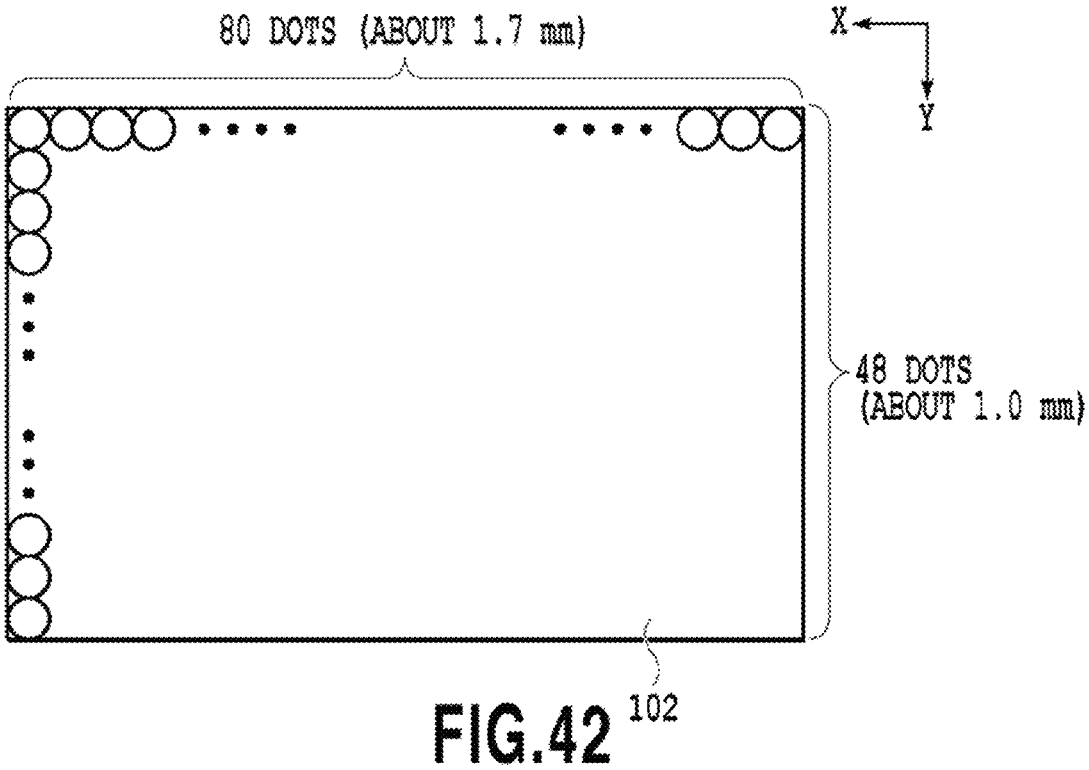
FIG. 42 is a view showing the arrangement of dots of a patch constituting the ejection test pattern shown in FIG. 41.

The block-shaped patches 102 are formed to correspond to the individual nozzles for ejecting the clear ink. More specifically, the print head 21 for ejecting the clear ink is scanned in the X direction, and the clear ink is ejected from the 16 nozzles #0, #32, . . . #448, and #460 out of a nozzle array arranged in the Y direction to print the 16 patches 102 arranged in the vertical direction on the far left side shown in FIG. 41. In this printing, 80 dots are printed in the X direction during scanning of the print head as shown in FIG. 42. Next, the print medium is conveyed by one dot in the Y direction. Then, while the print head is scanned, an array of 80 dots is printed adjacent to the printed array of 80 dots in a similar manner. The patch 102 having 80 dots in a row and 48 dots in a column can be printed by repeating scanning and conveying in a similar manner. 80 dots are printed at intervals corresponding to 1200 dpi in the X direction, and 48 dots are printed at intervals corresponding to 1200 dpi in the Y direction. Further, one patch 102 is a rectangle having an X-direction length of about 1.7 mm and a Y-direction length of 1.0 mm.

With reference to FIG. 41 again, after 16 patches 102 in the Y direction are printed, the print medium is conveyed in a direction opposite to the Y direction to return to a reference position, and an operation similar to the above-described one is performed to print patches 102 by using the 16 nozzles #1, #33, . . . #449, and #461. By performing the above printing, it is possible to print the patches 102 arranged in 16 columns×32 rows as shown in FIG. 41.

Figure 43:
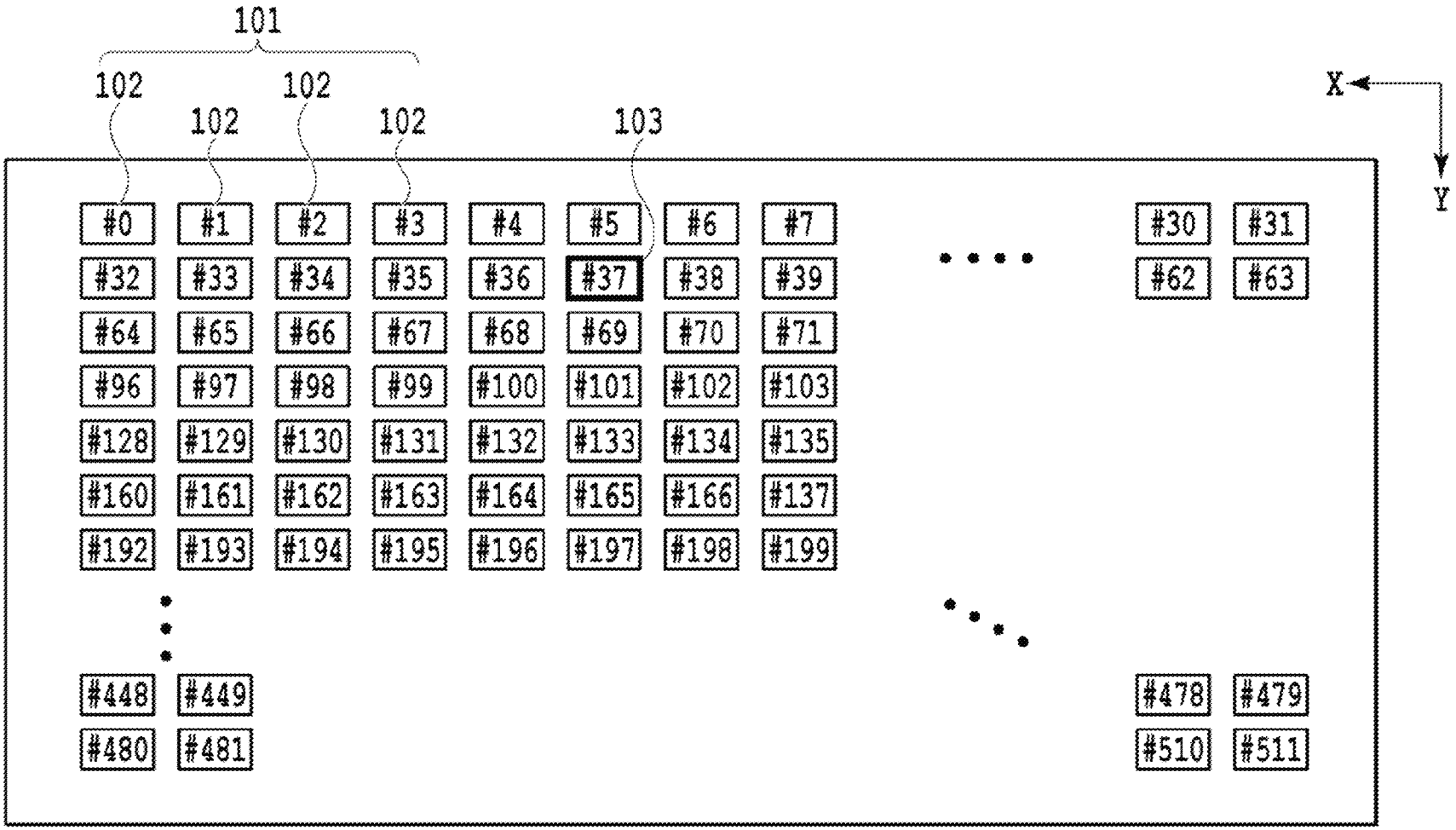
FIG. 43 is a view showing correspondence between patches and nozzles in a pattern for determining ejection of the clear ink according to the second embodiment of the present invention.

FIG. 43 is a view showing correspondence between the patches 102 and the nozzles in an ejection determining pattern 101 of the clear ink according to the present embodiment. In FIG. 41, a block 103 shows that the reflection density of the patch 102 printed by failing to eject the clear ink is lower than that of another patch 102 printed by ejecting the clear ink satisfactorily. As described above, regarding a relationship between coloring material inks of two colors, the density of a patch varies depending on whether or not the clear ink exists. FIG. 43 shows that a nozzle for printing the block 103 with the clear ink is the nozzle #37.

Incidentally, an area such as the block 103 whose reflection density is lower than that of another patch is not limited to an area formed by completely failing to eject the clear ink from the nozzles. For example, even in a case where the ejection amount of the clear ink is smaller than a specified amount or in a case where an ejection direction deflects from normal direction and the clear ink does not land on a specified position, the reflection density may be low. Even in this case, in a case where a difference in the density of the patch between a case where the clear ink exists and a case where the clear ink does not exist can be detected by an optical sensor, it is possible to detect such an ejection failure.

The detection auxiliary pattern 201 of the Y ink and the detection auxiliary pattern 202 of the K ink are printed in an overlapping manner on the ejection determining pattern 101 of the clear ink described above. More specifically, these detection auxiliary patterns 201 and 202 are patterns printed in the entire rectangular area shown in FIG. 41. More specifically, the detection auxiliary patterns 201 and 202 are printed so that dots are arranged at 1200 dpi in the X and Y directions. In this manner, these patterns cover the entire ejection determining pattern 101 of the clear ink.

Figure 44:
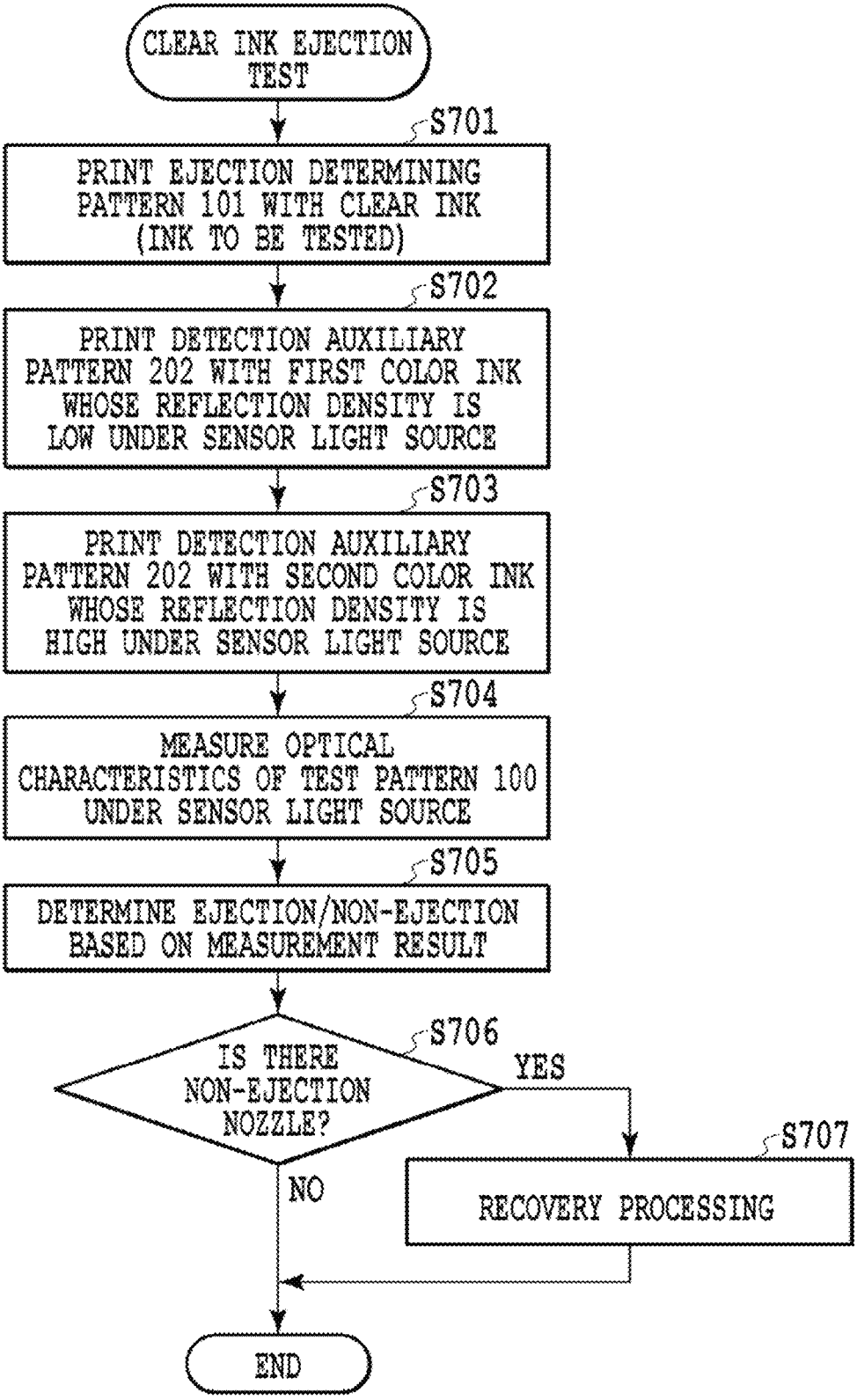
FIG. 44 is a flowchart showing processing for checking the ejection state of the clear ink according to the second embodiment of the present invention.

FIG. 44 is a flowchart showing processing for checking the ejection state of the clear ink according to the second embodiment. First, in step 701, the ejection determining pattern 101 is printed with the clear ink as described above with reference to FIG. 41 and the like. Next, as describe above with reference to FIG. 41 and the like, the detection auxiliary pattern 201 is printed with the Y ink in step 702 and then the detection auxiliary pattern 202 is printed in an overlapping manner with the K ink in step 703. Under the red (R) light source to be used, the reflection density of the firstly printed Y ink is lower than that of the subsequently printed K ink.

Next, in step 704, the reflective optical sensor 30 measures the optical characteristics of the ejection determining pattern 101 of the clear ink. More specifically, the reflective optical sensor 30 measures the reflection density of each patch 102 in the ejection determining pattern 101 of the clear ink. Then, in step 705, whether or not the clear ink is ejected is determined by comparing the reflection density of the measured patch 102 with the reflection density of an area printed without the clear ink pattern and only with the detection auxiliary patterns 201 and 202. In step 706, whether or not a non-ejection nozzle exists is determined based on the determination in step 705, and in a case where a non-ejection nozzle does not exist, the above processing ends. In a case where a non-ejection nozzle exists, a recovery operation is performed in step 707.

As described above, according to the present embodiment, a test pattern is printed by printing, on the clear ink, the Y ink whose reflection density is low under the R light source and the K ink whose reflection density is high under the R light source in an overlapping manner in this order, and the printed test pattern is measured under the R light source. This makes it possible to increase a difference in reflection density between a case where the clear ink exists and a case where the clear ink does not exist. As a result, the difference can be detected easily.

In the present embodiment, the red (R) light source is used as the sensor light source, the Y ink is used as the coloring material ink 1 to be firstly ejected, and the K ink is used as the coloring material ink 2 to be subsequently ejected. However, the advantageous results of the present invention can be achieved in any other combination as long as the above-described relationship between the sensor light source color and the reflection density is satisfied. For example, in the case of the R light source, the Y ink or the M ink is preferable as the coloring material ink 1, and the K ink or the C ink is preferable as the coloring material ink 2. In the case of the G light source, the C ink or the Y ink is preferable as the coloring material ink 1, and the K ink or the M ink is preferable as the coloring material ink 2. In the case of the B light source, the M ink or the C ink is preferable as the coloring material ink 1, and the K ink or the Y ink is preferable as the coloring material ink 2. However, the colors of the coloring material inks used in the inkjet printing apparatus such as C, M, Y, and K are not ideal colors, and a limitation on dot overlapping order varies depending on the color development of the print medium to be used and the configuration of the printing apparatus. Accordingly, it is desirable to previously set and use an optimal combination for a standard print medium.

<Regarding Detection of Optical Characteristics>

In the present embodiment, the reflective optical sensor for emitting limit from the color (R, G, or B) light source having a predetermined peak wavelength and measuring the intensity (reflection density) of its reflection light is used to detect optical characteristics. However, it is natural that it is possible to use another configuration as long as the other configuration detects optical characteristics over a specific wavelength range. For example, it is also possible to use, for example, a CCD scanner which emits white light from the white light source, disperses its amplified reflection light by using color filters for RGB, and reads the dispersed reflection light by using a CCD sensor, which is an imaging element, thereby obtaining RGB information. Further, it is also possible to use a CIS scanner or the like which obtains the RGB information by reading reflection light from the RGB light sources with the CMOS sensor, which is the imaging device. In these cases, the same advantageous results can be obtained by reading the luminance value of an appropriate channel of the obtained RGB information as the above-described reflection density.

Further, in another mode, in a case where a test is conducted through visual observation, an ink having a color tone whose reflection density is low (lightness is high) under the white light is selected as the detection auxiliary coloring material ink to be firstly ejected, and an ink having a color tone whose reflection density is high (lightness is low) under the white light is selected as the detection auxiliary coloring material ink to be subsequently ejected. This can increase the amount of change in reflection density (lightness) between a case where the clear ink exists and a case where the clear ink does not exist. As a specific combination, it is preferable to use the Y ink as the detection auxiliary ink to be firstly ejected, and to use the K ink as the detection auxiliary ink to be subsequently ejected.

Variation of Second Embodiment

A variation of the second embodiment relates to driving condition setting processing for setting appropriate driving energy (electric energy) for an ejection heater for each nozzle in the print head.

As a printing mode of the inkjet printing apparatus other than a normal printing mode, the present embodiment prints a test pattern to be used for driving condition setting processing (hereinafter also referred to as the Pth test) for setting the pulse width of a voltage pulse to be supplied to the ejection heater. The printing mode can be set in an interface provided in the inkjet printing apparatus itself or a host apparatus connected to the inkjet printing apparatus.

In the Pth test, a patch for measuring driving energy is printed on the print medium while reducing stepwise the driving energy (a pulse width in the present embodiment) to be supplied to the print head, and based on the density of the patch, driving energy which fails to eject the ink is set as a threshold. A value obtained by multiplying the set threshold by a predetermined coefficient (k) is set as driving energy used for a subsequent printing operation. The variation of the second embodiment relates to printing of a test pattern used for a Pth test for driving energy for ejecting the clear ink.

Figure 45:
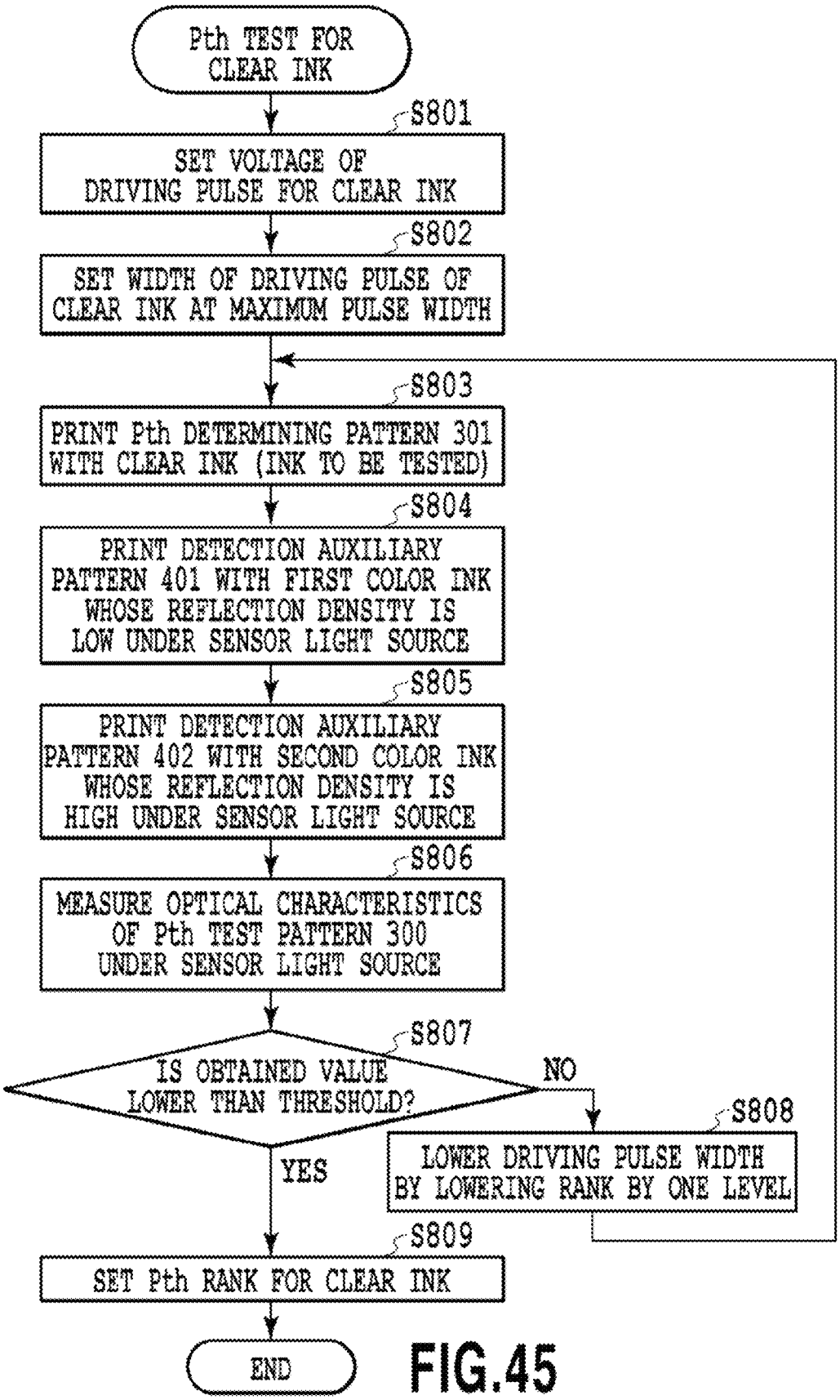
FIG. 45 is a flowchart showing a Pth test process for the clear ink according to a variation of the second embodiment of the present invention.

FIG. 45 is a flowchart showing a Pth test process for the clear ink according to the present embodiment. In a case where the Pth test is started, the voltage (hereinafter also referred to as the driving voltage) of the diving pulse of the ejection heater at the time of printing the test pattern of the clear ink is set in step 801. This driving voltage is a threshold voltage Vth obtained by dividing the currently set driving voltage VH of the driving pulse used for a normal printing operation by the above value k (for example, 2>k>1). The value k can be set at 1.15, but is not limited to this numerical value. Next, in step 802, the pulse width of the driving pulse to be supplied to the ejection heater for each nozzle for the clear ink is set at a maximum pulse width. In general, variations in the surface properties and the like of the ejection heater of the print head may arise at the time of manufacturing. Because of the above variations, variations also arise in a minimum driving pulse width (hereinafter the driving pulse width will also be referred to as the threshold driving pulse width Pth) which is necessary for ejecting the clear ink. In this step, in variations in the threshold driving pulse width ranging from a minimum to a maximum, the maximum is set as the initial value of the pulse width of the driving pulse to be applied to the ejection heater.

A memory (ROM) of the printing apparatus of the present embodiment stores a table in which the range of the variations in the threshold driving pulse width Pth from the minimum to the maximum is divided in units of a certain width to obtain a plurality of pulse widths, and values called head ranks are assigned to the pulse widths. FIG. 46 shows an example of the table. In the example shown in FIG. 46, a plurality of threshold driving pulse widths (0.59 μsec to 1.21 μsec) are set in units of 0.01 μsec, and the head ranks (1 to 63) are assigned to the threshold driving pulse widths. The inkjet printing apparatus of the present embodiment can set the pulse width of the driving pulse to be supplied to the ejection heater of the print head according to a head rank. Accordingly, in step 802, a threshold driving pulse width Pth (1.21 μsec) corresponding to a maximum head rank (63) among the head ranks is set as an initial value.

Further, in general, in a process for manufacturing the print head, a driving pulse width suitable for each manufactured print head is measured. The head rank of the print head is set with reference to a table similar to the above-described one based on the threshold driving pulse width obtained by the above measurement. The head rank is stored in the memory of the print head, and the print head is shipped. A printer having the print head thereon can read the head rank from the memory of the print head, and recognize the threshold driving pulse width Pth based on the heat rank. However, there is a case where there is an error in the appropriate driving energy because of an environment in which the printer is actually used such as variations in power supply voltage. In this respect, the Pth test of the present embodiment is effective, and in processing in stop 803 onward, which will be described below, the threshold driving pulse width Pth is newly set according to the printing apparatus or its use environment.

With reference to FIG. 45 again, in step 803, a driving pulse having the driving threshold voltage set in step 801 and the initial value of the driving pulse width set in step 802 is supplied to the heater corresponding to the nozzle in the print head for the clear ink, and the test pattern is printed on the print medium.

Figure 47:
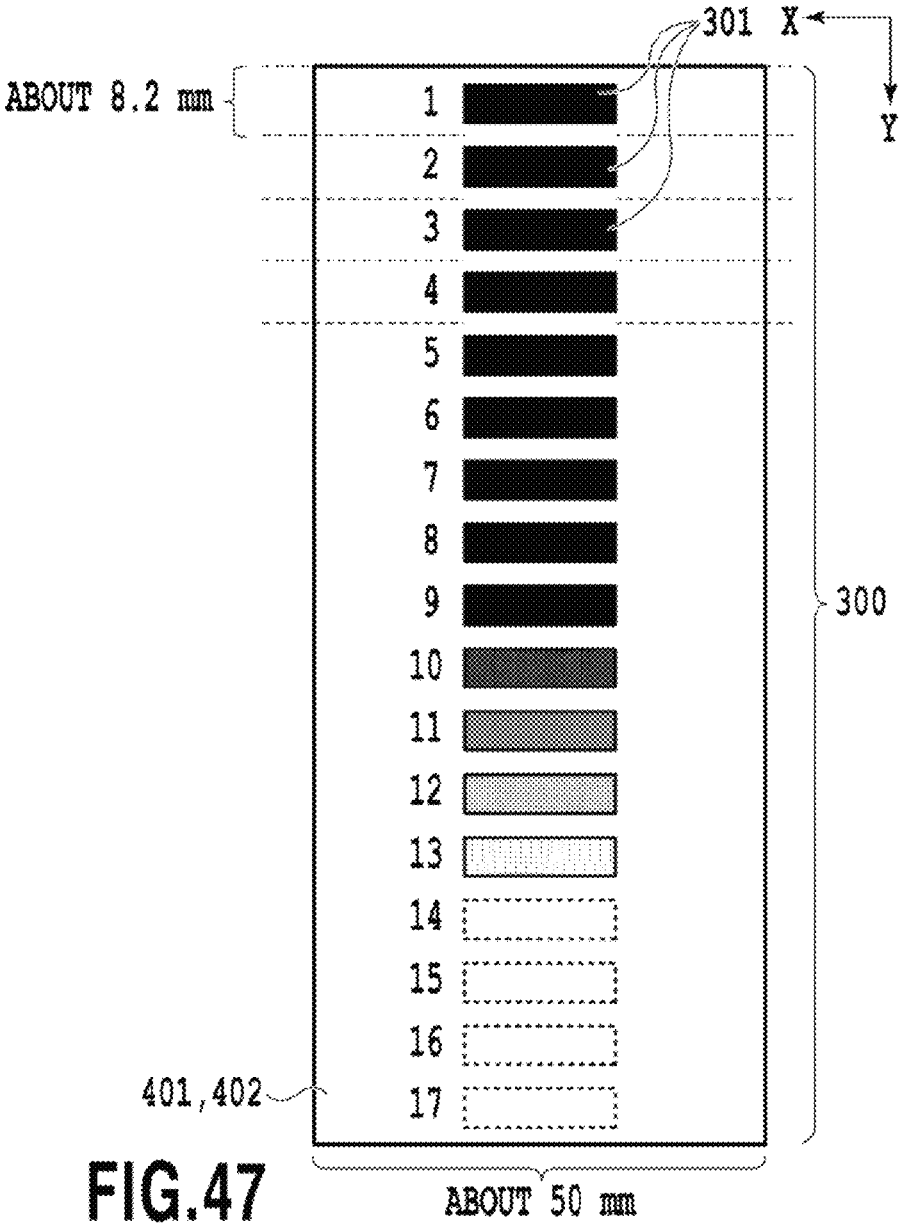
FIG. 47 is a view showing a Pth test pattern for the clear ink according to the variation of the second embodiment of the present invention.

FIG. 47 is a view showing a Pth test pattern for the clear ink according to the variation of the second embodiment. In FIG. 47, a Pth test pattern 300 is formed by a Pth determining patch 301 of the clear ink, a detection auxiliary pattern 401 of the coloring material ink 1, and a detection auxiliary pattern 402 of the coloring material ink 2. Incidentally, in the present embodiment, the Y ink is used as the coloring material ink 1, and the K ink is used as the coloring material ink 2.

The Pth determining patch 301 of the clear ink is printed by scanning once the print head with 192 nozzles in the center portion out of 512 nozzles for the clear ink. An area to be printed is part of an area for one row, and is part of an area to which a row number is assigned in FIG. 47. The area for one row has a Y-direction length of about 8.2 mm and an X-direction length of about 50 mm.

Figure 48:
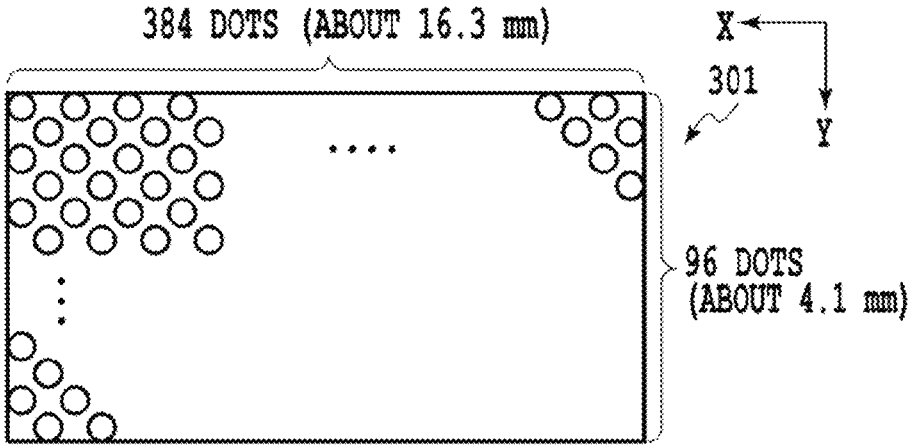
FIG. 48 is a view for explaining the details of a Pth determining patch for the clear ink as shown in FIG. 47.

FIG. 48 is a view for explaining the details of one Pth determining patch 301 for the clear ink. As shown in FIG. 48, 384 dots are printed at intervals corresponding to 600 dpi in the X direction, and 96 dots are printed at intervals corresponding to 600 dpi in the Y direction, whereby the Pth determining patch 301 is formed. These 384×96 dots are printed in a zigzag pattern. The Pth determining patch 301 is a rectangle having an X-direction length of about 16.3 mm and a Y-direction length of about 4.1 mm.

As shown in FIG. 47, a maximum of 17 Pth determining patches 301 formed in the above manner are printed at intervals from each other according to the threshold driving pulse width Pth in the Y direction. As the row number (1 to 17) of the Pth determining patch 301 in FIG. 47 becomes higher, the pulse width of the driving pulse to be supplied to the ejection heater for printing becomes smaller. In a case where the maximum driving pulse width is set as the initial value, the patch belonging to the first row is printed.

With reference to FIG. 45 again, after the Pth determining patch 301 for the clear ink is printed with the set driving pulse width as described above, in a row in which the Pth determining patch 301 is printed (in a case where the row in which the Pth determining patch 301 is printed is a kth row, the kth row), the detection auxiliary pattern 401 of the Y ink is printed to overlap the Pth determining patch printed with the clear ink in step 804, and the detection auxiliary pattern 402 of the K ink is printed to overlap the pattern of the Y ink in step 805. In the present embodiment, the Pth determining patch 301 and the detection auxiliary patterns 401 and 402 are printed by scanning the print head 2 once.

The detection auxiliary patterns 401 and 402 have the same shape as shown in FIG. 47, and have an X-direction length of about 50 mm and a Y-direction length of 8.1 mm. Further, in the detection auxiliary patterns 401 and 402, dots are arranged at a density of 100% for pixels at intervals corresponding to 1200 dpi in the X and Y directions. This makes it possible to perform printing to cover the entire Pth determining patch 301 of the clear ink even in a case where the print positions of the Y ink and the K ink are displaced from each other due to a certain factor. Incidentally, the same driving pulse as the one used for normal printing is used to print the detection auxiliary patterns of the Y ink and the K ink.

Incidentally, in the above-described example, the detection auxiliary patterns 401 and 402 are printed by performing the same scan once as in the case of the Pth determining patch, but may be printed by performing another scan. For example, the Pth test pattern may be printed by performing a first scan, and the detection auxiliary patterns 401 and 402 may be printed by performing a second scan. Further, by controlling a scan direction of the print head in the second scan, it is possible to realize desired overlapping order irrespective of the arrangement order of the colors of the coloring material inks. However, it is naturally necessary that a time interval at which the Pth determining patch 301 and the detection auxiliary patterns 401 and 402 are printed be a time interval at which the phenomenon described above with reference to FIGS. 25A to 25F occurs.

After the patch 301 and the detection auxiliary patterns 401 and 402 are printed in the kth row as described above, then, in step 806, the reflective optical sensor 30 scans the test pattern 300 in the X direction, and measures the optical characteristics of the patch 301 under the R light source. In this manner, the reflective optical sensor 30 measures, under the R light source, the test pattern formed by printing, on the clear ink, the Y ink whose reflection density is low under the R light source and the K ink whose reflection density is high under the R light source in an overlapping manner in this order. As a result, as described above with reference to FIGS. 24A to 24D and 25A to 25F and the like, a difference in reflection density can be made large between a case where the clear ink exists and a case where the clear ink does not exist, and the difference can be detected easily.

In next step 807, it is determined whether or not the reflection density of the Pth determining patch 301 is lower than a previously set threshold. In a case where the measured reflection density is equal to or higher than the previously set threshold, that is, in a case where the clear ink is ejected favorably with the currently set driving pulse width (S802 or S808), the driving pulse width is reduced by lowering the head rank by one level in step 808. For example, in a case where the reflection density of the Pth determining patch 301 printed in the first row shown in FIG. 47 is equal to or higher than a predetermined threshold, the pulse width is set at 1.2 μsec corresponding to the head rank 62 shown in FIG. 45, and the process proceeds to step 803. Then, in step 804, the Pth determining patch 301 of the clear ink is printed in a (k+1)th row, which is different from the previously printed kth row, and in steps 804 and 805 and subsequent steps, similar processing is performed.

In a case where in step 807, it is determined that the measured reflection density is lower than the predetermined threshold, that is, in a case where there is no difference in the density or color of the Pth determining patch 301 between a case where the clear ink is used and a case where the clear ink is not used because the clear ink is not ejected with the currently set driving pulse width (S802 or S800), for example, at step 809, a driving pulse width whose corresponding head rank is one level higher than the head rank corresponding to the currently set pulse width is set as the threshold driving pulse width Pth, at step 809. For example, assume that in FIG. 47, the density of the patch 301 printed with a driving pulse width with which the Pth determining patch 301 printed in the 14th row is formed, that is, a driving pulse width corresponding to the head rank 50 is lower than a threshold. In this case, a pulse width with which the patch 301 is printed in a 13th row in FIG. 47, that is, a driving pulse width (1.09 μsec) corresponding to the head rank 51 is set as the threshold driving pulse width Pth for the clear ink.

As described above, driving energy obtained by multiplying the measured threshold pulse width Pth by the threshold voltage Vth is a boundary value for driving energy with which the coloring material ink for the print head cannot be ejected, that is, threshold driving energy. After this measurement operation, the driving voltage changes from the threshold voltage Vth to a driving voltage Vop for a normal printing operation. Since this driving voltage Vop is k times the threshold driving voltage Vth, driving energy obtained by multiplying the normal driving voltage Vop by the measured threshold pulse width Pth is optimal driving energy obtained by multiplying the threshold driving energy by the value k.

Third Embodiment

A third embodiment of the present invention relates to a mode of printing, as a check pattern, a pattern for correcting the applying amount of the clear ink (HS), and increases a difference in density corresponding to a difference in the applying amount of the clear ink in an area in which the coloring material ink and the clear ink overlap each other. In the following explanation of the third embodiment, the same reference numerals are allocated to the same elements as the ones in the above-described first and second embodiments, and their explanation will be omitted.

Figure 49:
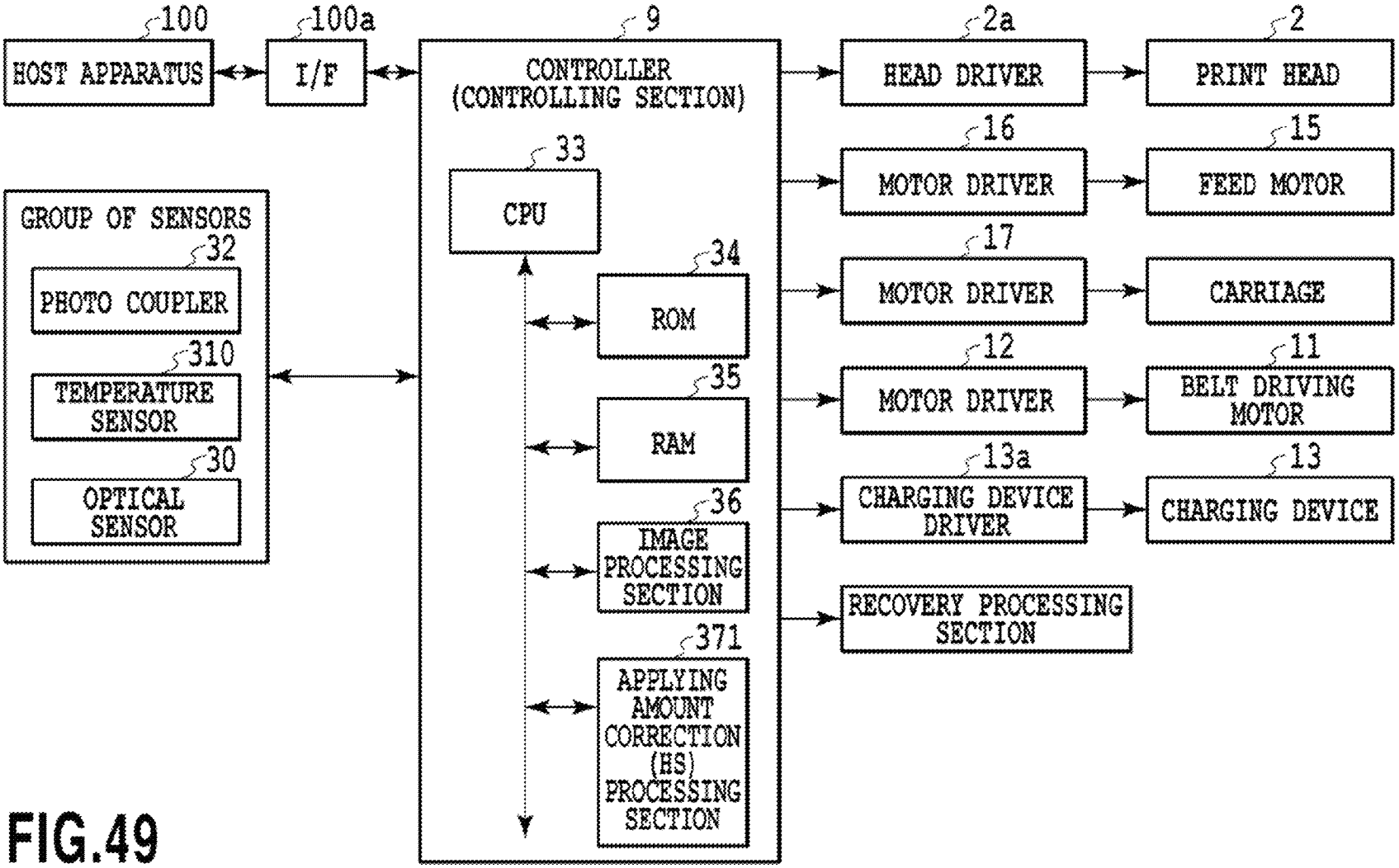
FIG. 49 is a block diagram showing the control configuration of an inkjet printing apparatus according to a third embodiment of the present invention.

The third embodiment of the present invention relates to an apparatus having the same configuration as the above-described inkjet printing apparatus shown in FIG. 1 according to the first embodiment. FIG. 49 is a block diagram showing the control configuration of an inkjet printing apparatus according to she third embodiment, and mainly shows the detailed configuration of the controlling section 9 shown in FIG. 1. The configuration of the third embodiment is different from the configuration of the first embodiment shown in FIG. 5 in that the third embodiment includes an HS processing section 371. The HS processing section performs processing for correcting the applying amount of the clear ink (clear HS) as described later with reference to FIG. 51 and the like. More specifically, the image processing section 36 performs predetermined color conversion of image data, and obtains color signal data for the clear ink and the C, M, Y, and K coloring material inks. Applying amount correction (HS correction) is performed on each of the color signals based on an HS table for each ink. The color signal for the clear ink is corrected based on the HS table obtained by printing a pattern described later with reference to FIG. 51 and the like. The image processing section 36 quantizes image data composed of color signal data after HS correction.

<Coloring Material Inks and Clear Ink>

The clear ink used in the present embodiment is the same as the one in the first embodiment.

<Applying the Clear Ink>

In the present embodiment, in order to print an image, the clear ink is applied to an area of the print medium on which the image is to be printed before the coloring material inks. Specifically, as shown in FIG. 1 regarding the first embodiment, the print head 21 for the clear ink positioned upstream in the conveying direction of the print medium P ejects the clear ink, and next, the print head 22 for the coloring material inks positioned downstream ejects the coloring material inks, thereby applying the clear ink and the coloring material inks as described above. Regarding the applying amount of the clear ink, the present embodiment is designed so that about 10 ng of the clear ink is applied to pixel of a size corresponding to 600 dpi in the X and Y directions (FIG. 1). More specifically, the present embodiment is designed so that in a case where the print duty of the clear ink as indicated by image data is 100%, about 10 ng of the clear ink is applied to the pixel of 600 dpi. In the present embodiment, a pixel with a density of 1200 dpi in the X and Y directions is printed, and in a case where the print duty is 100%, a dot of the clear ink (a droplet of the clear ink) is printed on (applied to) each of two pixels out of four (2×2) pixels of 1200 dpi, the total amount of these droplets is about 10 ng as described above. In the applying amount correcting section 371, in a case where a gradation value indicated by the image data (color signal data) for the clear ink is 128, this value corresponds to the print duty of 100%. However, even in a case where the above setting is made, variations may occur in the ejection amount of the print head. As a result, an excessive amount of the clear ink, for example, leads to sheet deformation caused by an excessive amount of water, ink bleeding, and an increase in running cost caused the excessive consumption of the clear ink. On the other hand, in a case where the ejection amount decreases and the applying amount of the clear ink is not enough, the coloring material inks do not coagulate sufficiently, the density decreases, and image quality lowers. Further, in a case where these states exist in the nozzles of the same print head in a mixed manner, variations in density occur in addition to the above problems, and the quality of a printed image further lowers. In the present embodiment, processing for correcting the applying amount of the clear ink (clear ink HS correction), which will be described later, is performed to manage the applying amount of the clear ink.

Incidentally, in the explanation of the present embodiment, it is assumed that a certain amount of the clear ink is uniformly applied to an area which is substantially the same as an area in which an image is formed with the coloring material inks. However, in a method for applying the clear ink, the clear ink may be applied not only to the area in which the image is formed, but also to the entire surface of the print medium. Further, the applying amount of the clear ink may vary depending on the applying amounts of the coloring material inks from an image printing section. This makes it possible to reduce the load of processing related to an area to which the clear ink is applied and to further suppress excessive consumption of the clear ink.

Further, in the present embodiment, in order to print an image, the clear ink is applied before the coloring material inks are applied. However, application order is not limited to the above order. The clear ink may be applied after the coloring material inks are applied. Further, the clear ink may be applied while the plurality of types of coloring material inks are applied.

<Correction of Applying Amount (HS)>

Figure 50:
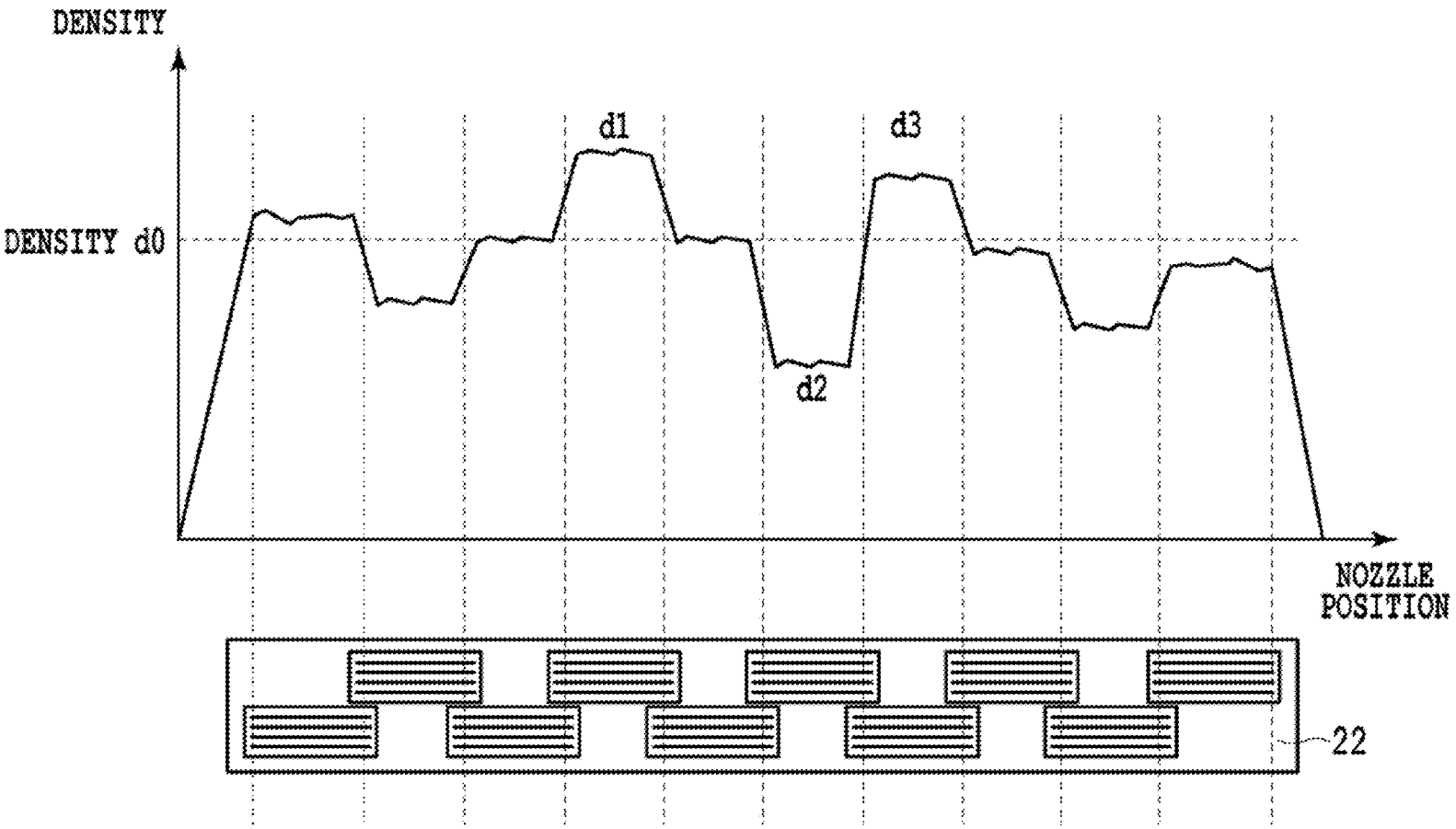
FIG. 50 is a graph showing an example of density unevenness caused by a difference in ejection characteristics between nozzles of a print head according to the third embodiment of the present invention.

Specific explanation will be made on processing by the applying amount correcting section 371. Here, explanation will be made by taking, as an example, a nozzle array for a one-color ink in the print head 22 for the coloring material inks. FIG. 50 is a graph showing an example of density unevenness caused by a difference in ejection characteristics between the nozzles of the nozzle arrays of the print head. Incidentally, the print had of the present embodiment is formed by arranging a plurality of head chips provided with nozzles so that the head chips overlap some nozzles. At the time of performing printing by the print head, a half of overlapping portions of the nozzles are configured to be used by mask processing.

The nozzles of the nozzle arrays for one color of the print head are used to print a uniform image with a density d0 by using image data on the same signal value (gradation value). In this case, a density distribution shown in FIG. 50 can be obtained by quantizing the image data without performing processing by the applying amount correction processing section 371, for example to obtain ejection data, ejecting the ink from the nozzles of the nozzle arrays for the one color to perform printing, and optically measuring the density of an obtained image. Incidentally, even in a case where the applying amount correction processing section 371 performs HS correction, the density distribution shown in FIG. 50 may be obtained due to a temporal change of the print head or the like. HS correction corrects such a density distribution so that for example, all the nozzles have a constant density d0, which is a target. More specifically, the HS processing section 371 performs correction to decrease the signal value (gradation value) of image data corresponding to the nozzles of a chip exhibiting a density (for example, d1 or d3) higher than the target density d0 shown in FIG. 50. On the other hand, the HS processing section 371 performs correction to increase the signal value (gradation value) of image data corresponding to the nozzles of a chip exhibiting a density (for example, d2) lower than the target density d0. In other words, the level of a signal given to a chip is increased or decreased based on a relationship between the ejection characteristics of the chip and target ejection characteristics. Such data for HS processing for each chip is stored in the ROM 34 as table data.

Incidentally, as described above, the present embodiment relates to HS correction for correcting a density distribution (density unevenness) among the chips. This is because from a microscopic viewpoint, a density distribution is generated on a nozzle basis, and due to a method for manufacturing chips, a density distribution among different chips tends to be large as compared with a density distribution in the same chip. Incidentally, the present invention can be naturally applied to a density distribution for one nozzle or a density distribution for a plurality of nozzle groups, which will be described later.

<Sensor Light Source Color and Reflection Density>

Next, explanation will be made on the sensor light source color and the reflection density. The reflective optical sensor 30 of the present embodiment selects and uses, as the light emitting section 31, any of three types of red (the R light source), green (the G light source), and blue (the B light source) light emitting diodes (LEDs) according to the color tones of the clear ink and the coloring material inks used by the printing apparatus, the configuration of the print head, and the like. More specifically, the explanation of the first embodiment with reference to FIGS. 17 and 18 also applies to the present embodiment.

<Reflection Density of a Printed Portion of the Clear Ink and the Coloring Material Inks>

The reflection density and optical characteristics of a printed portion of the clear ink and the coloring material inks according to the present embodiment are the same as those explained in the first embodiment with reference to FIGS. 19A to 24D.

<Correction of the Applying Amount of the Clear Ink (Clear Ink HS)>

Figure 51:
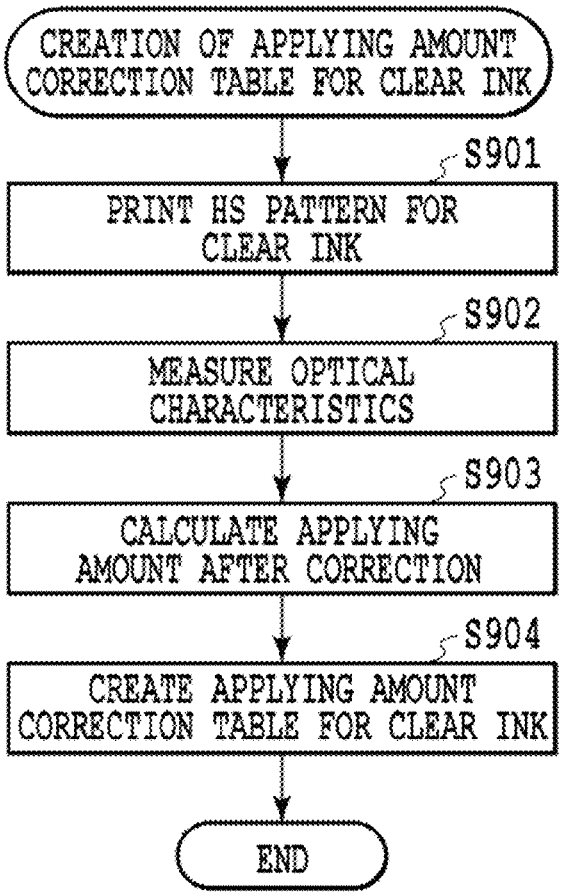
FIG. 51 is a flowchart showing processing for creating a table for correcting the applying amount of the clear ink (HS) according to the third embodiment of the present invention.

FIG. 51 is a flowchart showing processing for creating a table for correcting the applying amount of the clear ink (HS) according to the third embodiment of the present invention. This table for HS is used for the applying amount correction processing section 371 (FIG. 49) to correct the applying amount as described above.

First, a pattern for obtaining an applying amount correction table for the clear ink (an HS pattern for the clear ink) is printed (S901). Next, the optical characteristics of the printed HS pattern are measured (S902). Then a correction coefficient relating to the applying amount of the clear ink is obtained from the measured optical characteristics (S902), and the applying amount correction table for the clear ink is created (S904). The details of each step will be described below.

<S901: Printing of the HS Pattern for the Clear Ink>

Figure 52:
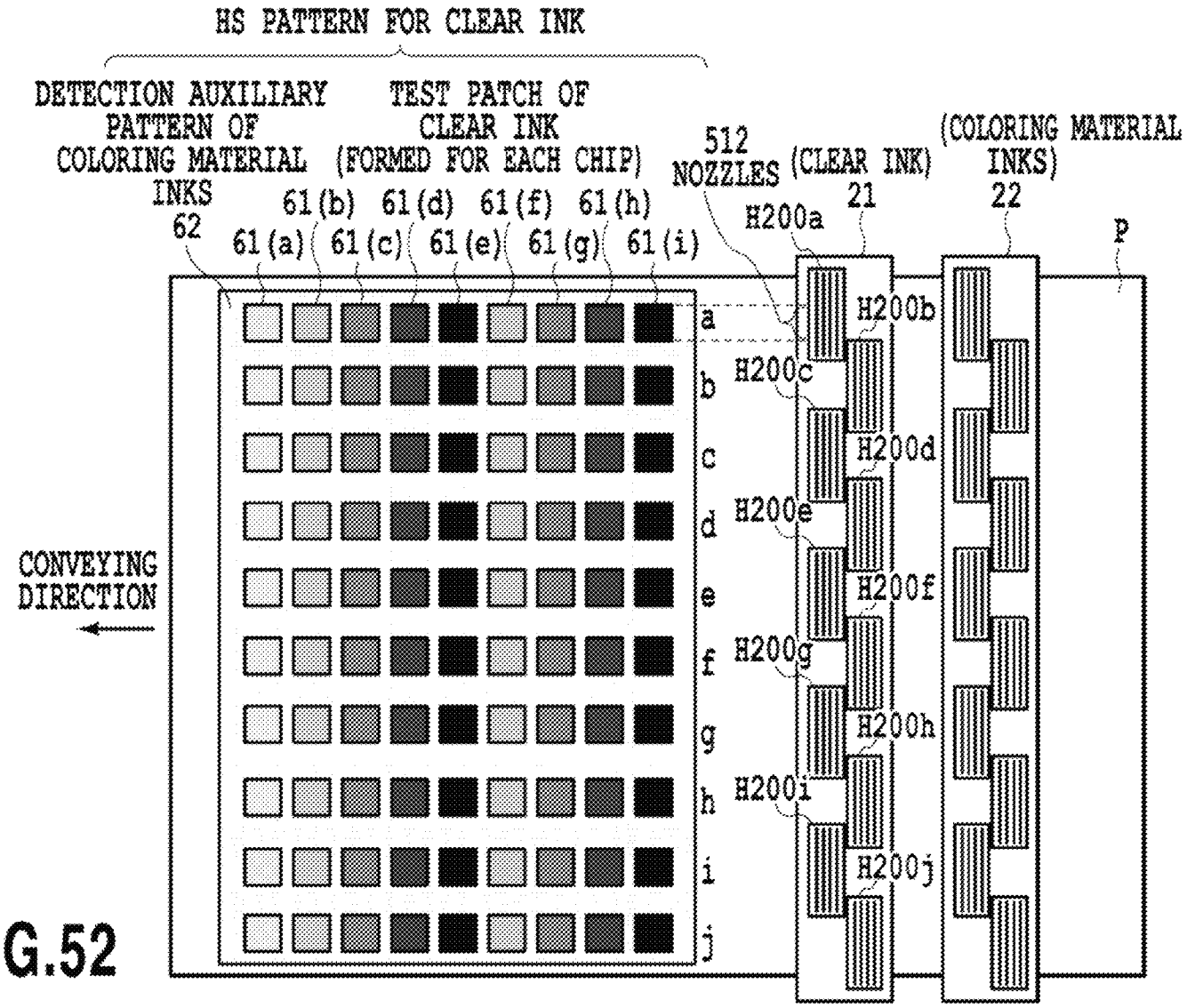
FIG. 52 is a view for explaining an example of an HS pattern for the clear ink according to the third embodiment of the present invention.
Figure 53:
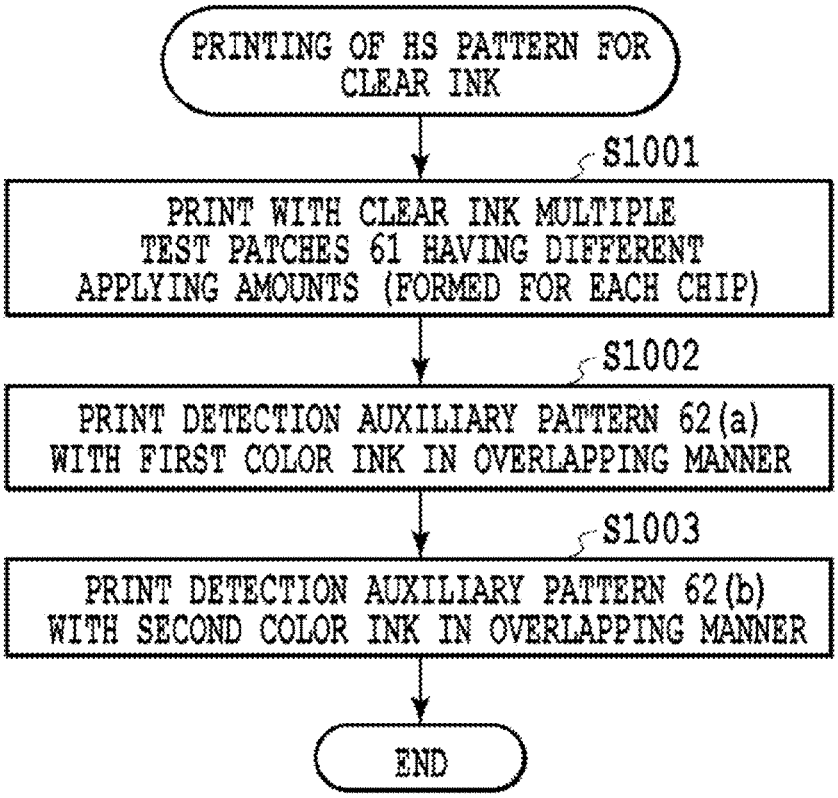
FIG. 53 is a flowchart showing processing for printing the HS pattern shown in FIG. 52.

The HS pattern for the clear ink is printed by using the clear in and two types of predetermined coloring material inks. In the present embodiment, the yellow (Y) ink is used as the first coloring material ink, and the black (K) ink is used as the second coloring material ink. FIG. 52 is a view for explaining an example of the HS pattern for the clear ink according to the present embodiment. The HS pattern for the clear ink is printed by printing certain applying amounts of the first coloring material ink (Y) and the second coloring material ink (K) on a plurality of test patches 61 formed with the clear ink in different applying amounts in an overlapping manner in this order (a detection auxiliary pattern 62). FIG. 53 is a flowchart showing processing for printing the HS pattern. First, the clear ink is ejected from the print head 21, and the plurality of patches 61(*a*) to 61(*i*) with the different applying amounts are printed (S1001). In a case where the currently set applying amount of the clear ink is regarded as 100%, these test patches are formed with a total of nine applying amounts 0%, 25%, 50%, 75%, (100%), 125%, 150%, 175%, and 200% wherein the currently set applying amount is a median. In FIG. 52, the nine columns 61(*a*) to 61(*j*) are shown as the patches with these applying amounts. Further, these test patches are printed for each chip in the print head 21 for the clear ink. In FIG. 52, rows a to j are shown as these test patches. More specifically, a patch having 512 pixels×512 pixels (about 108 mm×about 108 mm) is printed as a patch of the patch rows a to j by using 512 nozzles in a center portion of each of the chips H200*a* to H200*j* arranged on the print head 21. More specifically, in the present embodiment, the ejection characteristics of each chip are detected, and the applying amount of each chip is corrected based on the detection result. In this respect, the ejection characteristics of the 512 nozzles in the center portion are handled as the ones representing the ejection characteristics of the chip. Further, as in the case of the clear ink, 512 nozzles in a center portion of each chip are also used to print patches of the coloring material inks by the print head 22, as will be described below. Incidentally, it is natural that nozzles other than 512 nozzles in the center portion are used to print an area other than the patches. However, in a case where the print head 21 for the clear ink and the print head 22 for the coloring material inks are not at the same position in the Y direction, the patches may be printed with the coloring material inks by using nozzles other than the nozzles in the center portion. Incidentally, the nine applying amounts from 0% to 200% are specifically represented by gradation values of 8-bit image data, and in a case where the gradation value is 255, for example, the applying amount is such that one dot of the clear ink is formed on each pixel in the 512 pixels×512 pixels constituting the patch. Further, in a case where the set applying amount of the clear ink (the gradation value) is 128, for example, this applying amount is a median, and the gradation values are 0, 32, 64, 96, (128), 160, 192, 224, and 255.

With reference to FIG. 53 again, after the test patches are printed with the clear ink in the above manner, then, the detection auxiliary pattern 62 is printed with the first coloring material ink (Y) in an overlapping manner on each test patch printed in the above manner and an area other than the patches based on image data on a predetermined applying amount (gradation value) (S1002). Then, as in the case of the first coloring material ink, the detection auxiliary pattern 62 is printed with the second coloring material ink (K) in an overlapping manner on each test patch and an area other than the patches based on image data on a predetermined applying amount (gradation value) (S1003).

Figure 54:
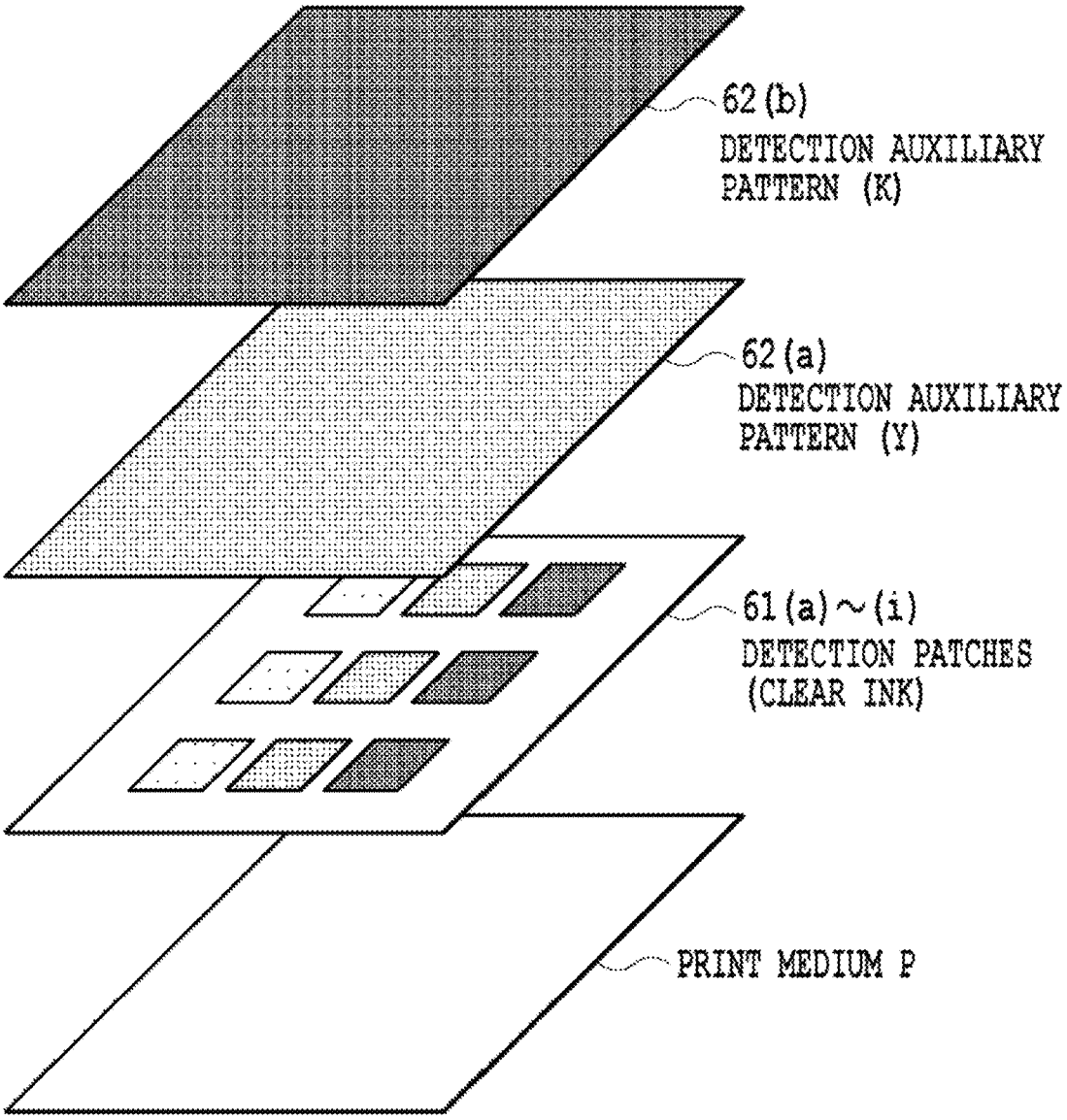
FIG. 54 is a view showing the HS pattern for the clear ink and its printing order according to the third embodiment of the present invention.

FIG. 54 is a view showing the above-described HS pattern for the clear ink and its printing order. As shown in FIG. 54, first, the test patches 61(*a*) to 61(*i*) are printed with the clear ink on the print medium P. Then, a detection auxiliary pattern 62(*a*) of the Y ink and a reference pattern 62(*b*) of the K ink are printed on the test patches and another area in this order. In the present embodiment, the detection auxiliary pattern 62(*a*) is a uniform density solid pattern obtained by applying about 20 ng of the Y ink to an area corresponding to 600 dpi×600 dpi based on the gradation value (the applying amount) of the image data and the detection auxiliary pattern 62(*b*) is also a uniform density solid pattern obtained by applying about 20 ng of the K ink to an area corresponding to 600 dpi×600 dpi. These applying amounts match the maximum applying amounts (duties) of the coloring material inks used at the time of printing by the printing apparatus of the present embodiment. Further, regarding printing of a pattern, in order to reduce the effect of variations in the applying amounts of the coloring material inks, it is desirable to perform HS of the clear ink after correcting the applying amounts of the coloring material inks beforehand.

<S902: Measurement of Optical Characteristics>

The optical characteristics of the printed test patches 61(*a*) to 61(*i*) are measured. After the HS pattern for the clear ink is printed as described above, the print medium P and the carriage are moved so that the reflective optical sensor 30 mounted in the carriage is positioned to face the test patches 61(*a*) to 61(*i*). Then, the reflection optical density is measured as the optical characteristics of each patch. In the present embodiment, red (the R light source) is used as the light source of the reflective optical sensor 30. Incidentally, in order to reduce the effect of noise, it is possible to perform measurement after stopping the carriage, to use a sensor having a large spot diameter, or to average the results of measurements at a plurality of points. This makes it possible to average local unevenness on the printed pattern and measure the reflection optical densities with high accuracy.

<S903: Calculation of the Corrected Applying Amount>

Figure 55:
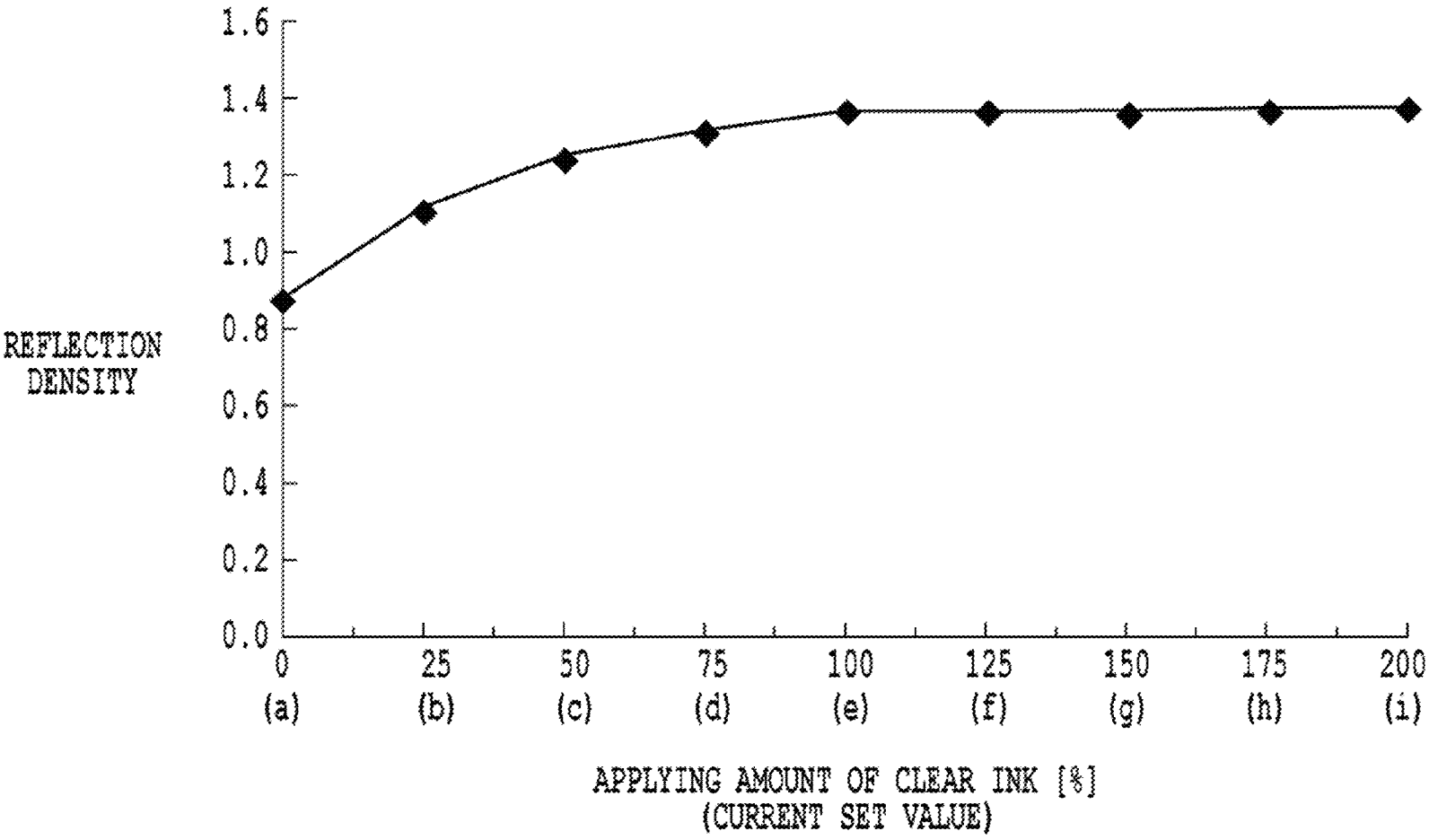
FIG. 55 is a graph showing an example of the results of measurements of test patches printed by one chip according to the third embodiment of the present invention.

FIG. 55 is a graph showing an example of the results of measurements of the test patches 61(*a*) to 61(*i*) printed by one chip. In FIG. 55, the reflection density D gradually increases from the patch (a) whose applying amount of the clear ink is 0% to the patch (e) whose applying amount of the clear ink is 100%, whereas the reflection density Dn is almost constant after the patch (e) whose applying amount of the clear ink is 100%. This shows that the required minimum applying amount of the clear ink for coagulating the coloring material inks, that is, the optimal applying amount of the clear ink is about 100% in the case of the chip which prints the test patches in the example. In the present embodiment, the applying amount in a patch immediately preceding a patch in which the amount of change ΔD in reflection density between the test patches is smaller than 3% is set as the corrected applying amount of the clear ink of the chip, and used as a criterion for determining whether or not the reflection density Dn is almost constant. More specifically, as described above, in the present embodiment, the applying amount which is set at the time of printing the test patches and which is indicated by the image data for the clear ink is 100%. Accordingly, the applying amount of 100% which corresponds to the chip and which is image data for printing the clear ink is corrected by the applying amount correction processing section 371 (FIG. 49) and serves as image data for the clear ink indicating the applying amount of 100%. The consecutive numbers n of the test patches 61(*a*) to 61(*i*) are 1 to 9, and ΔDn is represented by the following formula:

$$\Delta Dn=(Dn-1-Dn)/Dn \quad (n=2, 3, 4, \ldots 9)$$

where Dn is the reflective density measurement value.

FIG. 56 is a diagram showing densities Dn and amounts of change in density ΔDn measured by using the chip for the results of measurements shown in FIG. 55. As shown in FIG. 56, in a case where the amount of change in density ΔDn becomes smaller than 3% for the first time, n=6. Accordingly, the applying amount of "100%" wherein n=5 (the test patch e) is calculated as the corrected applying amount of the clear ink of the chip in the example.

Figure 57:
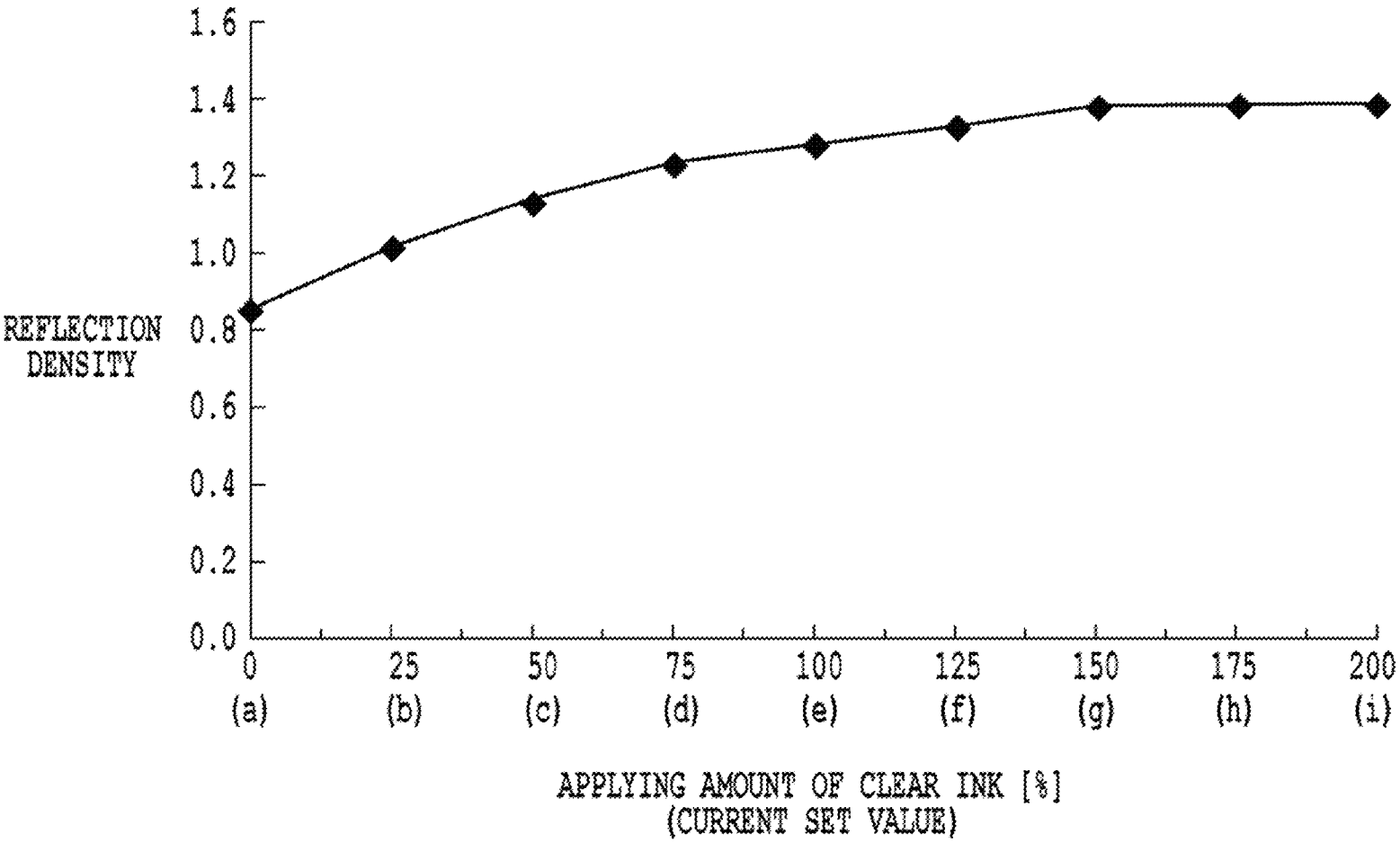
FIG. 57 is a graph showing the results of measurements of test patches printed by a chip different from the chip for the results of measurements shown in FIG. 55.

FIG. 57 is a graph showing the results of measurements of the test patches 61(*a*) to 61(*i*) printed by a chip different from the chip for the results of measurements shown in FIG. 55. As shown in FIG. 57, the reflection density D gradually increases from the patch (a) whose applying amount of the clear ink is 0% to the patch (g) whose applying amount of the clear ink is 150%, whereas the reflection density D is almost constant after the patch (g) whose applying amount of the clear ink is 150%. This shows that the optimal applying amount of the chip in the example is about 150%, that is, shows that in a case where the applying amount is 100%, which is the current set value, the applying amount is not sufficient. FIG. 58 is a diagram showing densities Dn and amounts of change in density ΔDn measured by using the chip for the results of measurements shown in FIG. 57. As shown in FIG. 58, in a case where the amount of change ΔDn becomes smaller than 3% for the first time, n=8. Accordingly, the applying amount of "150%" wherein n=7 (the test patch g) is calculated as the corrected applying amount of the clear ink of the chip in the example. More specifically, the applying amount of 100% which corresponds to the chip and which is image data for printing the clear ink is corrected by the applying amount correction processing section 371 (FIG. 49) and serves as image data for the clear ink indicating the applying amount of 150%.

Figure 59:
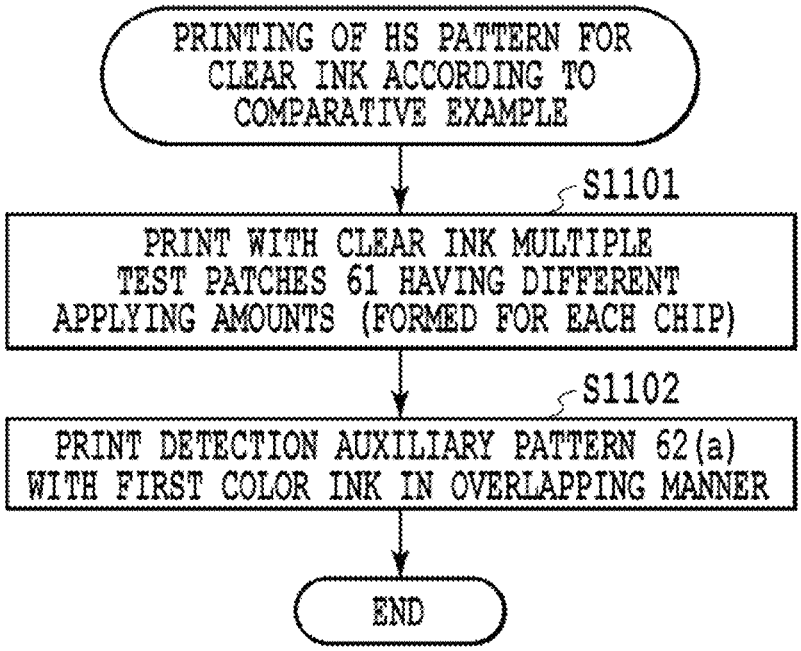
FIG. 59 is a flowchart showing processing for printing an HS pattern for the clear ink according to a comparative example.

Explanation will be made on the measurement values of the test patches 61 in the case of printing the HS pattern for the clear ink using only one color (for example, the K ink) for the clear ink as a comparative example. FIG. 59 is a flowchart showing processing for printing the HS pattern for the clear ink according to the comparative example. In FIG. 59, in step 1101, the plurality of test patches are printed with the clear ink as in step 1001. Next, in step 1102, the detection auxiliary pattern 62(*b*) is printed with a predetermined applying amount of the first coloring material ink (K) on the test pattern of the clear ink in an overlapping manner.

Figure 60:
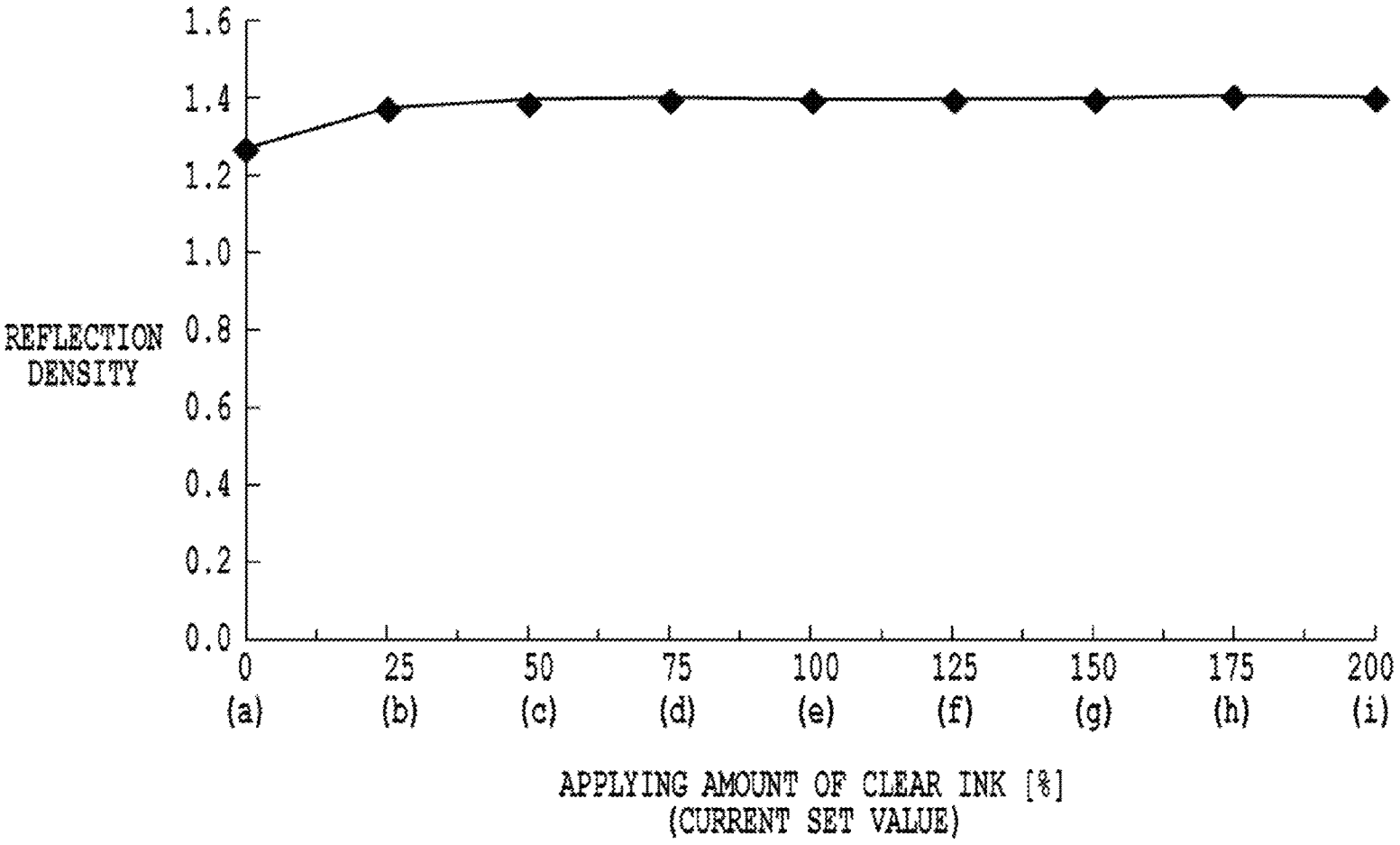
FIG. 60 is a graph showing the results of measurements of test patches printed according to the process described above with reference to FIG. 59 by the chip for the clear ink with which the results of measurements shown in FIGS. 55 and 56 are obtained.

FIG. 60 is a graph showing the results of measurements of test patches printed according to the process described above with reference to FIG. 59 by the chip for the clear ink with which the results of measurements shown in FIGS. 55 and 56 are obtained. Further, FIG. 61 is a diagram showing densities Dn and amounts of change in density ΔDn measured by using the chip for the results of measurements shown in FIG. 60. As shown in these figures, a detected difference in density between the test patches is small. As a result, in the present embodiment, the measured optical density is constant after the test patch (f) (see FIGS. 55 and 56), and in this comparative example, the reflection density D is almost constant after the patch (b) whose applying amount is 25%. Accordingly, as compared with the above-described embodiments, it is found that the accuracy of detecting the applying amount whose density is almost constant becomes lower.

Figure 62:
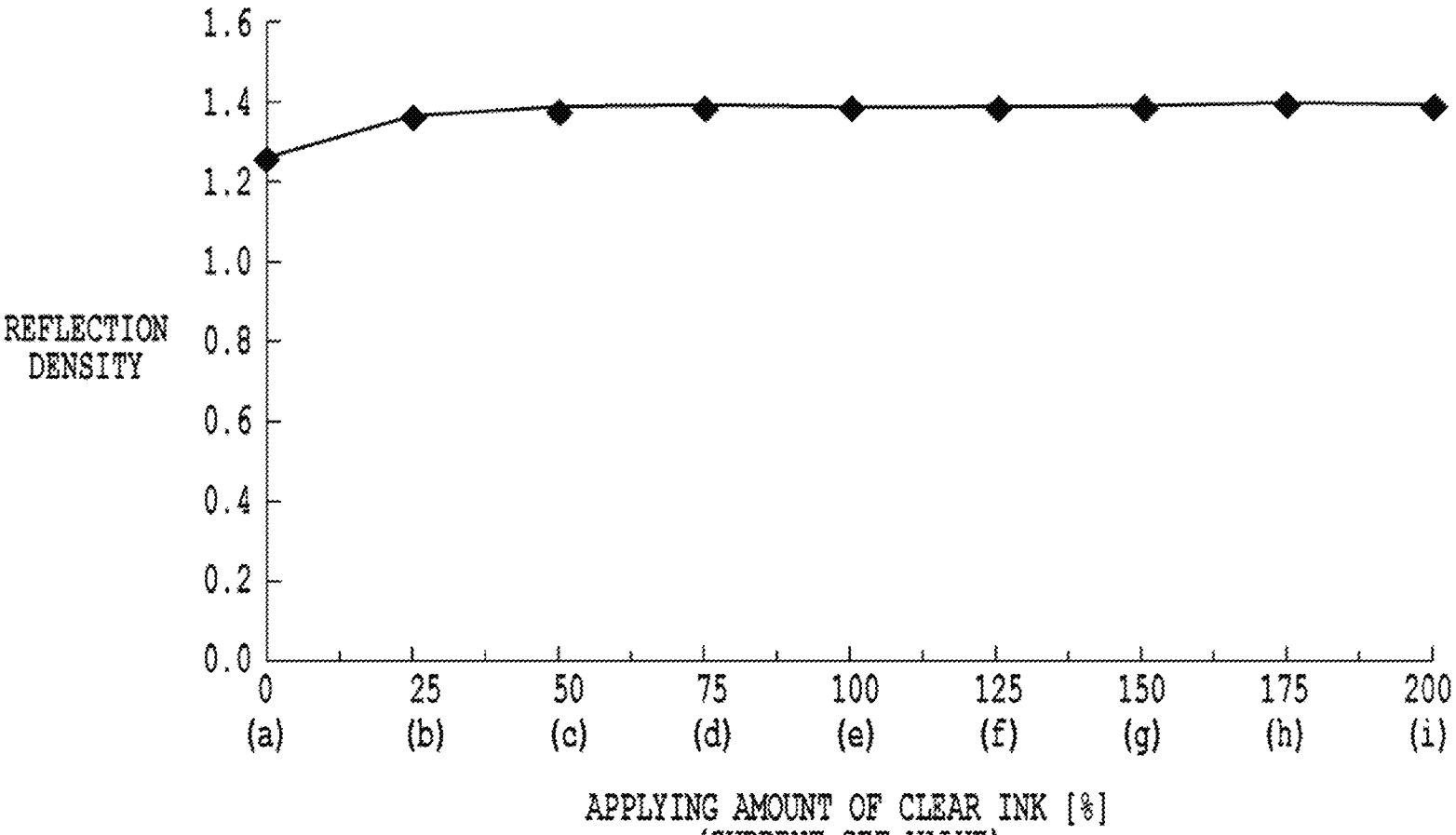
FIG. 62 is a graph showing the results of measurements test patches printed according to the process described above with reference to FIG. 59 by the chip for the clear ink with which the results of measurements shown in FIGS. 57and 58 are obtained.

Likewise, FIG. 62 is a graph showing the results of measurements of test patches printed according to the process described above with reference to FIG. 59 by the chip for the clear ink with which the results of measurements shown in FIGS. 57and 58 are obtained. Further, FIG. 63 is a diagram showing densities Dn and amounts of change in density ΔDn measured by using the chip for the results of measurements shown in FIG. 62. In this comparative example as well, a detected difference in density between the test patches is small. As a result, in the present embodiment, the measured optical density is constant after the test patch (h) (see FIGS. 57 and 58), and in this comparative example, the reflection density D is almost constant after the patch (b) whose applying amount is 25%. Accordingly, as compared with the above-described embodiments, it is found that in this example as well, the accuracy of detecting the applying amount whose density is almost constant becomes lower.

Accordingly, according to the present embodiment, by appropriately combining the coloring material inks of two colors, printing order, and the light source color used for measurement, it becomes possible to increase a difference in detected value between test patches or between a case where the amount of the clear ink is large and a case where the amount of the clear ink is small, and to improve its detectability.

<S904: Creating the Applying Amount Correction Table for the Clear Ink, Setting the Corrected Applying Amount>

In order to realize the corrected applying amount calculated in step 903 as described above, the applying amount correction table for the clear table is created for each chip. More specifically, regarding the chip from which the above-described results of the measurements shown in FIG. 55 are obtained, the table is set to convert the gradation value (the applying amount) (100%) of the image data for the clear ink corresponding to the nozzles of the chip into a gradation value obtained by multiplying the gradation value before conversion by a coefficient of 100%/100%=1.0. Further, regarding the chip from which the results of the measurements shown in FIG. 57 are obtained, the table is set to convert the gradation value (the applying amount) (100%) of the image data for the clear ink corresponding to the nozzles or the chip into a gradation value obtained by multiplying the gradation value before conversion by a coefficient of 150%/100%=1.5. Further, the HS table for the clear ink thus obtained is stored in the ROM 34 (FIG. 49). At the time of performing printing with the clear ink, the CPU 33 requests transmission of the HS table for the clear ink stored in the ROM 34 to the applying amount correction processing section 371. The applying amount correction processing section 371 corrects the image data for the clear ink by using the transmitted HS table. This control makes it possible to reduce variations in the ejection characteristics of the ink caused by a manufacturing error, durability deterioration, and the like for each chip for the clear ink, and to apply the clear ink uniformly.

<Combination of the Sensor Light Source Color and the Detection Auxiliary Ink Color>

In the above explanation of the embodiment, the red (R) light source is used as the light source color, and out of the coloring material inks, the Y ink is used as the detection auxiliary coloring material ink to be firstly applied to the print medium, and the K ink is used as the detection auxiliary coloring material ink to be subsequently applied to the print medium. However, another combination may achieve the same advantageous results. As described above, the present invention selects an ink having a color tone whose reflection density is low in the case of using the color of the light source used for a test as the detection auxiliary first coloring material ink to be firstly applied and an ink having a color tone whose reflection density is high in the case of using the color of the light source used for a test as the detection auxiliary second coloring material ink to be subsequently applied. Regarding a representative combination, assuming that R, G, and B as the sensor light source colors and C, M, Y, and K as the coloring material ink colors are ideal colors, the Y ink or the M ink is selected as the detection auxiliary first coloring material ink under the red (R) light source, and the K ink or the C ink can be selected as the detection auxiliary second coloring material ink under the red (R) light source. The C ink or the Y ink can be selected as the first coloring material ink under the green (G) light source, and the K ink or the M ink can be selected as the second coloring material ink under the green (G) light source. Further, the M ink or the C ink can be selected as the first coloring material ink under the blue (B) light source, and the K ink or the Y ink can be selected as the second coloring material ink under the blue (B) light source. Incidentally, there are many cases where the colors of the coloring material inks used in the inkjet printing apparatus such as C, M, Y, and K are net ideal C, M, Y, and K, and the color development of the print medium to be used and the configuration of the printing apparatus also put limitations on dot overlapping order. In this it is desirable to actually print patterns on the print medium used for printing under various conditions to obtain an optimal combination beforehand.

<Regarding Detection of Optical Characteristics>

In the above explanation of the embodiment, the reflective optical sensor for emitting limit from the color (R, G, or B) light source having a predetermined peak wavelength and measuring the intensity (reflection density) of its reflection light is used as a detecting unit configured to detect optical characteristics. However, it is possible to use another detecting unit as long as the other detecting unit detects optical characteristics over a specific wavelength range. For example, it is also possible to emit white light from the white light source, disperse its amplified reflection light by using color filters for RGB, and read the dispersed reflection light by using a CCD sensor, which is an imaging element, thereby obtaining RGB information. Further, the RGB information can also obtained by reading reflection light from the RGB light sources with a CMOS sensor, which is an imaging device. In these cases, the same advantageous results can be obtained by reading the luminance value of an appropriate channel of the obtained RGB information as the above-described reflection density.

Further, in another mode, in a case where a test is conducted through visual observation, an ink having a color tone whose reflection density is low (lightness is high) under the white light is selected as the detection auxiliary coloring material ink to be firstly applied, and an ink having a color tone whose reflection density is high (lightness is low) under the white light is selected as the reference coloring material ink to be subsequently applied. This can increase a difference in reflection density (lightness) between test patches or between a case where the amount of the clear ink is large and a case where the amount of the clear ink is small. The user can observe the clear HS pattern printed in the above manner as shown in FIG. 52, select the constant-density patch from the nine patches, and input the applying amount in the patch as the applying amount of the clear ink. As an example of a specific combination of inks, the Y ink is used as the detection auxiliary first coloring material ink, and the K ink is used as the detection auxiliary second coloring material ink.

Variation of the Third Embodiment

A variation of the third embodiment uses a line scanner capable of performing detection according to the width of the print medium as a reading device for detecting optical characteristics. The line scanner of the present embodiment includes CCD line sensors, and the CCD sensors are arranged at intervals of 1600 dpi in a direction perpendicular to the conveying direction of the print medium. It is possible to correct the applying amount for several nozzles by using the reading device having relatively high resolution.

Figure 64:
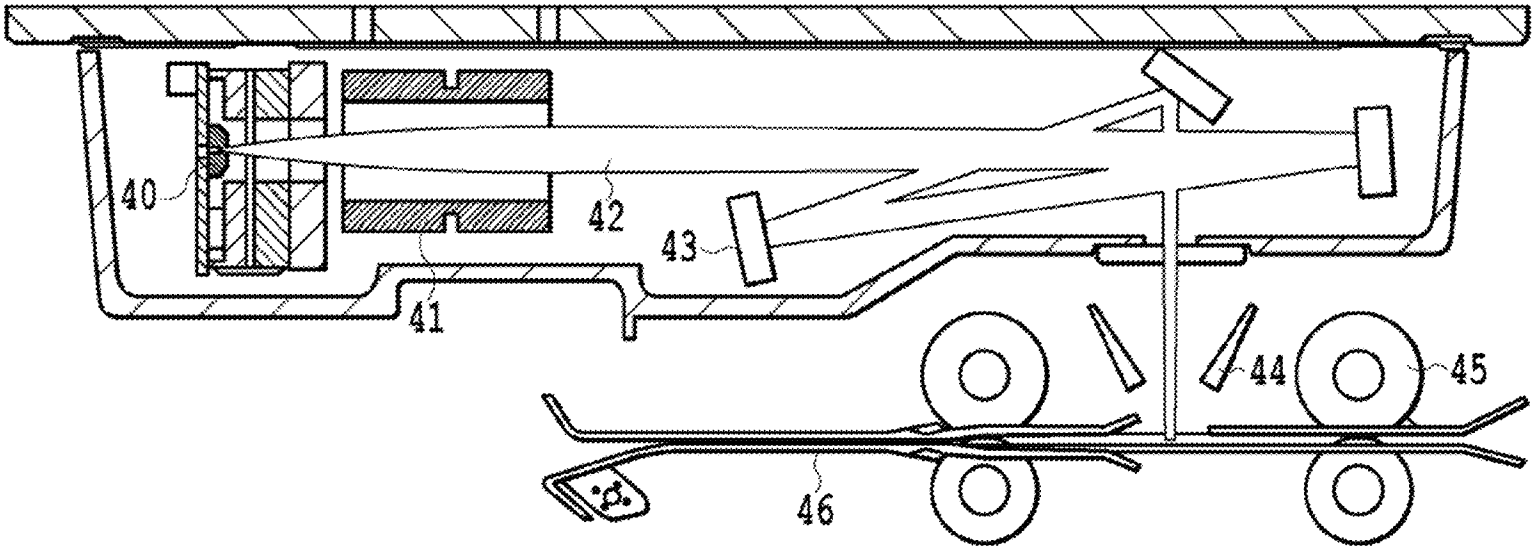
FIG. 64 is a cross-sectional view showing a line scanner used for a variation of the third embodiment.

FIG. 64 is a cross-sectional view showing the line scanner used for the present embodiment. In FIG. 64, a CCD 40 converts light into an electric signal. A light beam 42 reflected from a document passes through a lens 41 and reaches the CCD 40. In this configuration, reference numeral 43 denotes a mirror for reflecting the light beam into small space, reference numeral 44 denotes a document illuminating device for illuminating the document, reference numeral 45 denotes a conveying roller for conveying the document, and reference numeral 46 denotes a paper conveying guide plate for guiding the document. The document guided by the paper conveying guide plate 46 is passed through a reading section at a predetermined speed by the conveying roller 45. The document at the reading section is illuminated by the document illuminating device 44. The light beam 42 reflected from the illuminated document is reflected from the mirror 43, and passes through the lens 41 to enter the CCD 40. Image information which is converted into an electric signal by the CCD 40 is passed to an image analyzing section and analyzed. The scanner can obtain analog luminance data on red (R), green (G), and blue (B) channels. The luminance data can be handled in the same manner as the reflection densities under the R, G, and B light sources as explained in the third embodiment.

Figure 65:
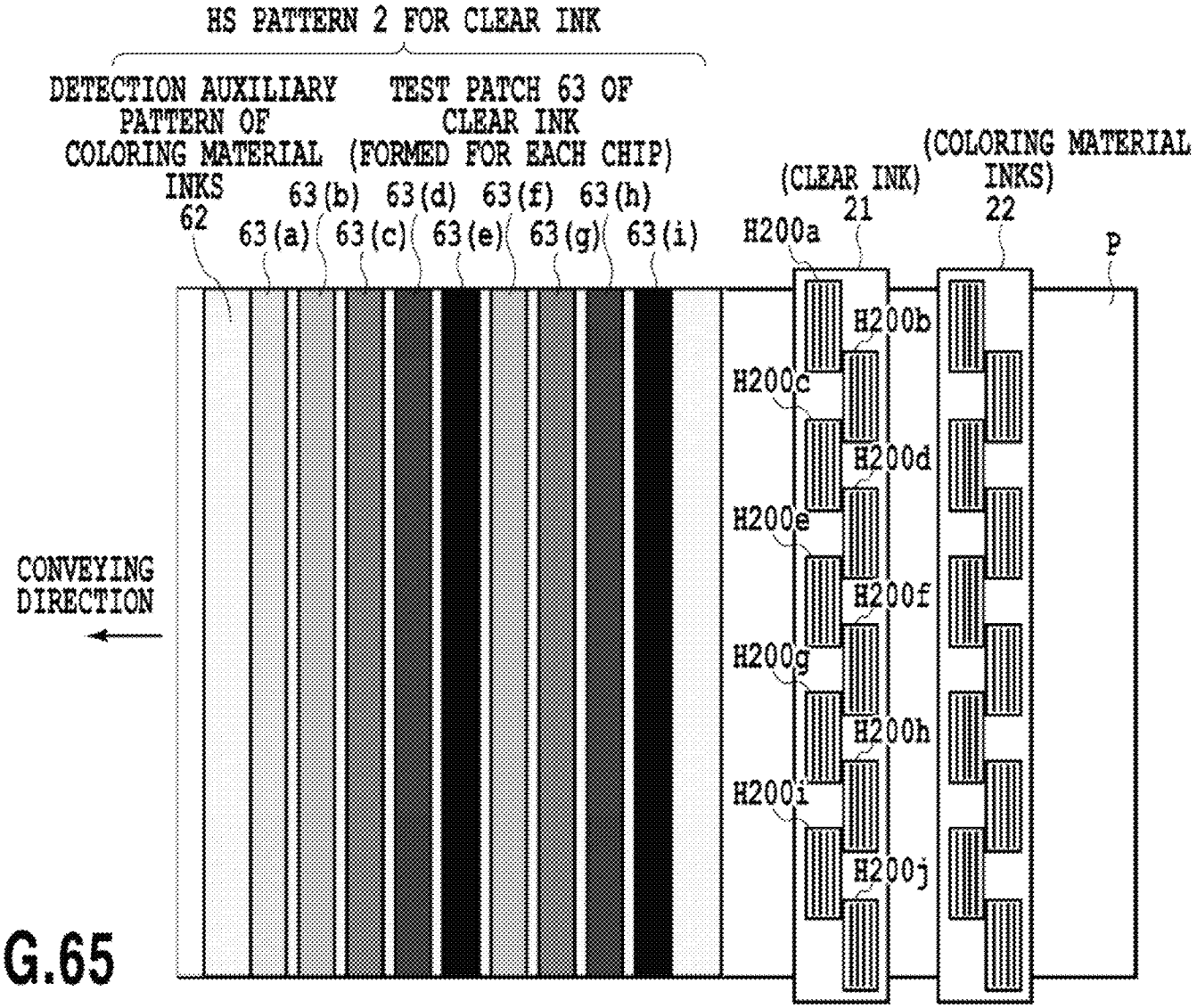
FIG. 65 is a view showing an HS pattern for the clear ink according to the variation of the third embodiment.

FIG. 65 is a view showing the HS pattern for the clear ink according to the present embodiment. Processing for creating the HS table for the clear ink according to the present embodiment is the same as the above-described processing in the third embodiment. The HS pattern for the clear ink (hereinafter referred to as the HS pattern 2) according to the present embodiment is printed by forming a plurality of test patches 63(*a*) to 63(*i*) with different applying amounts of the clear ink. Then, certain applying amounts of the first coloring material ink (Y) and the second coloring material ink (K) are printed on these test patches in an overlapping manner in this order (the detection auxiliary pattern 62). As described above in the third embodiment, in a case where the currently set applying amount of the clear ink is regarded as 100%, the test patches 63(*a*) to 63(*i*) are formed with a total of nine applying amounts 0%, 25%, 50%, 75%, (100%), 125%, 150%, 175%, and 200% wherein the currently set applying amount is a median. Incidentally, the patches 63 of the clear ink are a pattern which is printed by using all the nozzles of each chip, and which has almost the same size as the width of the print medium.

Figure 66:
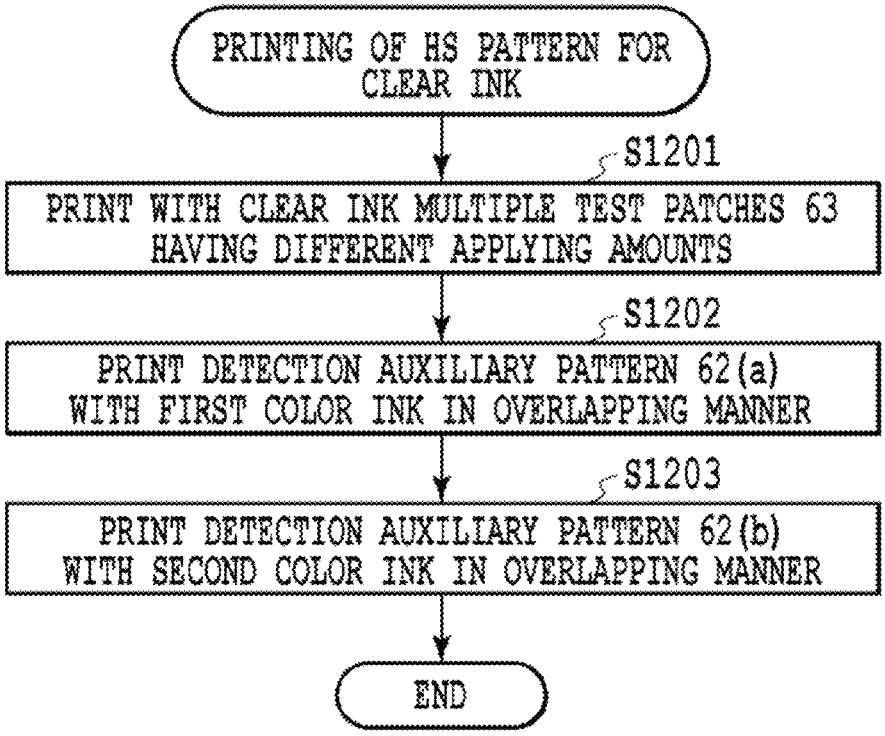
FIG. 66 is a flowchart showing processing for printing the HS pattern for the clear ink according to the variation of the third embodiment.

FIG. 66 is a flowchart showing processing for printing the HS pattern for the clear ink according to the present embodiment. First, the print head 21 for the clear head prints the test patches 63(*a*) to 63(*i*) with the different applying amounts (S1201). These test patches are formed with the nine applying amounts as described above. Next, the uniform detection auxiliary pattern 62 is printed with the first coloring material ink (Y) on the plurality of test patches in an overlapping manner (S1202). Then, the uniform detection auxiliary pattern 62 is printed with the second coloring material ink (K) on the plurality of test patches 63 in this order (S1203).

Figure 67:
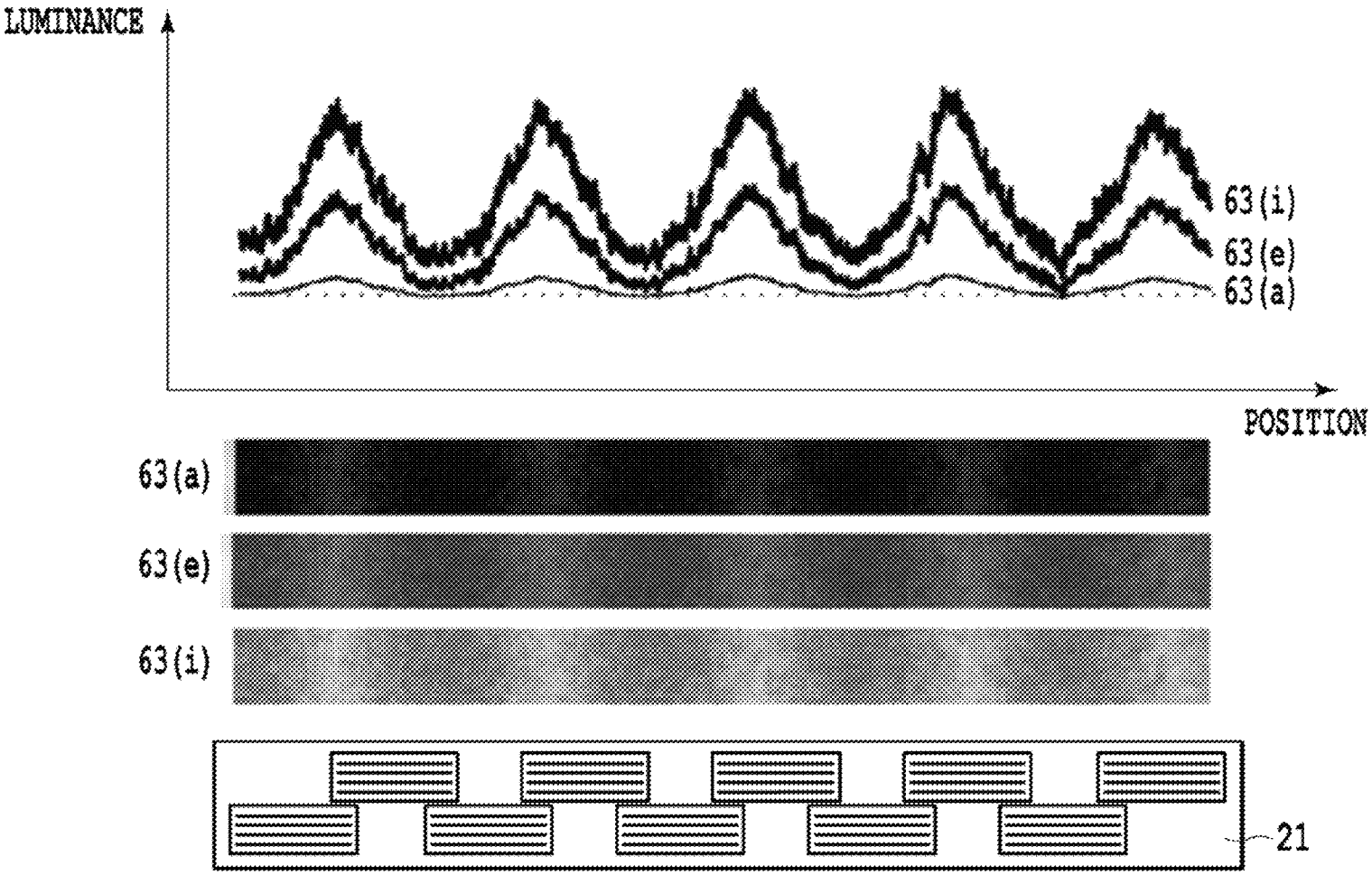
FIG. 67 is a diagram showing the results of measurement of the reflection densities three test patches according to the variation of the third embodiment.

FIG. 67 is a diagram showing the results of measurement of the reflection densities of the teat patches 63(*a*), 63(*e*), and 63(*i*) according to the present embodiment. In the present embodiment, the above-described line scanner obtains luminance data with a resolution of 400 dpi. By using the reading device having such relatively high resolution, it becomes possible to detect the densities in a smaller unit. After the reflection densities are measured, as in the third embodiment, the densities of the test patches 63(*a*) to 63(*i*) are compared for each area of 400 dpi to determine the corrected applying amount of the clear ink.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2015-108411 filed May 23, 2015, No. 2015-108439 filed May 28, 2015, and No. 2016-043681 filed Mar. 7, 2016, which are hereby incorporated by reference wherein in their entirety.

What is claimed is:

1. An inkjet printing apparatus that uses a printing unit for ejecting a first coloring material ink of a first color and a second coloring material ink of a second color whose coloring material is different in type from coloring material of the first coloring material ink and a transparent clear ink for fixing at least the first coloring material ink to a surface of a print medium in order to perform printing on the print medium and performs check processing for checking an ejection operation of the clear ink from a print head, the inkjet printing apparatus comprising:

a receiving unit configured to receive an instruction to perform the check processing; and a controlling unit configured to cause the printing unit to eject the first coloring material ink, the second coloring material ink, and the clear ink so as to print a check pattern used for the check processing, in response to the receiving unit receiving the instruction, wherein at the time of printing the check pattern, the controlling unit causes the printing unit to print the check pattern in which the clear ink, the first coloring material ink, and the second coloring material ink are applied to a check pattern forming area of the print medium in the order of the clear ink, the first coloring material ink, and the second coloring material ink, and in the check pattern, in a portion in which the first coloring material ink and the clear ink are in contact with each other, the print medium is colored in the second color and the first color in the order of the second color and the first color in a direction from a surface side of the print medium toward a back side of the print medium, and in a portion in which the first coloring material ink and the clear ink are not in contact with each other, the print medium is colored in the order of the first color and the second color in the first color and the second color in the direction.

2. The inkjet printing apparatus according to claim 1, wherein the check pattern is an adjustment pattern which is printed by ejecting the first coloring material ink, the second coloring material ink, and the clear ink and has a portion in which a portion printed with the first coloring material ink and the second coloring material ink and a portion printed with the clear ink overlap each other and a portion in which the portion printed with the first coloring material ink and the second coloring material ink and the portion printed with the clear ink do not overlap each other.

3. The inkjet printing apparatus according to claim 2, wherein the second coloring material in is an ink fixed to an upper layer of the first coloring material ink firstly printed on the print medium.

4. The inkjet printing apparatus according to claim 2, wherein in printing the adjustment pattern, a print position of the second coloring material ink serves as a reference for adjusting a print position of the clear ink.

5. The inkjet printing apparatus according to claim 2, wherein the adjustment pattern is composed of a plurality of patches having different print position shift amounts, and a size of the portion in which the portion printed with the first coloring material ink and the second coloring material ink and the portion printed with the clear in overlap each other varies depending on each of the plurality of patches.

6. The inkjet printing apparatus according to claim 2, further comprising:

a light source for irradiating the adjustment pattern; and a detecting unit configured to detect optical characteristics of the adjustment pattern based on reflection light reflected from the adjustment pattern irradiated by the light source, wherein a density of the portion printed with the first coloring material ink which is detected by the detecting unit is lower than a density of the portion printed with the second coloring material ink which is detected by the detecting unit.

7. The inkjet printing apparatus according to claim 6, wherein the light source is a light source in which a reflection density of the portion printed with the first coloring material ink and the second coloring material ink in a case where the portion printed with the first coloring material ink and the second coloring material ink does not overlap the clear ink is lower than a reflection density of the portion printed with the first coloring material ink and the second coloring material ink in a case where the portion printed with the first coloring material ink and the second coloring material ink overlaps the clear ink.

8. The inkjet printing apparatus according to claim 6, wherein the light source is a red light source, the first coloring material ink is a yellow ink or a magenta ink, and the second coloring material ink is a cyan ink or a black ink.

9. The inkjet printing apparatus according to claim 6, wherein the light source is a green light source, the first coloring material ink is a cyan ink or a yellow ink, and the second coloring material ink is a magenta ink or a black ink.

10. The inkjet printing apparatus according to claim 6, wherein the light source is a blue light source, the first coloring material ink is a magenta ink or a cyan ink, and the second coloring material ink is a yellow ink or a black ink.

11. The inkjet printing apparatus according to claim 2, wherein lightness of a portion printed with the first coloring material ink is higher than lightness of a portion printed with the second coloring material ink.

12. The inkjet printing apparatus according to claim 6, further comprising a selecting unit configured to select a combination of the first coloring material ink and the second coloring material ink which are used to print the adjustment pattern and the light source for irradiating the adjustment pattern before printing the adjustment pattern by using the clear ink, a plurality of the coloring material inks whose coloring materials are different in type from each other, and a plurality of the light sources.

13. The inkjet printing apparatus according to claim 1, wherein the check pattern is a test pattern which is printed by ejecting the first coloring material ink, the second coloring material ink, and the clear ink from respective nozzles and has a portion in which a portion printed with the first coloring material ink and the second coloring material ink and a portion printed with the clear ink overlap each other and a portion in which the portion printed with the first color in material ink and the second coloring material into and the portion printed with the clear ink do not overlap each other.

14. The inkjet printing apparatus according to claim 13, wherein the second coloring material ink is an ink fixed to an upper layer of the first coloring material ink firstly printed on the print medium.

15. The inkjet printing apparatus according to claim 13, further comprising:

a light source for irradiating the test pattern; and a detecting unit configured to detect optical characteristics of the test pattern based on reflection light reflected from the test pattern irradiated by the light source, wherein a density of the portion printed with the first coloring material ink which is detected by the detecting unit is lower than a density of the portion printed with the second coloring material ink which is detected by the detecting unit.

16. The inkjet printing apparatus according to claim 15, wherein the light source is a light source in which a reflection density of the portion printed with the first coloring material ink and the second coloring material ink in a case where the portion printed with the first coloring material ink and the second coloring material ink does not overlap the clear ink is lower than a reflection density of the portion printed with the first coloring material ink and the second coloring material ink in a case where the portion printed with the first coloring material ink and the second coloring material ink overlaps the clear ink.

17. The inkjet printing apparatus according to claim 15, wherein the light source is a red light source, the first coloring material ink is a yellow ink or a magenta ink, and the second coloring material ink is a cyan ink or a black ink.

18. The inkjet printing apparatus according to claim 15, wherein the light source is a green light source, the first coloring material ink is a cyan ink or a yellow ink, and the second coloring material ink is a magenta ink or a black ink.

19. The inkjet printing apparatus according to claim 15, wherein the light source is a blue light source, the first coloring material ink is a magenta ink or a cyan ink, and the second coloring material ink is a yellow ink or a black ink.

20. The inkjet printing apparatus according to claim 15, wherein the clear ink is ejected from the nozzle by supplying a driving pulse to an ejection heater, and the test pattern is a pattern for detecting a pulse width of the driving pulse for ejecting the clear ink from the nozzle for the clear ink.

21. The inkjet printing apparatus according to claim 20, wherein in a case where a density of the portion printed with the clear ink which is detected by the detecting unit is equal to or higher than a predetermined threshold, the printing unit prints the test pattern with the driving pulse having a shorter pulse width, and in a case where a density of the portion printed with the clear ink which is detected by the detecting unit is lower than the predetermined threshold, the driving pulse for ejecting the clear ink is set based on the driving pulse at the time of printing the portion to be printed with the clear ink.

22. The inkjet printing apparatus according to claim 13, wherein lightness of a portion printed with the first coloring material ink is higher than lightness of a portion printed with the second coloring material ink.

23. The inkjet printing apparatus according to claim 13, wherein the test pattern is a pattern for detecting a failure to eject the clear ink from a nozzle for the clear ink.

24. The inkjet printing apparatus according to claim 1, wherein the check pattern is a correction pattern having a portion in which the portion printed with the first coloring material ink and the second coloring material ink and a plurality of portions printed with the clear ink in different applying amounts overlap each other.

25. The inkjet printing apparatus according to claim 24, wherein the second coloring material ink is an ink fixed to an upper layer of the first coloring material ink firstly printed on the print medium.

26. The inkjet printing apparatus according to claim 24, further comprising:

a light source for irradiating the correction pattern; and a detecting unit configured to detect optical characteristics of the correction pattern based on reflection light reflected from the correction pattern irradiated by the light source, wherein a density of the portion printed with the first coloring material ink which is detected by the detecting unit is lower than a density of the portion printed with the second coloring material ink which is detected by the detecting unit.

27. The inkjet printing apparatus according to claim 26, wherein the correction pattern is printed for each width which is larger than a reading resolution of the detecting unit.

28. The inkjet printing apparatus according to claim 26, wherein the light source is red light source, the first coloring material ink is a yellow ink or a magenta ink, and the second coloring material ink is a cyan ink or a black ink.

29. The inkjet printing apparatus according to claim 26, wherein the light source is a green light source, the first coloring material ink is a cyan ink or a yellow ink, and the second coloring material ink is a magenta ink or a black ink.

30. The inkjet printing apparatus according to claim 26, wherein the light source is a blue light source, the first coloring material ink is a magenta ink or a cyan ink, and the second coloring material ink is a yellow ink or a black ink.

31. The inkjet printing apparatus according to claim 24, wherein the print head for the clear ink includes a plurality of print chips each provided with a plurality of nozzles, and the correction pattern is printed for each print chip.

32. The inkjet printing apparatus according to claim 24, wherein lightness of a portion printed with the first coloring material ink is higher than lightness of a portion printed with the second coloring material ink.

33. A check pattern printing method of printing a check pattern for checking an ejection operation of a transparent clear ink from a print head by using a printing unit for ejecting a first coloring material ink of a first color and a second coloring material ink of a second color whose coloring material is different in type from coloring material of the first coloring material ink and the clear ink for fixing at least the first coloring material ink to a surface of the print medium so as to perform printing on a print medium, the check pattern printing method comprising:

printing the check pattern used for the check processing by ejecting the first coloring material ink, the second coloring material ink, and the clear ink, wherein in the printing step, at the time of printing the check pattern, the check pattern is printed in which the clear ink, the first coloring material ink, and the second coloring material ink are applied to a check pattern forming area of the print medium in the order of the clear ink, the first coloring material ink, and the second coloring material ink, and in the check pattern, in a portion in which the first coloring material ink and the clear ink are in contact with each other, the print medium is colored in the second color and the first color in the order of the second color and the first color in a direction from a surface side of the print medium toward a back side of the print medium, and in a portion in which the first coloring material ink and the clear ink are not in contact with each other, the print medium is colored in the order of the first color and the second color in the first color and the second color in the direction.

* * * * *